US012721431B2

(12) United States Patent
Goldberg et al.

(10) Patent No.: US 12,721,431 B2
(45) Date of Patent: Sep. 1, 2026

(54) CLUSTER BOOTH

(71) Applicant: NPS Public Furniture Corp., Clifton, NJ (US)

(72) Inventors: Avraham Y. Goldberg, Lakewood, NJ (US); Michael Joel Bacha, Montclair, NJ (US); Yehuda Freundlich, Passaic, NJ (US); Elchonon M. Jacobson, Passaic, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 0 days.

(21) Appl. No.: 19/636,019

(22) Filed: Apr. 1, 2026

(65) Prior Publication Data

US 2026/0224028 A1 Aug. 6, 2026

Related U.S. Application Data

(63) Continuation-in-part of application No. 29/896,767, filed on Jul. 7, 2023, now Pat. No. Des. 1,123,419.

(51) Int. Cl.
*A47B 83/02* (2006.01)
*A47B 13/02* (2006.01)
(Continued)

(52) U.S. Cl.
CPC ..... *A47B 83/024* (2017.08); *A47B 13/02* (2013.01); *A47B 83/02* (2013.01); *A47B 83/023* (2017.08); *A47C 3/18* (2013.01); *A47B 2013/006* (2013.01)

(58) Field of Classification Search
CPC ..... A47B 83/02; A47B 83/023; A47B 83/024; A47B 13/02; A47B 2013/006; A47C 3/18
See application file for complete search history.

(56) References Cited

U.S. PATENT DOCUMENTS

D193,001 S 6/1962 Mason
3,266,840 A * 8/1966 D'Estrube ..... A47B 83/02 297/158.3
(Continued)

FOREIGN PATENT DOCUMENTS

CH 717727 A2 * 2/2022 ..... A47B 83/0213
CN 3614473 2/2007
(Continued)

OTHER PUBLICATIONS

Cluster Swivel Booth by National Public Seating, retrieved online, site visited Sep. 9, 2025, URL: https://www.nationalpublicseating.com/products/cluster%20swivel%20Booth Year: 2024.

*Primary Examiner* — Rodney B White
(74) *Attorney, Agent, or Firm* — Weiss & Arons LLP

(57) ABSTRACT

A cluster booth is provided. The cluster booth may include a table, one or more seats and one or more brackets. The table may be coupled via first rectangular tube to a second rectangular tube. Each of the one or more seats may include a protrusion. The protrusion may extend from an underside of the seat. Each of the one or more brackets may include a bracket tube and a u-shaped portion. The u-shaped portion may include a right face, a left face and a top face. The bracket tube may be coupled to the top face of the u-shaped portion. The bracket may be configured to receive the protrusion. The u-shaped portion may be configured to encase the second rectangular tube on at least three faces of the second rectangular tube. The second rectangular tube may be coupled to set of support structures.

18 Claims, 46 Drawing Sheets

(51) Int. Cl.
*A47C 3/18* (2006.01)
*A47B 13/00* (2006.01)

(56) References Cited

U.S. PATENT DOCUMENTS

| | | | | | |
|---|---|---|---|---|---|
| D209,758 | S | | 1/1968 | Blink | |
| D209,841 | S | | 1/1968 | Bue | |
| 3,411,823 | A | * | 11/1968 | Bue | A47B 83/02 297/344.21 |
| 3,486,790 | A | | 12/1969 | Barecki et al. | |
| 3,494,662 | A | * | 2/1970 | Anderson | A47B 13/16 248/188 |
| 3,535,000 | A | * | 10/1970 | Protzmann | A47B 83/02 297/142 |
| 3,596,985 | A | * | 8/1971 | Degagne | A47B 83/02 297/157.1 |
| D228,162 | S | | 8/1973 | Fink | |
| D285,151 | S | | 8/1986 | Molinari | |
| 4,850,642 | A | * | 7/1989 | Crowe | A47B 83/02 108/91 |
| 4,921,303 | A | * | 5/1990 | White | A47C 9/00 297/338 |
| 5,452,936 | A | * | 9/1995 | Koehring | A47B 83/02 297/161 |
| 5,615,621 | A | | 4/1997 | Mengshoel et al. | |
| 5,782,526 | A | * | 7/1998 | Ott | A47B 83/02 297/157.1 |
| 5,884,966 | A | * | 3/1999 | Hill | A47C 7/62 297/170 |
| D439,428 | S | | 3/2001 | Mizuno | |
| D479,773 | S | | 9/2003 | Pajerski et al. | |
| D496,169 | S | | 9/2004 | Hightower | |
| 6,848,741 | B2 | * | 2/2005 | Ford | A47B 83/02 297/157.1 |
| 6,899,385 | B2 | * | 5/2005 | Pernicka | A47B 83/02 297/344.21 |
| 7,393,049 | B2 | * | 7/2008 | Chase | A47C 4/02 297/157.1 |
| 7,758,113 | B2 | * | 7/2010 | Hanusiak | A47C 9/10 297/157.1 |
| D685,201 | S | | 7/2013 | Fentress et al. | |
| 9,101,218 | B2 | * | 8/2015 | Bradley | A47B 83/02 |
| 10,477,969 | B2 | * | 11/2019 | Klokk | A47B 83/02 |
| 2005/0168017 | A1 | * | 8/2005 | Pernicka | A47B 83/02 297/142 |
| 2016/0302571 | A1 | * | 10/2016 | McBride | A47B 83/02 |

FOREIGN PATENT DOCUMENTS

| | | | | | |
|---|---|---|---|---|---|
| CN | 301191767 | | | 5/2010 | |
| CN | 111195019 | A | * | 5/2020 | A47C 3/185 |
| EP | 3449772 | A1 | * | 3/2019 | A47B 83/02 |
| ES | I0098368 | | | 2/1982 | |
| KR | 3002872330000 | | | 12/2001 | |
| KR | 1633915 | B1 | * | 7/2016 | A47B 83/02 |
| KR | 1691749 | B1 | * | 1/2017 | A47B 83/02 |
| RU | 7485 | | | 10/1969 | |
| TW | 106300994 | | | 1/2018 | |

* cited by examiner

CLUSTER BOOTH

CROSS-REFERENCE TO RELATED APPLICATION

This application is a continuation-in-part of co-pending, commonly-assigned U.S. Design patent application Ser. No. 29/896,767 filed on Jul. 7, 2023, and entitled "CLUSTER SWIVEL BOOTH," which is hereby incorporated by reference herein in its entirety.

FIELD OF TECHNOLOGY

Aspects of the disclosure relate to mechanical designs and apparatus. Specifically, aspects of the disclosure relate to seating booths.

BACKGROUND OF THE DISCLOSURE

Seating is an important facet of everyday life. Seats are used to enable a person to sit.

There are a variety of seating options available. A sampling of these seating options include chairs with backs, backless chairs, stools, couches and recliners.

Many times, seating options are used together with tables. The chair, when used with a table, may enable a person to sit while engaging in an activity. Activities may include eating and operating a computer.

At times, when the seats are disconnected from the tables, the seats may be removed from the location of the table and unavailable for use at a time when a user would like to use the seat and table.

Therefore, it would be desirable to combine seats and a table into a high-strength, reduced-footprint single booth.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
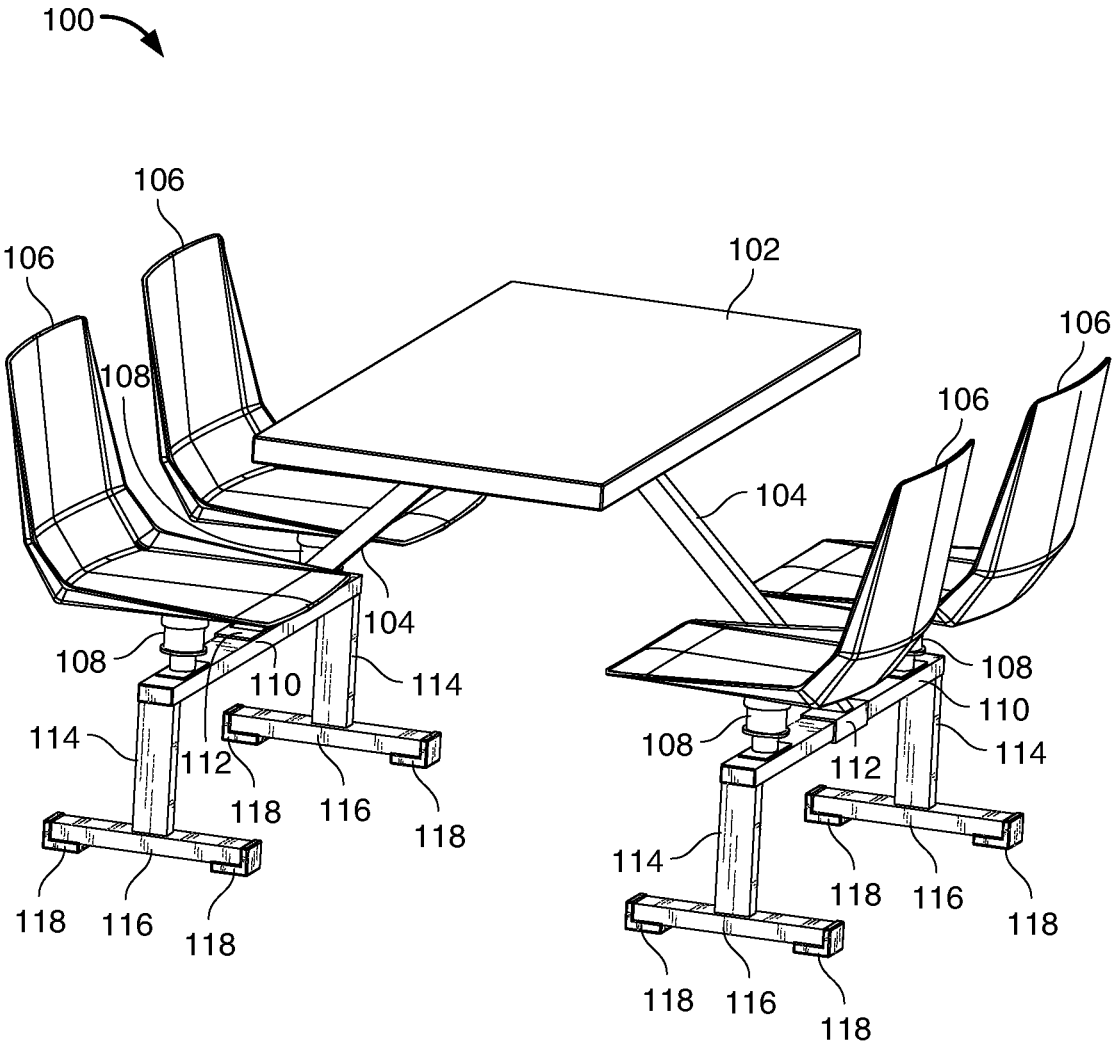
FIG. 1 shows an illustrative apparatus in accordance with principles of the disclosure.

A cluster booth is provided. The cluster booth may include one or more tables, one or more seats, one or more benches, one or more rectangular tubes (also referred to herein as a bar or pole) and/or one or more brackets.

Each of the tables, seats, rectangular tubes and brackets may include one or more materials. The material may include any material listed in Table 1.

TABLE 1

| Illustrative materials.<br>Illustrative materials. |
|---|
| Wood |
| Plastic |
| Metal |
| Aluminum |
| 18-gauge steel |
| 16-gauge steel |
| 3-gauge steel |
| Any suitable gauge steel |
| Any other suitable materials |
| Any suitable combination thereof |

The table may refer to a rectangular substrate upon which activities may be performed. The table may be coupled, via a first rectangular tube, to a second rectangular tube. The table may be coupled, via a third rectangular tube, to a fourth rectangular tube.

The cluster booth may include any suitable number of seats and/or any suitable number of benches. The cluster booth may preferably include four seats and/or two benches. Each side of the table may preferably accommodate two seats or one bench. The seats may be stools, such as, for example, circular stools, triangular stools, rectangular stools and square stools. The seats may be chairs. It should be noted that any combination of different seats and/or benches may be used. The combination may include, for example, one bench and two circle stools. The combination may include two chairs and one bench. Each seat may include a protrusion extending from an underside of the seat.

The cluster booth may include any suitable number of brackets. Preferably, the number of brackets may correspond to the number of seats included in the cluster booth. As such, the cluster booth may include four brackets. Each bracket may include a bracket tube. Each bracket may include a u-shaped portion. The u-shaped portion may include a right face, a left face and a top face. The bracket tube may be coupled to the top face of the u-shaped portion. The bracket tube may be welded to the top face of the u-shaped portion.

The u-shaped portion may include one or more apertures. Preferably, the u-shaped portion may include two apertures. The two apertures may be located on the top of face of the u-shaped portion. A first of the two apertures may be adjacent to a right side of a bracket tube. A second of the two apertures may be adjacent to a left side of the bracket tube. The two apertures and the bracket tube may be located laterally equidistant from the right face and the left face. Each of the two apertures may be operable to receive a bolt (also referred to herein as a screw). The bolt may engage the u-shaped portion, a top face of the second rectangular tube and a bottom face of the second rectangular tube. A nut may secure the bolt at the bottom face of the second rectangular tube. Each of the two apertures may enable the u-shaped portion to be secured to the second rectangular tube.

Each bracket may include four triangular support flanges. Each of the four triangular support flanges may include a first base side and a second base side. Each of the four triangular support flanges may be coupled by the first base side to the bracket tube. Each of the four triangular support flanges may be coupled by the second base side to the u-shape portion.

Each of the four triangular support flanges may include a right triangle. The first base side may be a first leg of the right triangle. The first leg may be an adjacent leg of the right triangle. The first leg may be an opposite leg of the right triangle. The first leg may preferably not be a hypotenuse of the right triangle. The second base side may be a second leg of the right triangle. The second leg may be an adjacent leg of the right triangle. The second leg may be an opposite leg of the right triangle. The second leg may preferably not be a hypotenuse of the right triangle.

The bracket tube may be configured to receive the protrusion. The protrusion may be at least partially hollow. The protrusion may include multiple apertures. The protrusion may include at least two apertures. The protrusion may be configured to receive the bracket tube. The bracket tube may include two apertures. The two apertures, included in the bracket tube, may correspond to two of the apertures included in the protrusion. A bolt may be configured to thread through a first aperture included in the bracket tube, a first aperture included in the protrusion, a second aperture included in the protrusion and a second aperture included in the bracket tube. A nut may secure the bolt at the second aperture included in the protrusion. The bolt and/or nut may secure the bracket and/or bracket tube to the seat. The bracket tube may be secured to the seat.

The u-shaped portion of a first bracket supporting a first seat and the u-shaped portion of a second bracket supporting a second seat may be configured to encase the second rectangular tube. The term encase, when referenced in this application, may include partially encase or surround. The encasing may be on less than three faces of the second rectangular tube. The second rectangular tube may be coupled to a first set of support structures. The first set of support structures may support the cluster booth. The first set of support structures may include a first vertical leg and a second vertical leg. The first vertical leg and the second vertical leg may extend perpendicularly from the second rectangular tube. The first vertical leg may include a first glide (also referred to herein as a foot). The first glide may contact a ground level. The second vertical leg may include a second glide. The second glide may contact the ground level.

The u-shaped portion of a third bracket supporting a third seat and the u-shaped portion of a fourth bracket supporting a fourth seat may be configured to encase the fourth rectangular tube. The encasing may involve contact between the u-shaped portion and one, two or three faces of the fourth rectangular tube. It should be noted that the right face the u-shaped portion may have a smaller width than the contacting face of the fourth rectangular tube. It should be noted that the left face the u-shaped portion may have a smaller width than the contacting face of the fourth rectangular tube.

The fourth rectangular tube may be parallel to the second rectangular tube. The second rectangular tube and the fourth rectangular tube may be located on opposite sides of the table. The fourth rectangular tube may be coupled to a second set of support structures. The second set of support structures may support the cluster booth. The second set of support structures may include a third vertical leg and a fourth vertical leg. The third vertical leg and the fourth vertical leg may extend perpendicularly from the fourth rectangular tube. The third vertical leg may include a third glide. The third glide may contact the ground level. The fourth vertical leg may include a fourth glide. The fourth glide may contact the ground level. The second set of support structures may be parallel to the first rectangular tube. The first set of support structures and the second set of support structures may be located on opposite sides of the table.

A first angle formed by the intersection of an underside of the table and a top face of the first rectangular tube may be less than 90 degrees. In certain embodiments, the first angle may be between about 40 degrees and 50 degrees. Preferably, the first angle may be approximately 45 degrees. A second angle formed by the intersection of the underside of the table and a top face of the third rectangular tube may be less than 90 degrees. In certain embodiments, the second angle may be between about 40 degrees and 50 degrees. Preferably, the second angle may be approximately 45 degrees. The first angle may be substantially equivalent to the second angle.

The cluster booth may include additional brackets. The additional brackets may be referred to herein, as the fifth bracket and/or the sixth bracket. A first additional bracket may couple the first rectangular tube to the second rectangular tube. A second additional bracket may couple the third rectangular tube to the fourth rectangular tube. Each additional bracket may include a u-shape. Each additional bracket may include a top face, a side face and a bottom face. The top face of the additional bracket may extend further laterally than the bottom face of the additional bracket.

The top face of the first additional bracket may be welded, or otherwise coupled, to the first rectangular tube. The angle formed by the intersection of the top face of the first additional bracket and the top face of the first rectangular tube may be approximately 45 degrees. The angle formed by the intersection of a bottom face of the first rectangular tube and a top face of the second rectangular tube may be approximately 45 degrees. The first additional bracket may be configured to contact and/or encase the second rectangular tube. The contact and/or encasing between the additional bracket and the second rectangular tube may involve one, two, three or four faces of the second rectangular tube. In certain embodiments, the contact and/or encasing may involve not less than three faces of the second rectangular tube.

The top face of the second additional bracket may be welded, or otherwise coupled, to the third rectangular tube. The angle formed by the intersection of the top face of the second additional bracket and the top face of the third rectangular tube may be approximately 45 degrees. The angle formed by the intersection of a bottom face of the third rectangular tube and a top face of the fourth rectangular tube may be approximately 45 degrees. The second additional bracket may be configured to contact and/or encase the fourth rectangular tube. The contact and/or encasing between the additional bracket and the fourth rectangular tube may involve one, two, three or four faces of the fourth rectangular tube. In certain embodiments, the contact and/or encasing may involve not less than three faces of the fourth rectangular tube.

When the cluster booth involves one or more benches, the cluster booth may utilize a different bracket than the brackets described above in connection with the seats. The brackets used to couple a bench to the cluster booth may be referred to herein, in the alternative, as a support bracket or a bench bracket. The support bracket and the components thereof may include a material from the materials listed in Table 1.

The support bracket may include a plate, a rectangular bracket tube, a first triangular support flange, a second triangular support flange and a u-shaped portion. The plate may include a top face, a bottom face and a plurality of apertures. The rectangular bracket tube may include four faces, a proximal end and a distal end. The distal end of the rectangular bracket tube may be welded, or otherwise coupled, to the bottom face of the plate. The plurality of apertures may be configured to receive a plurality of bolts. The plurality of bolts may couple the support bracket to the underside of the bench.

The four faces may include a first face, a second face, a third face and a fourth face. The first triangular support flange may include a right triangle. The second triangular support flange may also include a right triangle.

The first triangular support flange may include a first base side and a second base side. The first triangular support flange may be coupled by the first base side to a right side of the first face of the rectangular bracket tube. The first triangular support flange may be coupled by the second base side to the bottom face of the plate. The first base side may be a first leg of the right triangle. The second base side may be a second leg of the right triangle.

The second triangular support flange may include a first base side and a second base side. The second triangular support flange may be coupled by the first base side to a left side of the first face of the rectangular bracket tube. The second triangular support flange may be coupled by the second base side to the bottom face of the plate. The first base side is a first leg of the right triangle. The second base side is a second leg of the right triangle.

The u-shaped portion may include a right face, a left face and a top face. The right face may be of similar proportions to the left face. The proximal end of the rectangular bracket tube may be coupled to the top face of the u-shaped portion.

The u-shaped portion is configured to encase, or otherwise contact, the second rectangular tube. The encasement and/or contact may involve one, two, three or four faces of the second rectangular tube. In certain embodiments, the u-shaped portion may be configured to encase and/or contact not less than three faces of the second rectangular tube. The second rectangular tube may be coupled to the first set of support structures. The u-shaped portion may include one or more apertures. Preferably, the u-shaped portion may include two apertures. The two apertures may be located on the top of face of the u-shaped portion. A first of the two apertures may be adjacent to a right side of the bracket tube. A second of the two apertures may be adjacent to a left side of the bracket tube. The two apertures and the bracket tube may be located laterally equidistant from the right face and the left face. Each of the two apertures may be operable to receive a bolt. The bolt may engage the u-shaped portion, a top face of the second rectangular tube and a bottom face of the second rectangular tube. A nut may secure the bolt at the bottom face of the second rectangular tube. Each of the two apertures may enable the u-shaped portion to be secured to the second rectangular tube.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure. The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g. 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

FIG. 1 shows illustrative top right perspective view of cluster booth 100. Illustrative cluster booth 100 includes table 102. Table 102 may refer to a rectangular substrate upon which activities may be performed.

Table 102 may be coupled to rectangular tubes 104. Illustrative cluster booth 100 may preferably include two rectangular tubes 104. Each of rectangular tubes 104 may be coupled, via bracket 112, to rectangular tube 110. Rectangular tube 110 may be coupled to multiple support structures 114. Each of support structures 114 may be coupled to leg 116. Each leg 116 may be coupled to glides 118. Each leg 116 may preferably be coupled to two or more glides 118. Glides 118 may enable leg 116 to glide on a surface, such as a floor or ground.

Chair 106 may be coupled, via a swivel mount 108, to rectangular tube 110. Each of swivel mounts 108 may enable chair 106 to swivel, while remain attached, to rectangular tube 110. There may be multiple chairs, such as, for example, two chairs, coupled to rectangular tube 110. There may be two rectangular tubes 110. As such, there may be preferably four chairs in cluster booth 100.

Figure 2:
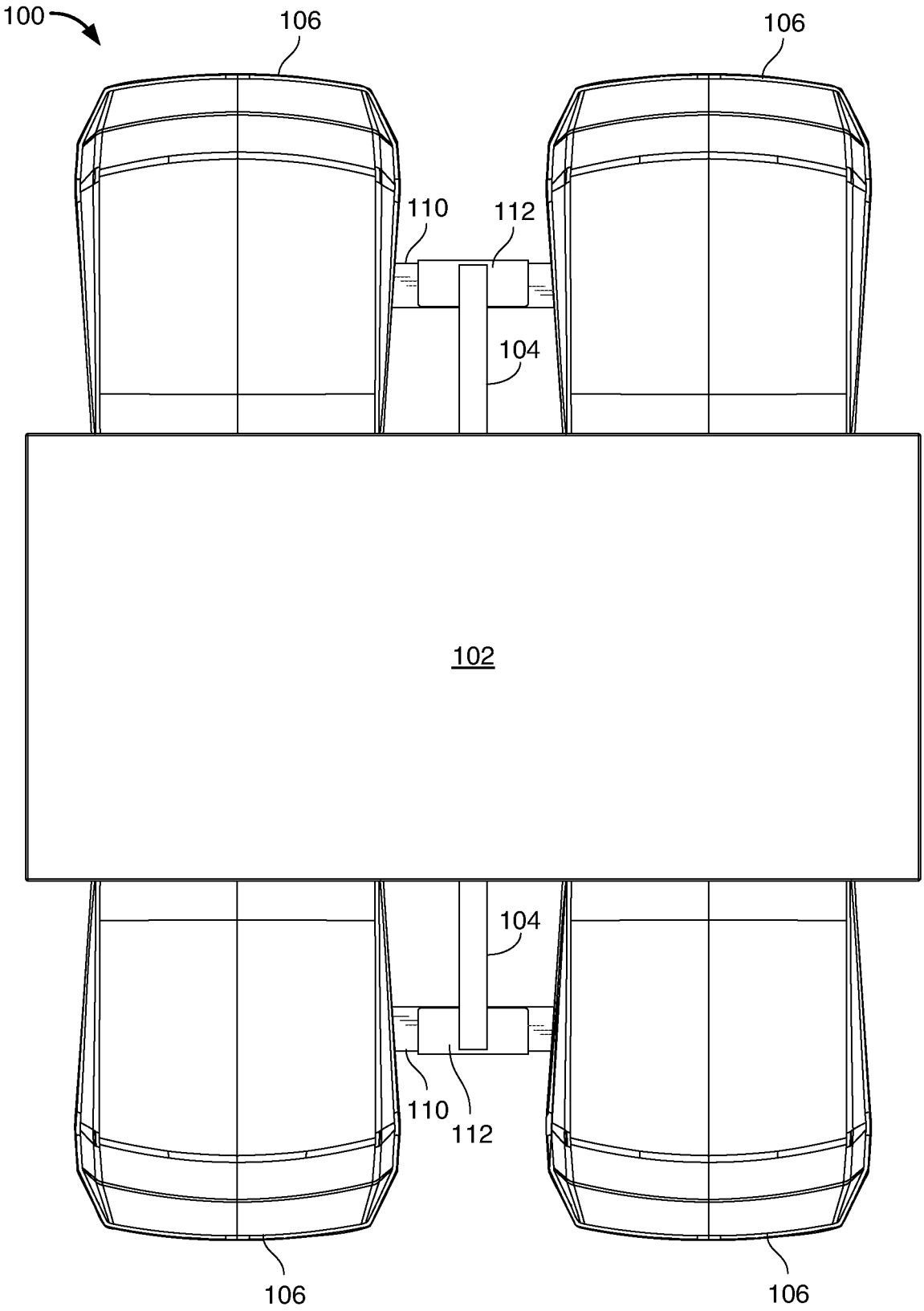
FIG. 2 shows an illustrative apparatus in accordance with principles of the disclosure.

FIG. 2 shows an illustrative top view of cluster booth 100.

Figure 3:
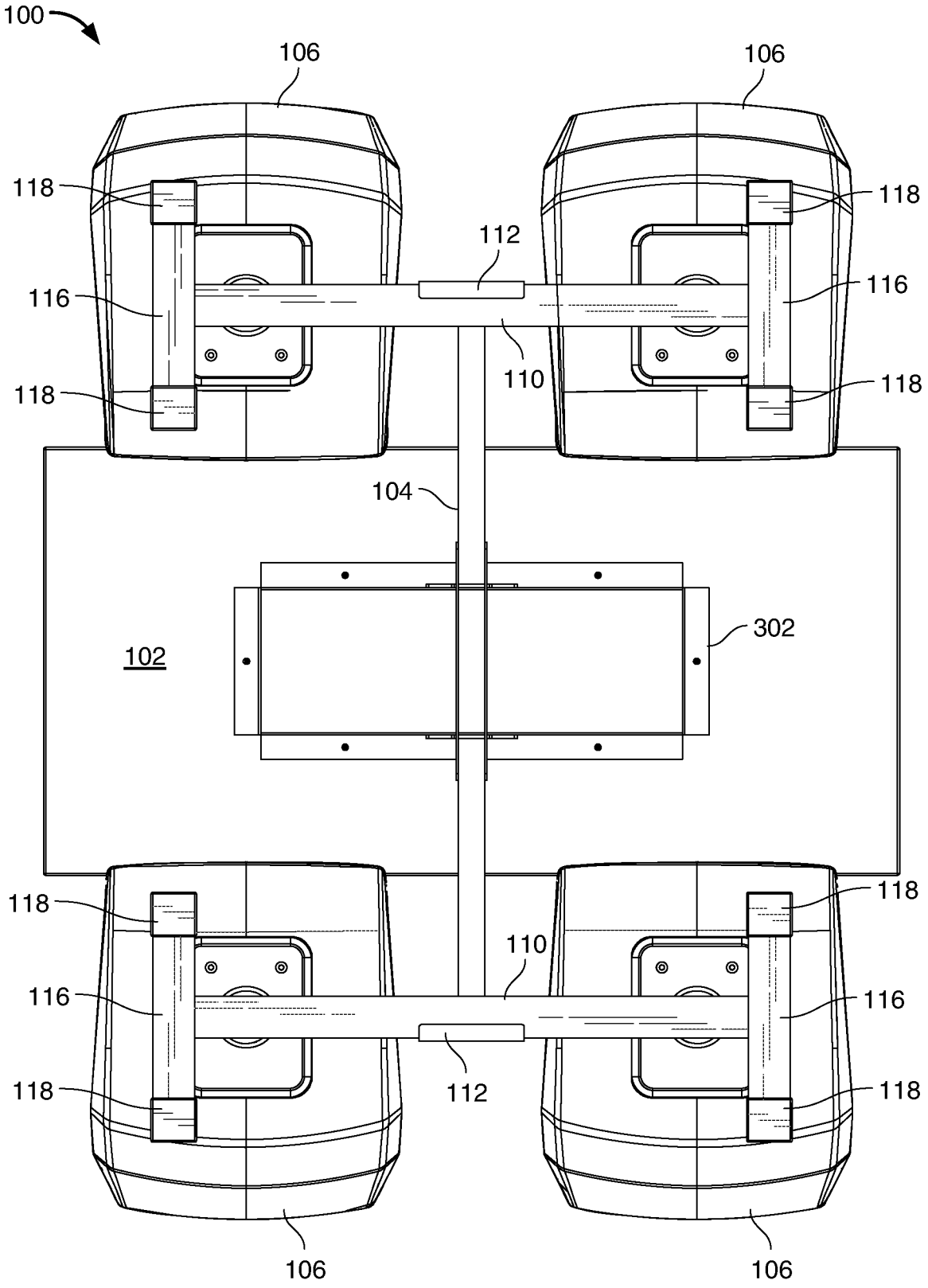
FIG. 3 shows an illustrative apparatus in accordance with principles of the disclosure.

FIG. 3 shows an illustrative bottom view of cluster booth 100. It should be noted that, as shown within the bottom view, table support 302 may be coupled to table 102. Table support 302 may include four L-shaped brackets. Each of the four L-shaped brackets may include a bottom face and a side face. The bottom face and/or the side face of the four L-shaped brackets may include one or more apertures. The apertures on the bottom face of the L-shaped brackets may be configured to receive one or more bolts. The bolts may couple table support 302 to table 102.

Rectangular tube 104 may be coupled, via a coupling bracket (shown as 602 in FIG. 6), to table support 302. The coupling bracket may be welded, bolted and/or otherwise coupled, to table support 302. The coupling bracket may be welded, bolted and/or otherwise coupled, to rectangular tube 104. A support bar (shown as 402 in FIG. 4) may couple the first rectangular tube 104 to the second rectangular tube 104. A second support bar may couple the first rectangular tube 104 to the second rectangular tube 104. The first support bar and the second support bar may be located on opposite faces of the first rectangular tube 104 and the second rectangular tube 104.

Figure 4:
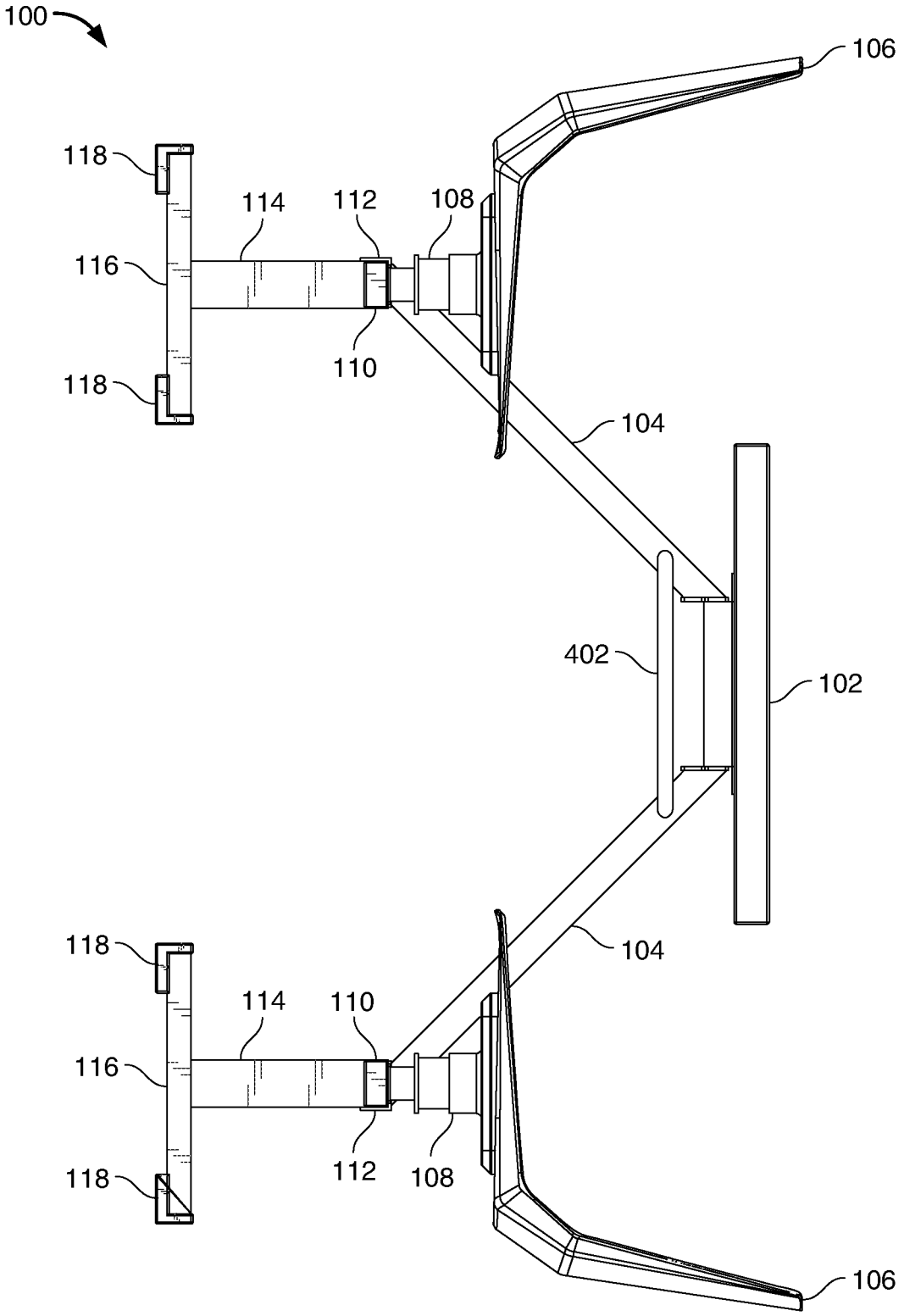
FIG. 4 shows an illustrative apparatus in accordance with principles of the disclosure.

FIG. 4 shows an illustrative front view of cluster booth 100. A first support bar 402 couples the first rectangular tube 104 to the second rectangular tube 104.

Figure 5:
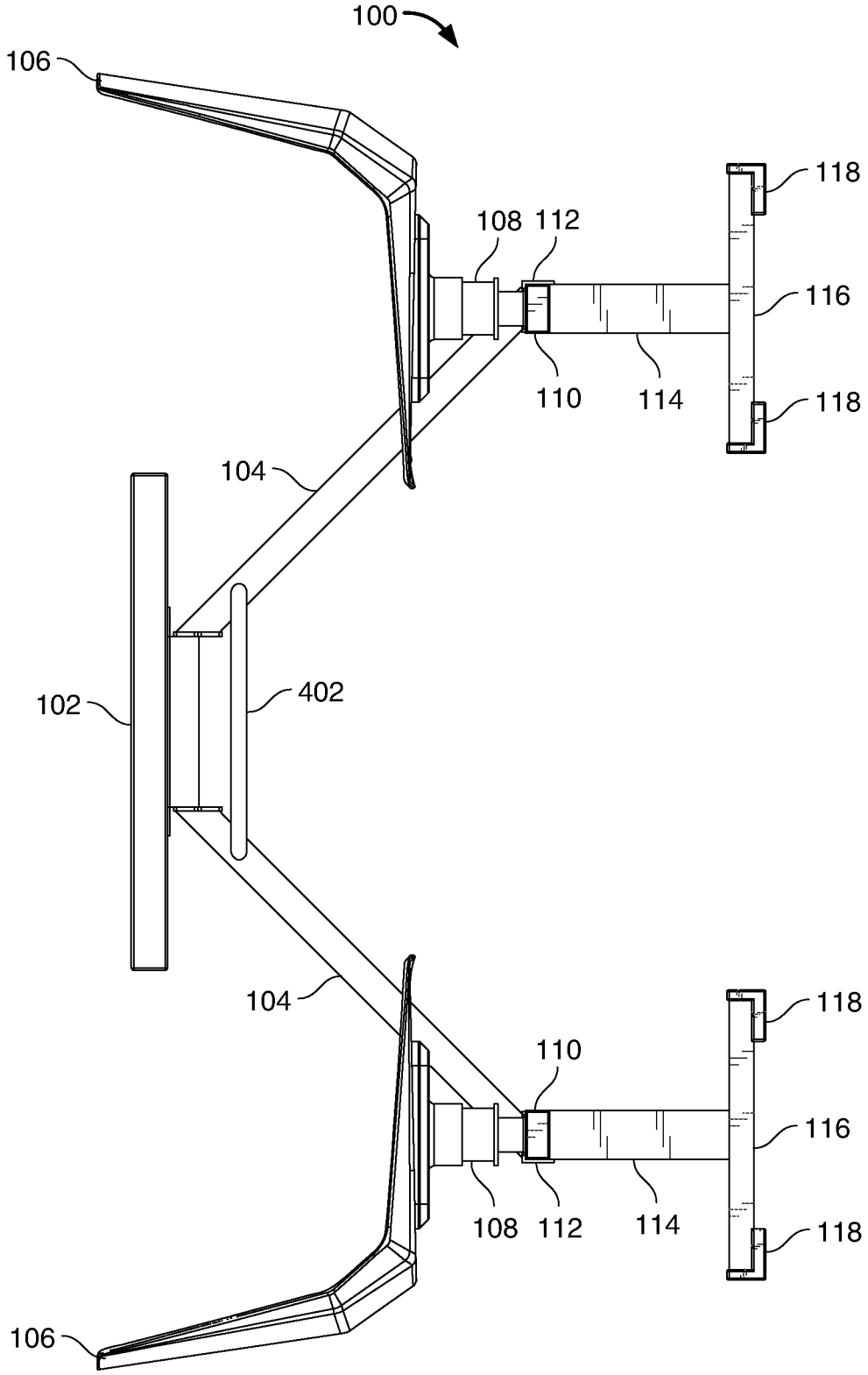
FIG. 5 shows an illustrative apparatus in accordance with principles of the disclosure.

FIG. 5 shows an illustrative back view of cluster booth 100. A second support bar 402 couples the first rectangular tube 104 to the second rectangular tube 104.

Figure 6:
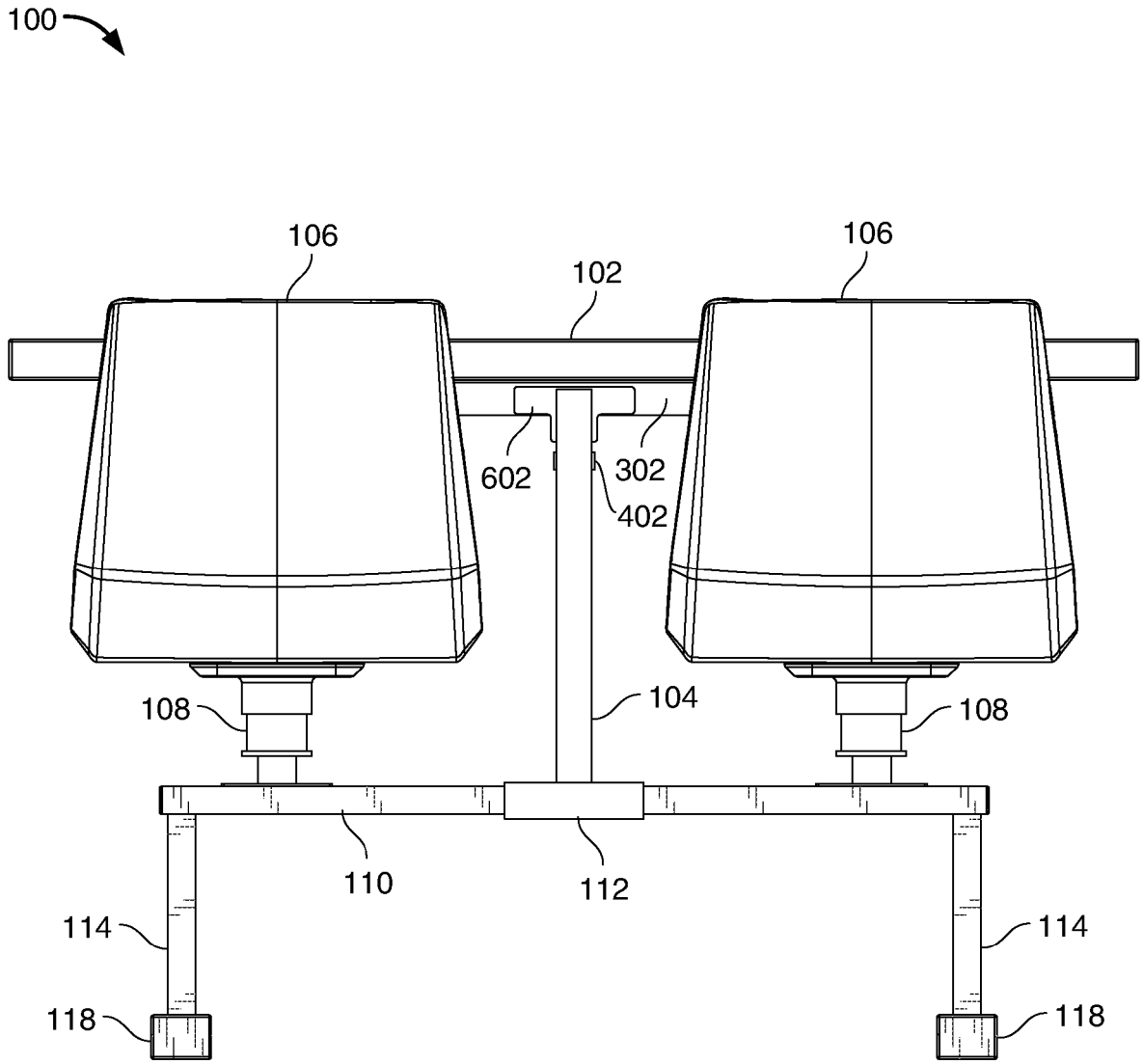
FIG. 6 shows an illustrative apparatus in accordance with principles of the disclosure.

FIG. 6 shows an illustrative left view of cluster booth 100. Coupling bracket 602 may couple rectangular tube 104 to table 102 via coupling bracket 602 and table support 302.

Figure 7:
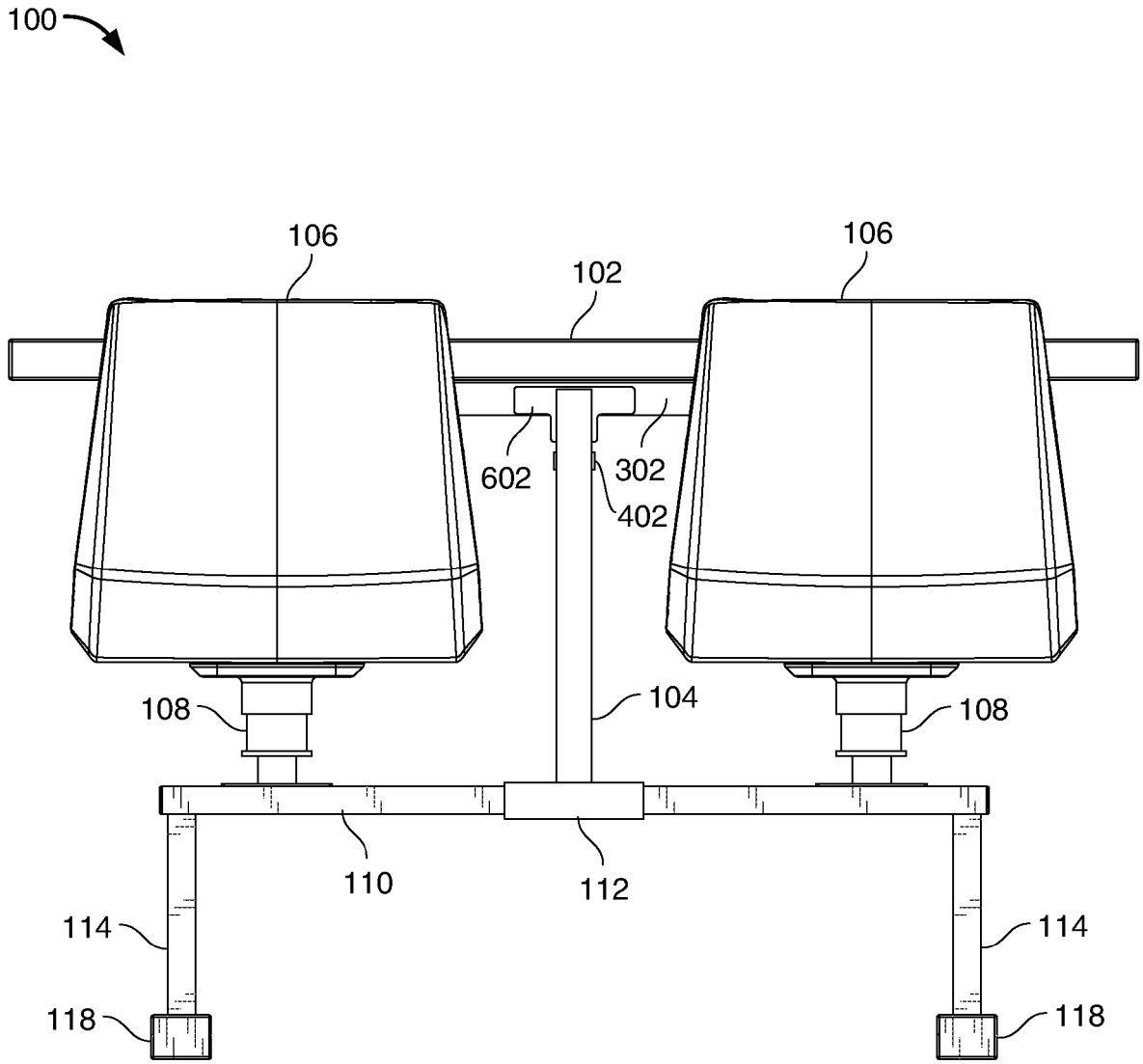
FIG. 7 shows an illustrative apparatus in accordance with principles of the disclosure.

FIG. 7 shows an illustrative right view of cluster booth 100.

Figure 8:
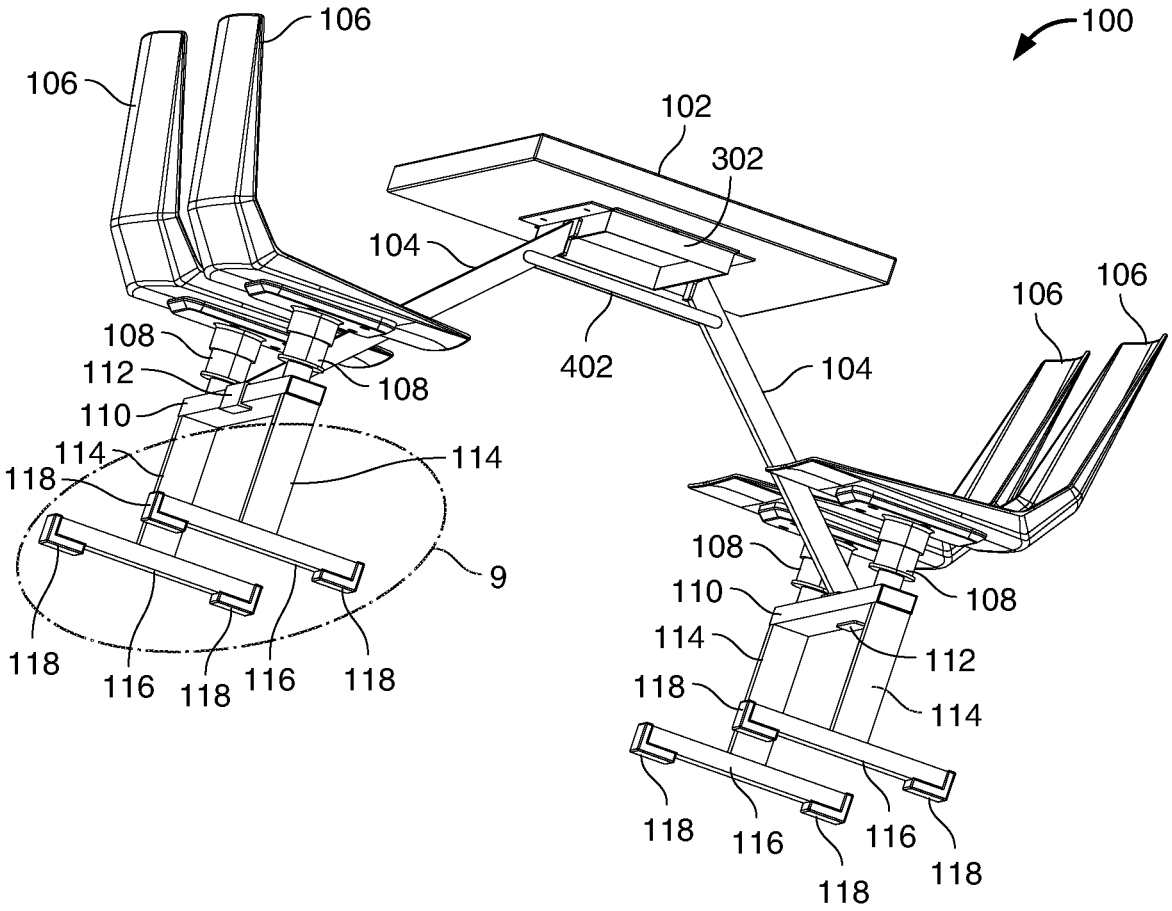
FIG. 8 shows an illustrative apparatus in accordance with principles of the disclosure.

FIG. 8 shows an illustrative bottom perspective view of cluster booth 100. It should be noted that swivel mount 108 may include multiple elements to enable the coupling between chair 106 and rectangular tube 110.

Figure 9:
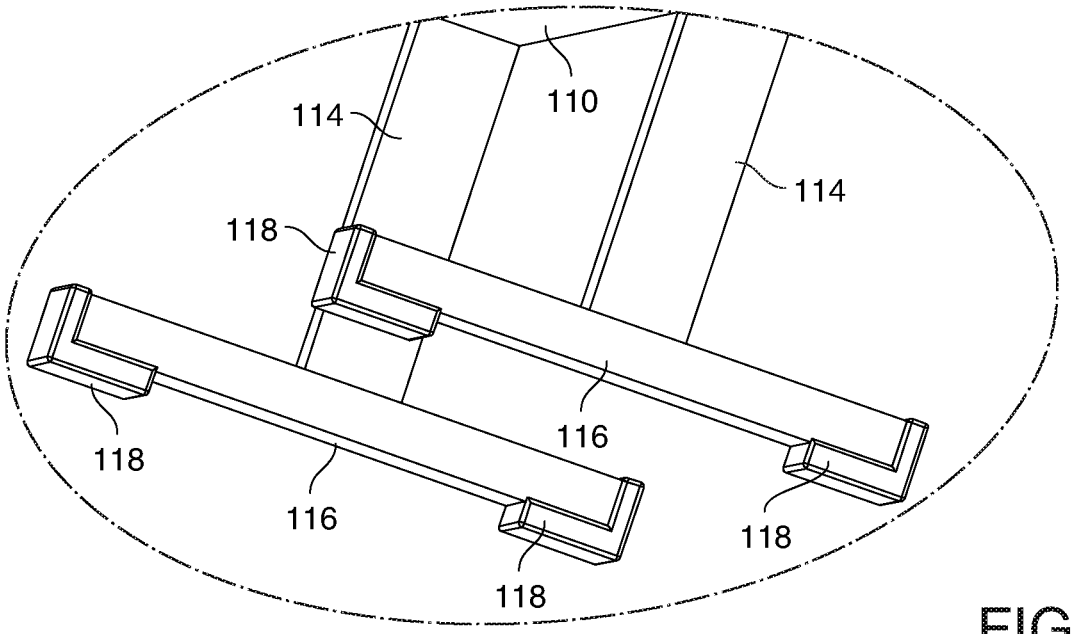
FIG. 9 shows an illustrative apparatus in accordance with principles of the disclosure.

FIG. 9 shows an illustrative bottom perspective view of an enlarged portion of the legs, taken from the circle part in FIG. 8, shown separately for completeness of illustration.

Figure 10:
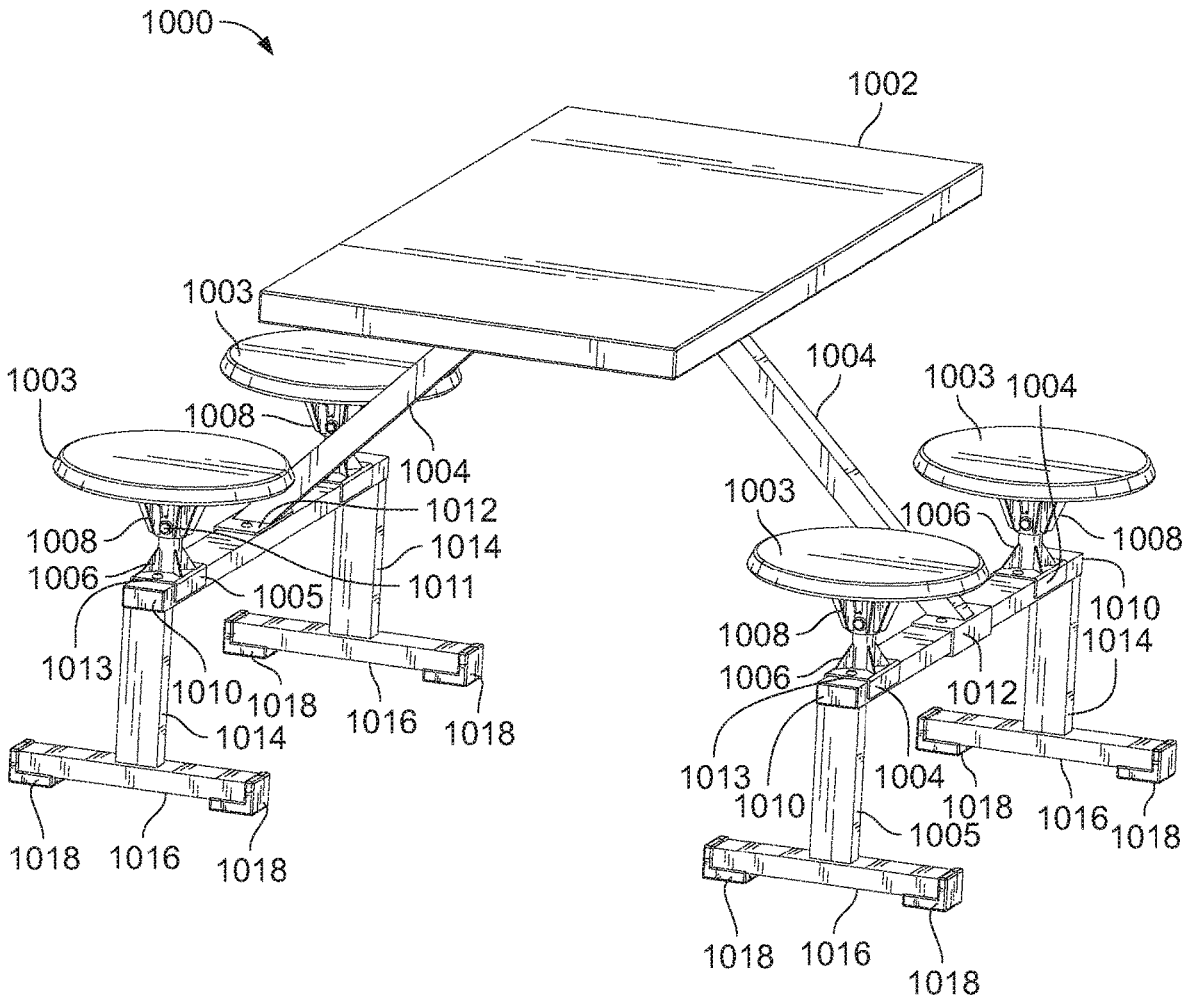
FIG. 10 shows an illustrative apparatus in accordance with principles of the disclosure.

FIG. 10 shows an illustrative top right perspective view of cluster booth 1000. Cluster booth 1000 may include table 1002. Table 1002 may refer to a rectangular substrate upon which activities may be performed. Table 1002 may be similar to table 102 discussed in connection with cluster booth 100.

Table 1002 may be coupled to rectangular tubes 1004. Each of rectangular tubes 1004 may be similar to rectangular tubes 104 discussed in connection with cluster booth 100. Each of rectangular tubes 1004 may be coupled, via bracket 1012, to rectangular tube 1010. Each of brackets 1012 may be similar to brackets 112 discussed in connection with cluster booth 100. Rectangular tubes 1010 may be similar to rectangular tubes 110 discussed in connection with cluster booth 100.

Rectangular tubes 1010 may be coupled to multiple support structures 1014. Support structures 1014 may be similar to support structures 114 discussed in connection with cluster booth 100. Each of support structures 1014 may be coupled to leg 1016. Each leg 1016 may be similar to leg 116 discussed in connection with cluster booth 100. Each leg 1016 may be coupled to glides 1018. Each leg 1016 may preferably be coupled to two or more glides 1018. Glides 1018 may be similar to glides 118 discussed in connection with cluster booth 100. Glides 1018 may enable leg 1016 to glide on a surface, such as a floor or ground.

Stool seat 1003 may be coupled to rectangular tube 1010 via a seat mount. The seat mount may include u-shaped portion 1005. The seat mount may include bracket tube 1006. The seat mount may be coupled, via u-shaped portion 1005, to rectangular tube 1010. U-shaped portion 1005 may be bolted to rectangular tube 1010. Bolts 1013 may couple u-shaped portion 1005 to rectangular tube 1010. Bracket tube 1006 may fit into a hollow portion of protrusion 1008, which protrudes from an underside of stool seat 1003. Bolts 1011 may couple bracket tube 1006 to protrusion 1008.

Figure 11:
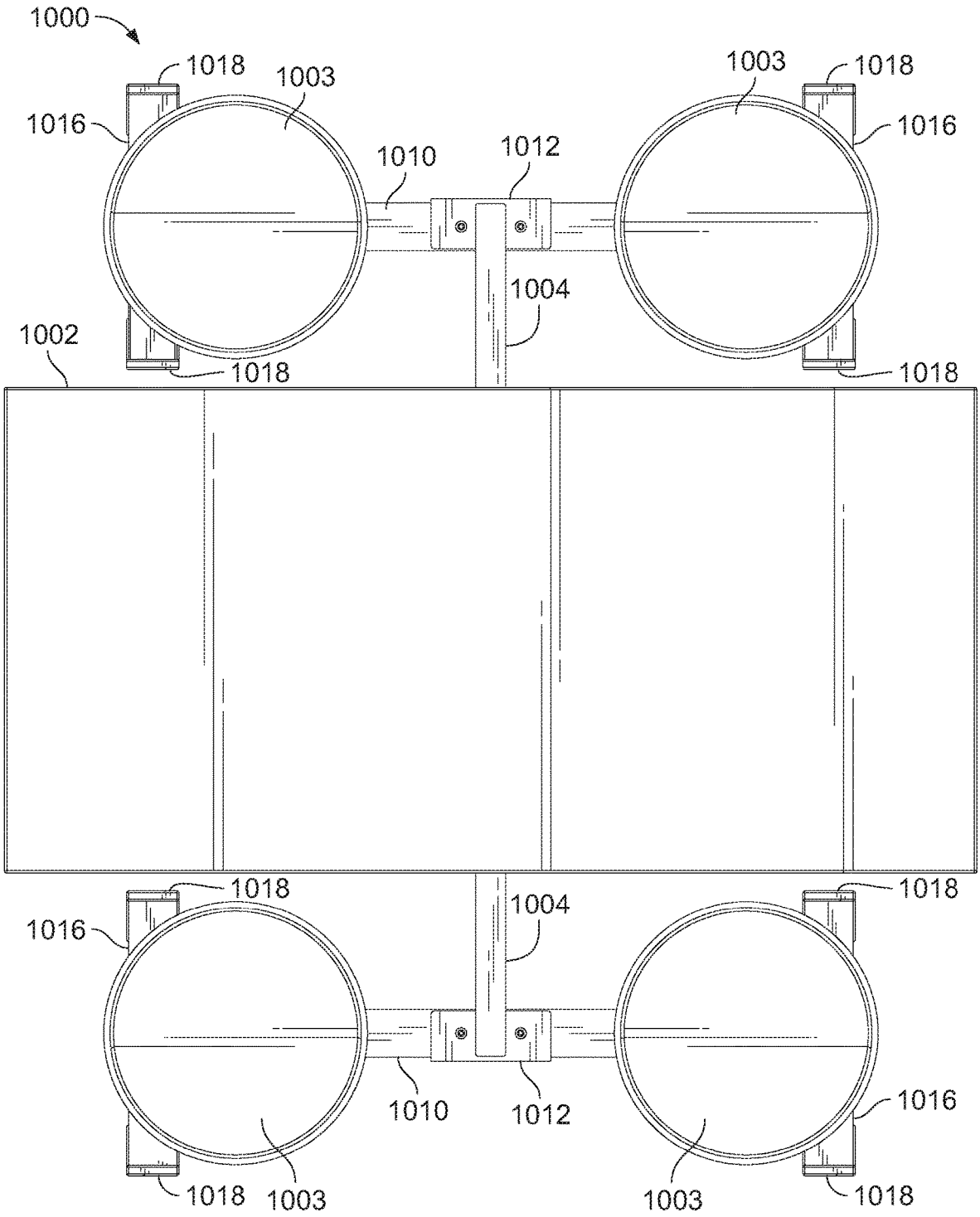
FIG. 11 shows an illustrative apparatus in accordance with principles of the disclosure.

FIG. 11 shows an illustrative top view of cluster booth 1000.

Figure 12:
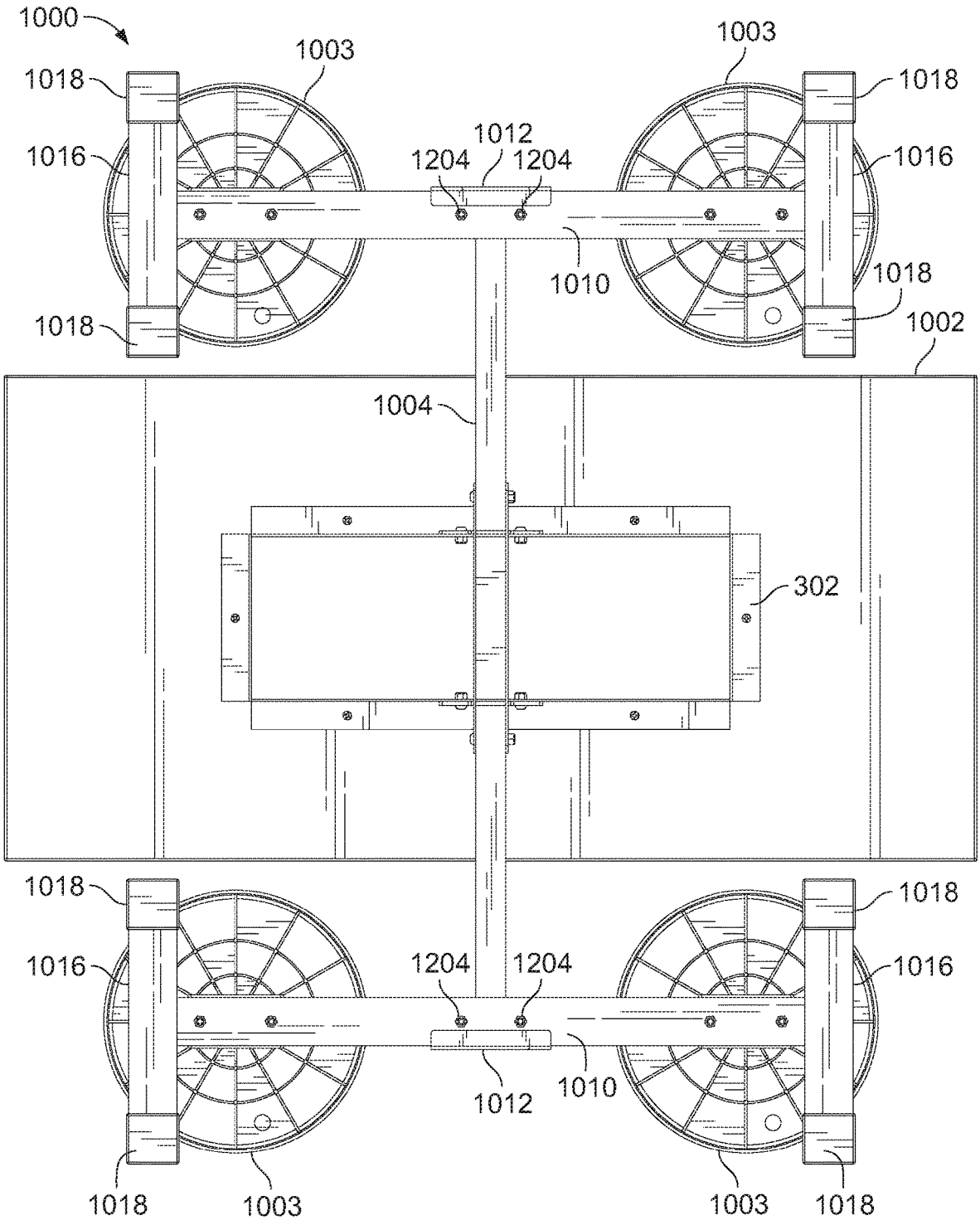
FIG. 12 shows an illustrative apparatus in accordance with principles of the disclosure.

FIG. 12 shows an illustrative bottom view of cluster booth 1000. Nuts 1204 may secure bolts screwed into bracket 1012 and rectangular tube 1010.

Figure 13:
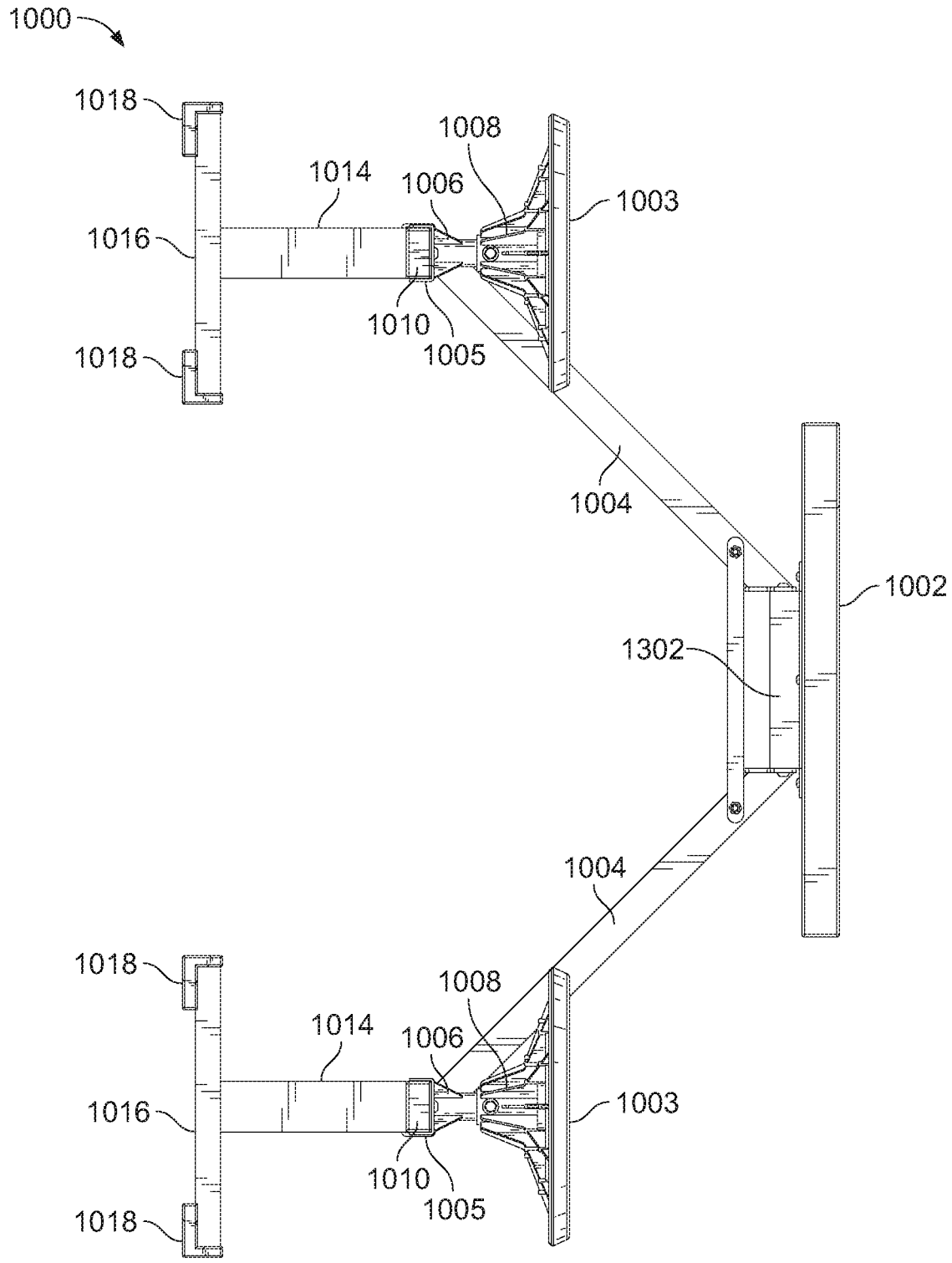
FIG. 13 shows an illustrative apparatus in accordance with principles of the disclosure.

FIG. 13 shows an illustrative front view of cluster booth 1000. Illustrative side view shows table support 1302. Table support 1302 may be similar to table support 302 shown in FIG. 3.

Rectangular tube 1004 may be coupled, via a coupling bracket, to table support 302. The coupling bracket may be welded, bolted and/or otherwise coupled, to table support 1302. The coupling bracket may be welded, bolted and/or otherwise coupled, to rectangular tube 1004. A support bar may couple the first rectangular tube 1004 to the second rectangular tube 1004. A second support bar may couple the first rectangular tube 1004 to the second rectangular tube 1004. The support bar(s) may be welded, bolted and/or otherwise coupled to the first rectangular tube 1004 and/or the second rectangular tube 1004. The first support bar and the second support bar may be located on opposite faces of the first rectangular tube 104 and the second rectangular tube 1004.

Figure 14:
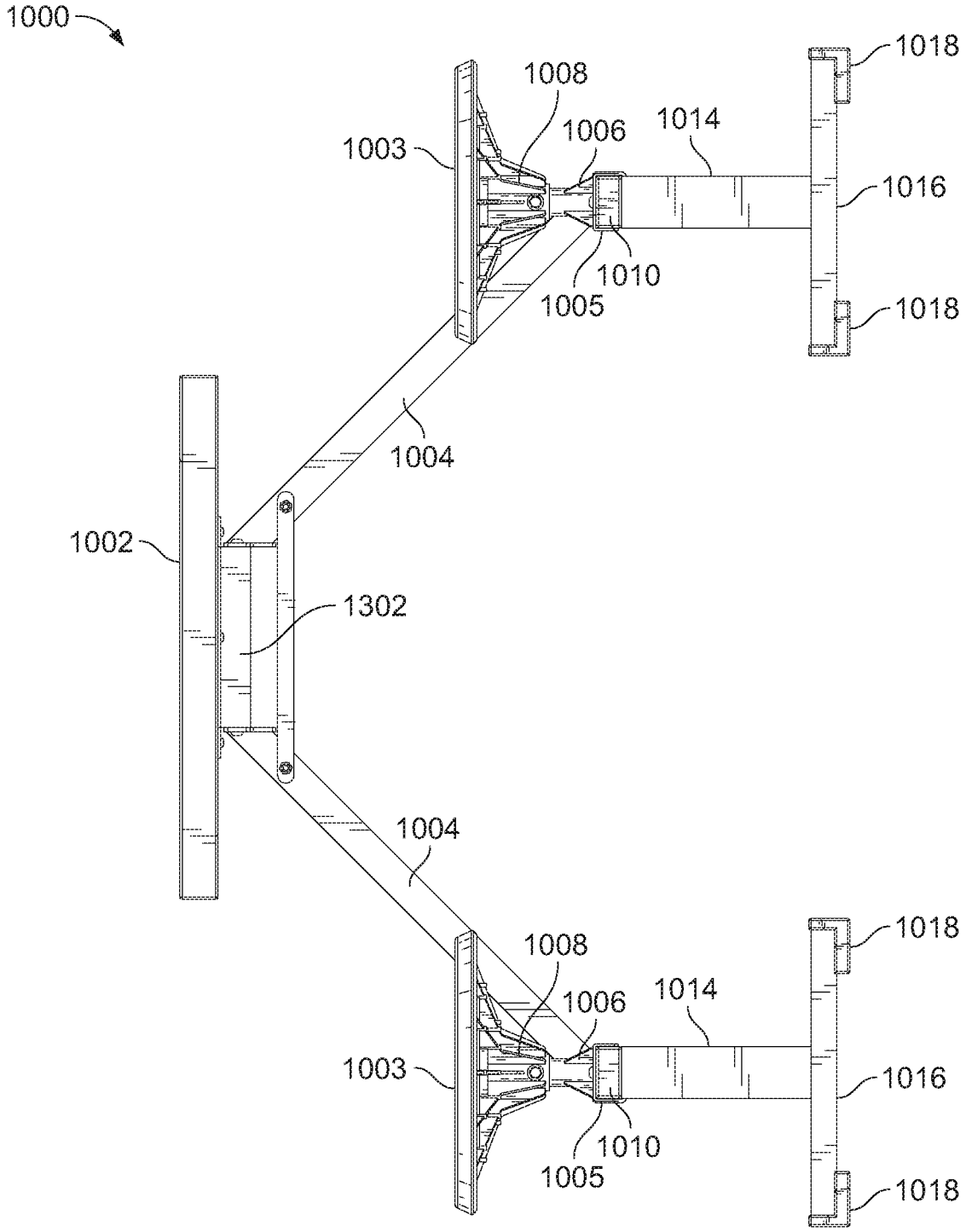
FIG. 14 shows an illustrative apparatus in accordance with principles of the disclosure.

FIG. 14 shows an illustrative back view of cluster booth 1000.

Figure 15:
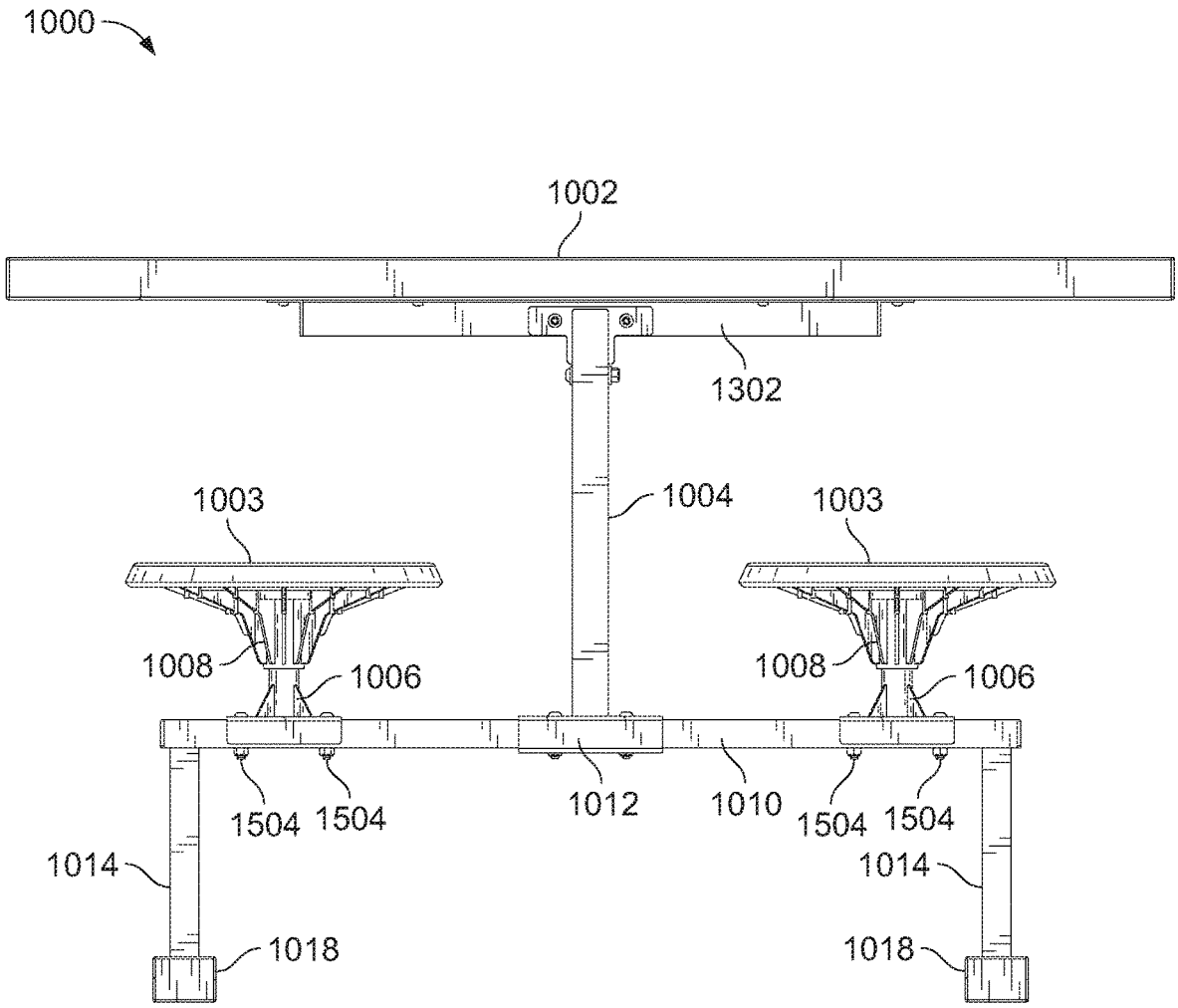
FIG. 15 shows an illustrative apparatus in accordance with principles of the disclosure.

FIG. 15 shows an illustrative left view of cluster booth 1000. As shown in FIG. 15, nuts 1504 may secure bolts 1013.

Figure 16:
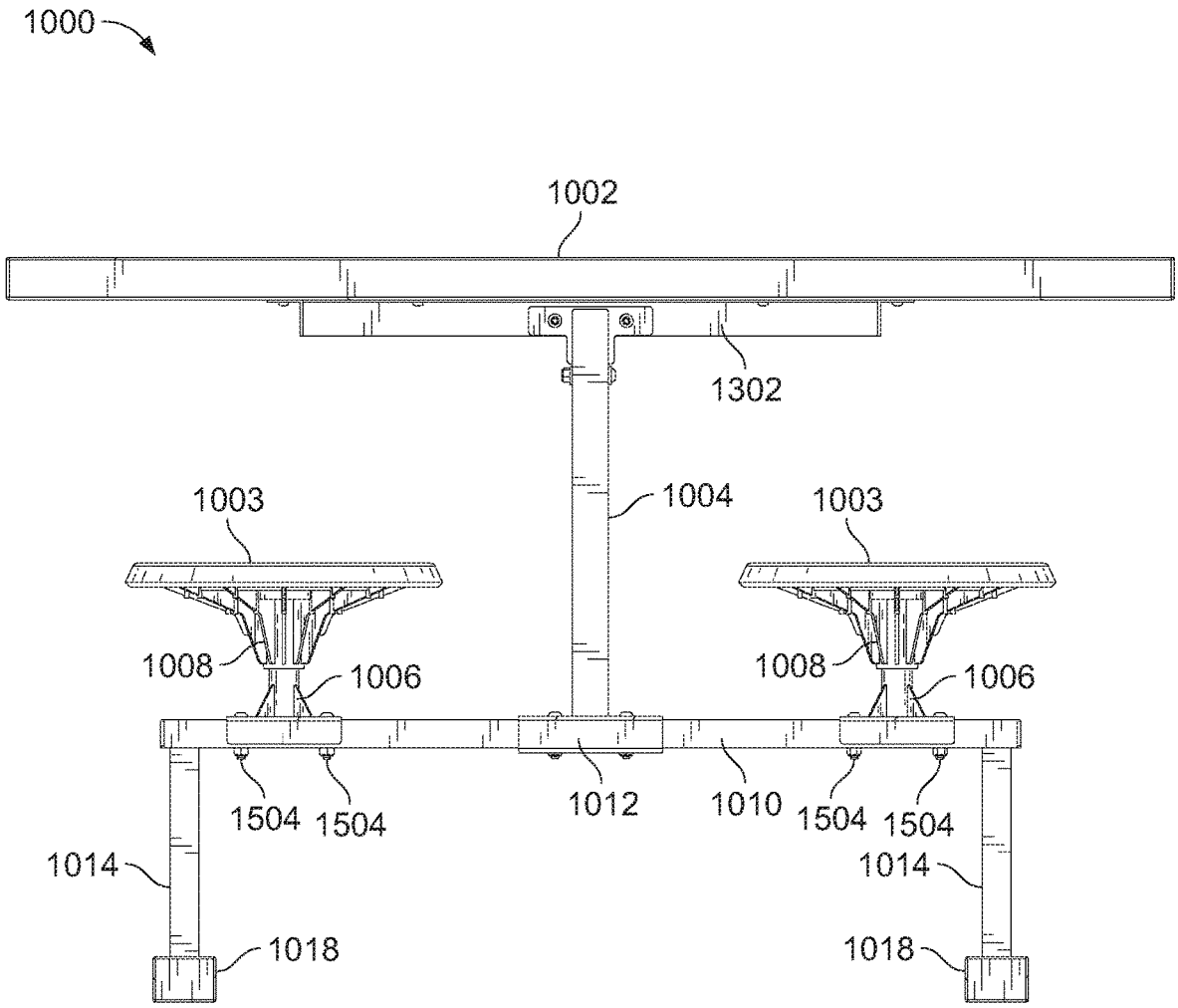
FIG. 16 shows an illustrative apparatus in accordance with principles of the disclosure.

FIG. 16 shows an illustrative right view of cluster booth 1000.

Figure 17:
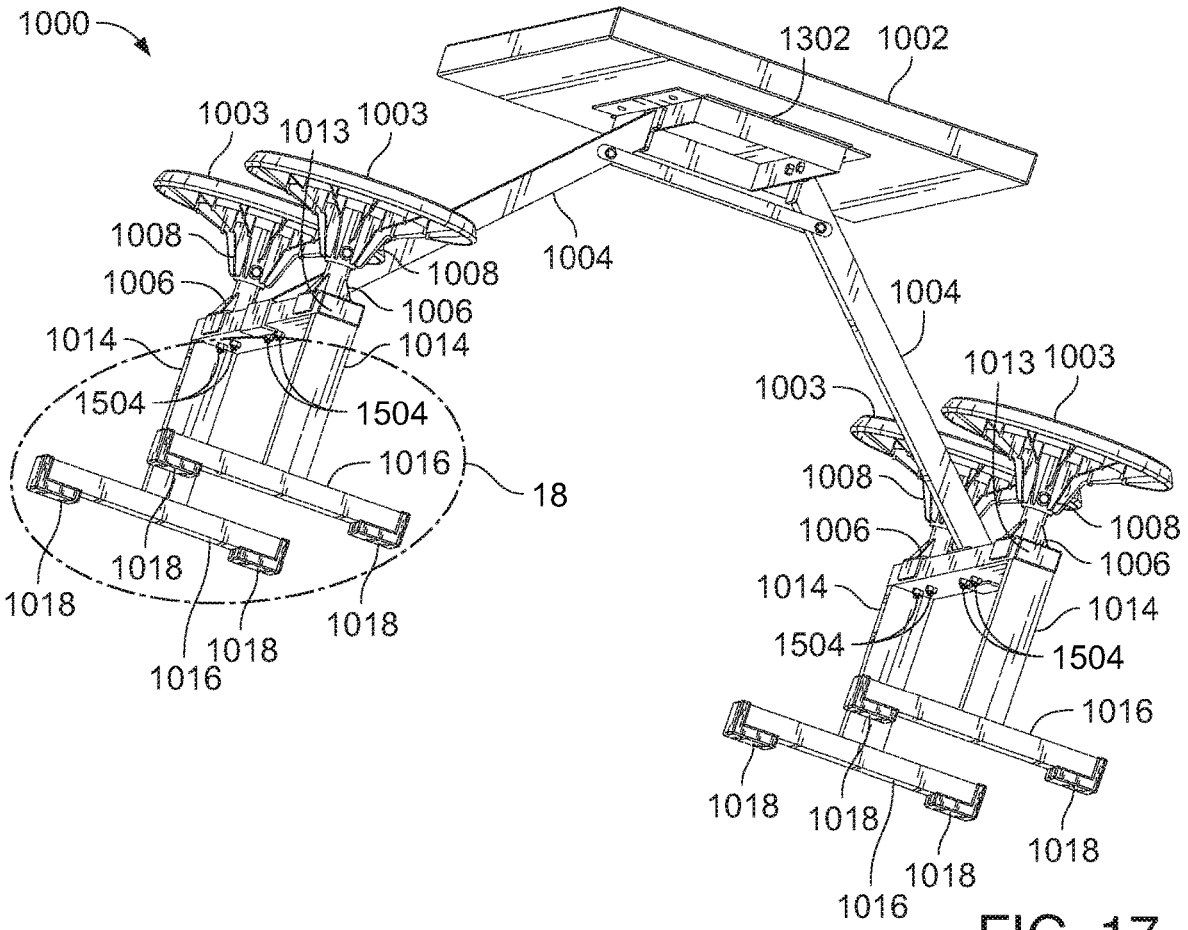
FIG. 17 shows an illustrative apparatus in accordance with principles of the disclosure.

FIG. 17 shows an illustrative bottom perspective view of cluster booth 1000. It should be noted that nuts 1504 may secure bolts 1013 and/or bolts used to secure bracket 1012 to rectangular tube 1010.

Figure 18:
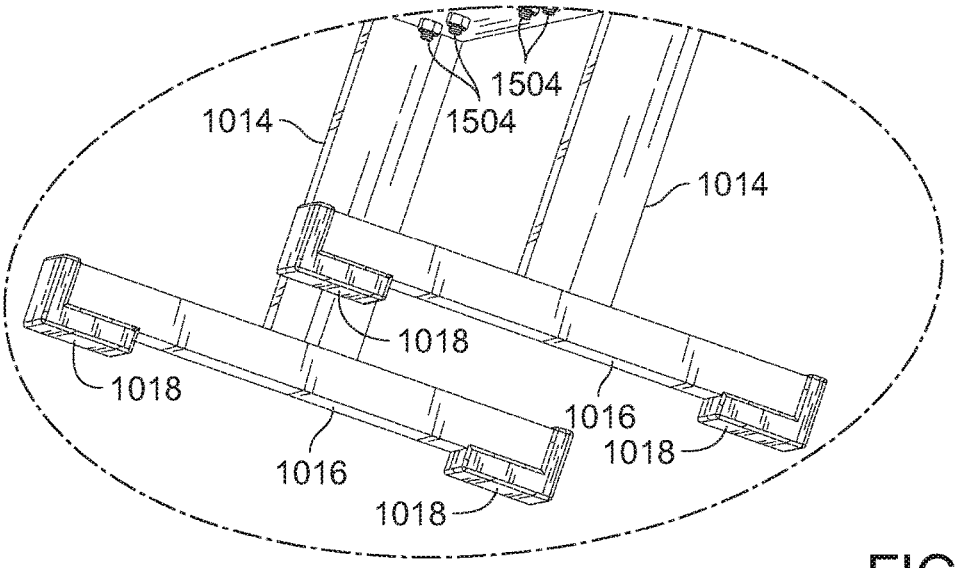
FIG. 18 shows an illustrative apparatus in accordance with principles of the disclosure.

FIG. 18 shows an illustrative bottom perspective view of an enlarged portion of the legs, taken from the circle part in FIG. 17, shown separately for completeness of illustration.

Figure 19:
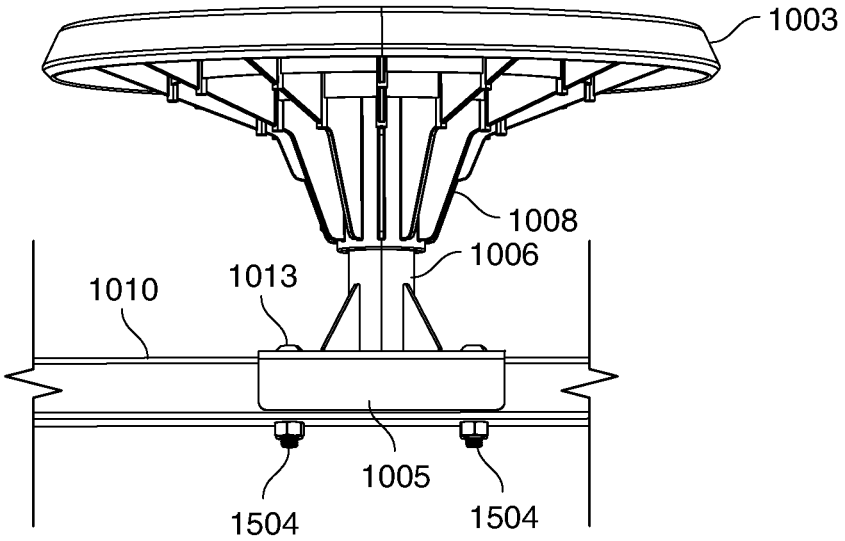
FIG. 19 shows an illustrative apparatus in accordance with principles of the disclosure.

FIG. 19 shows an illustrative side view of stool seat 1003 coupled to rectangular tube 1010. Stool seat 1003 may be coupled to bracket tube 1006 via protrusion 1008. Bolts 1013 and nuts 1504 may secure u-shaped portion 1005 to rectangular tube 1010.

Figure 20:
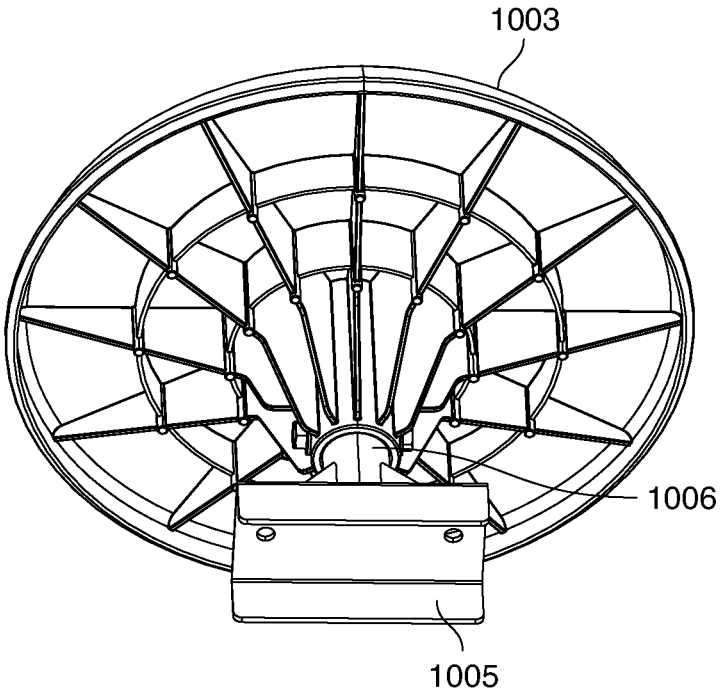
FIG. 20 shows an illustrative apparatus in accordance with principles of the disclosure.

FIG. 20 shows an illustrative bottom perspective view of stool seat 1003.

Figure 21:
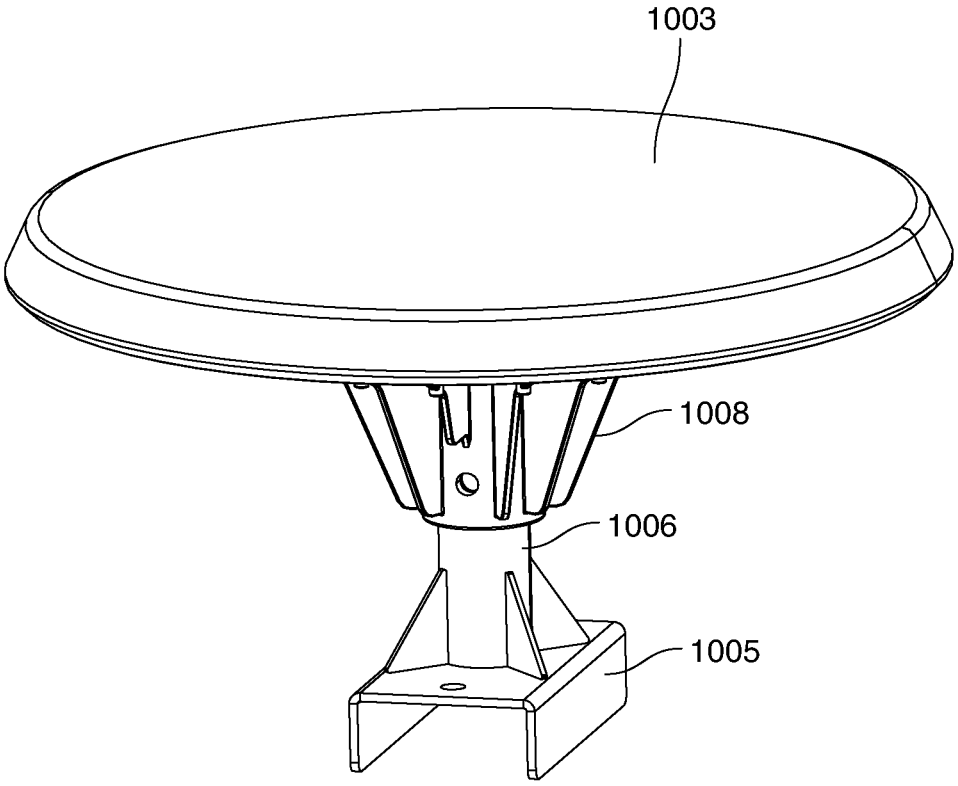
FIG. 21 shows an illustrative apparatus in accordance with principles of the disclosure.

FIG. 21 shows an illustrative top perspective view of stool seat 1003. Shown in FIG. 21, a bolt used to secure protrusion 1008 to bracket tube 1006 is not shown.

Figure 22:
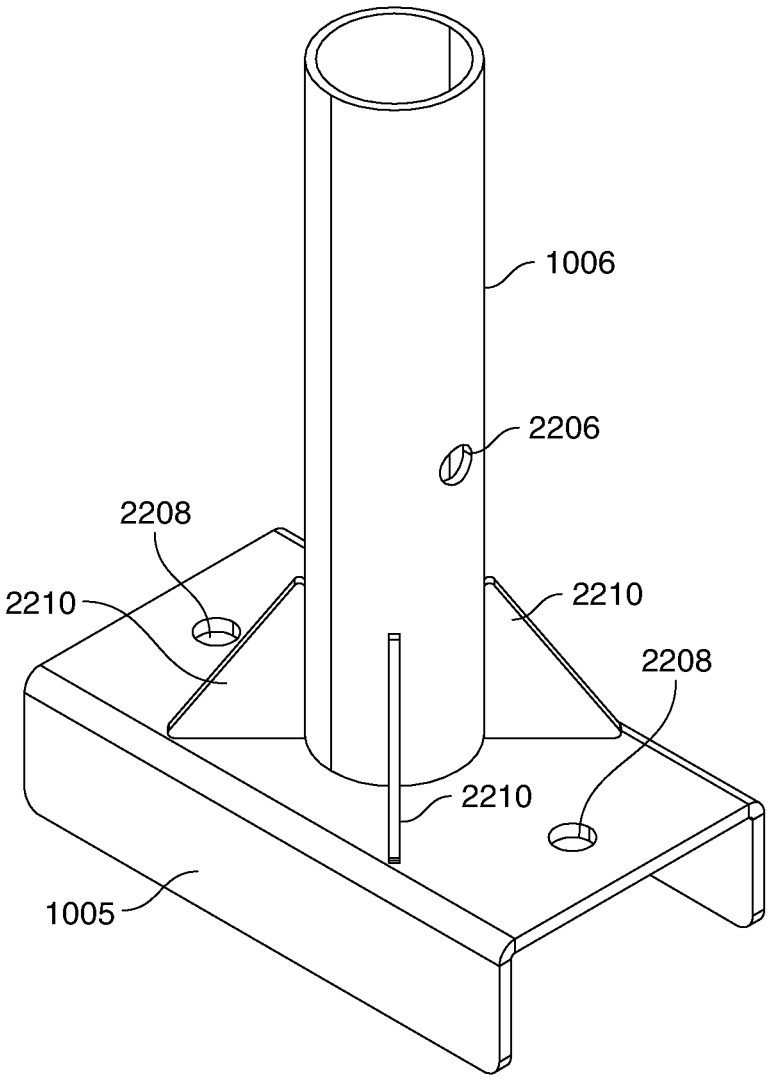
FIG. 22 shows an illustrative apparatus in accordance with principles of the disclosure.

FIG. 22 shows an illustrative view of a seat mount. The seat mount may include bracket tube 1006. The seat mount may include u-shaped portion 1005. The seat mount may include flanges 2210. Flanges 2210 may be triangular flanges. Triangular flanges 2210 may support the coupling between bracket tube 1006 and u-shaped portion 1005.

As shown in FIG. 22, u-shaped portion 1005 may include apertures 2208.

Apertures may receive bolts 1013 (not shown in FIG. 22). Bracket tube 1006 may include apertures 2206. Apertures may receive bolts 1011 (not shown in FIG. 22).

Figure 23:
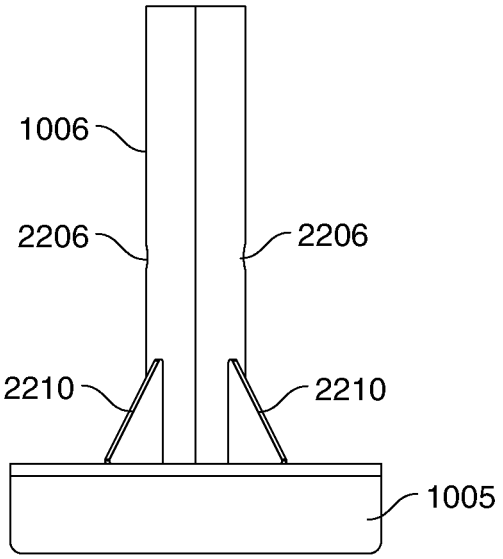
FIG. 23 shows an illustrative apparatus in accordance with principles of the disclosure.

FIG. 23 shows an illustrative front view of the seat mount. As shown in FIG. 23, apertures 2206 may be located on two sides of bracket tube 1006. Apertures 2206 may correspond to each other. As such, bolt 1011 may screw through a first apertures 2206 and emerge through a second aperture 2206.

Figure 24:
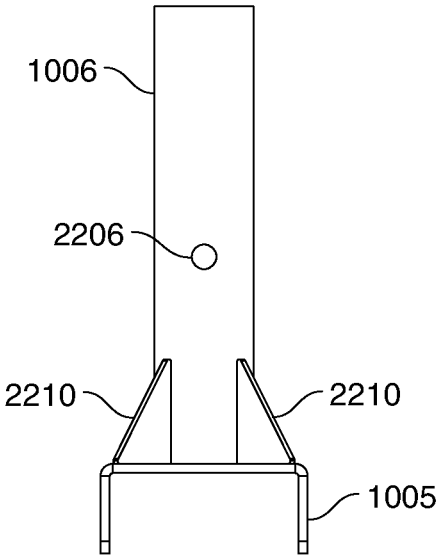
FIG. 24 shows an illustrative apparatus in accordance with principles of the disclosure.

FIG. 24 shows another illustrative side view of the seat mount.

Figure 25:
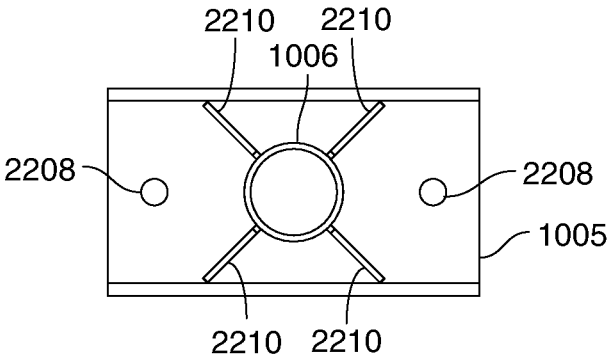
FIG. 25 shows an illustrative apparatus in accordance with principles of the disclosure.

FIG. 25 shows an illustrative top view of the seat mount.

Figure 26:
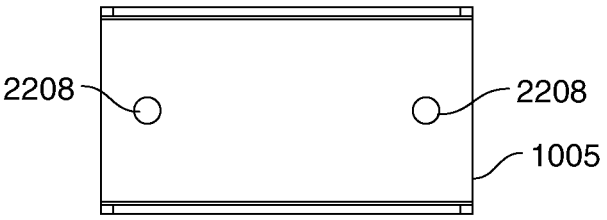
FIG. 26 shows an illustrative apparatus in accordance with principles of the disclosure.

FIG. 26 shows an illustrative bottom view of the seat mount.

Figure 27:
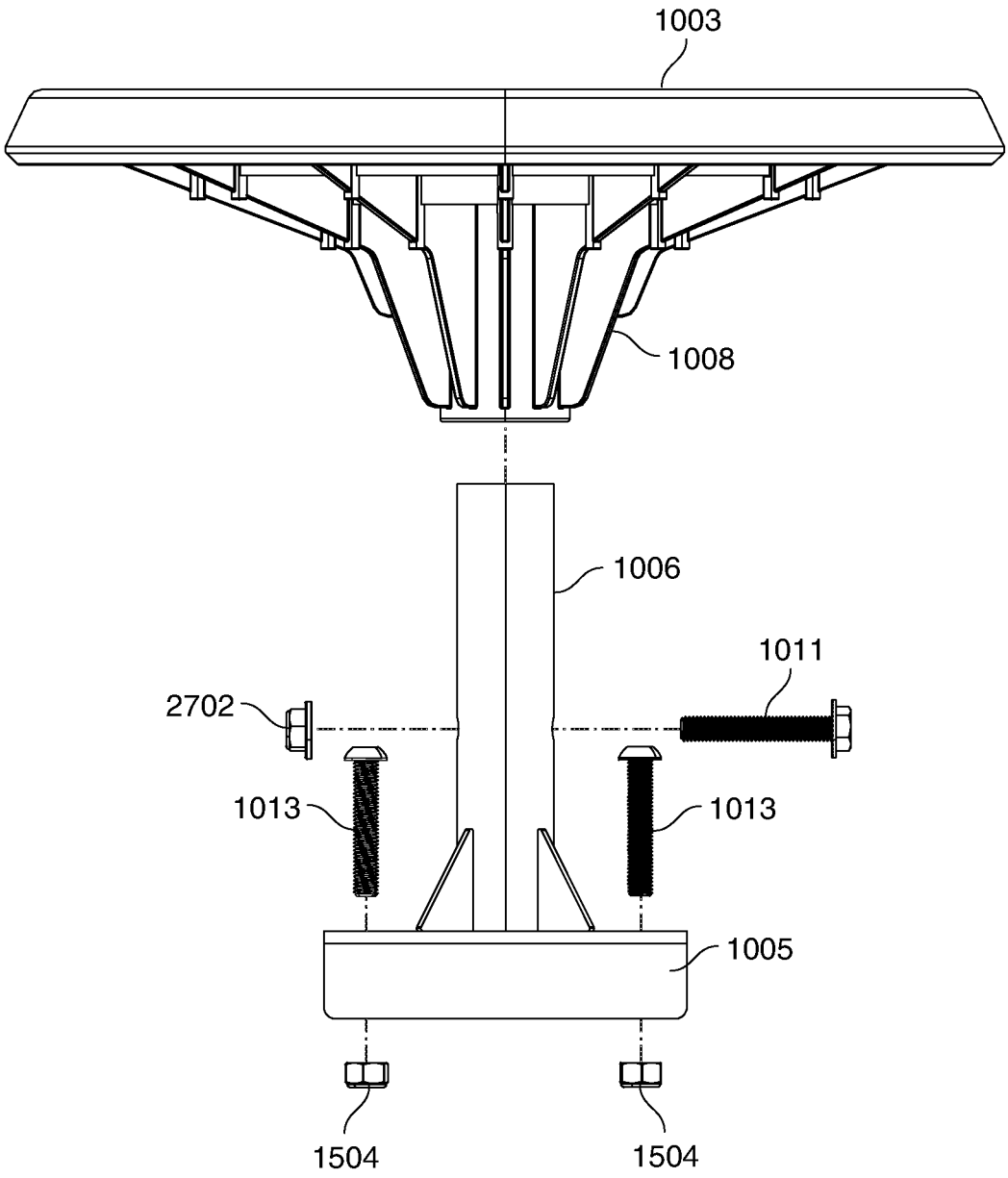
FIG. 27 shows an illustrative apparatus in accordance with principles of the disclosure.

FIG. 27 shows an illustrative exploded view of stool seat 1003, the seat mount, bolt 1011 and corresponding nut 2702, bolts 1013 and corresponding nuts 1504.

Figure 28:
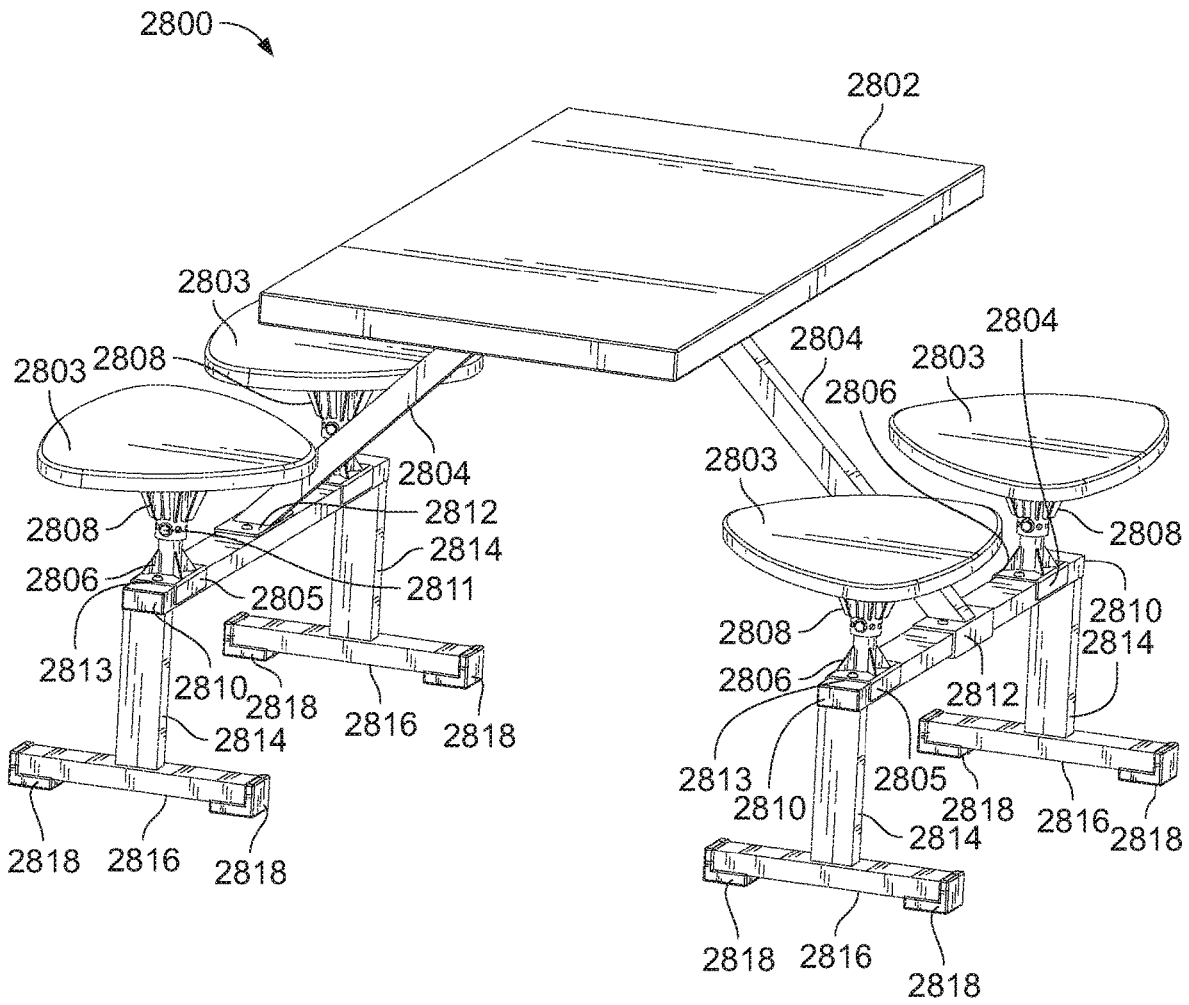
FIG. 28 shows an illustrative apparatus in accordance with principles of the disclosure.

FIG. 28 shows an illustrative top right perspective view of cluster booth 2800. Cluster booth 2800 may include table 2802. Table 2802 may refer to a rectangular substrate upon which activities may be performed. Table 2802 may be similar to table 102 discussed in connection with cluster booth 100.

Table 2802 may be coupled to rectangular tubes 2804. Each of rectangular tubes 2804 may be similar to rectangular tubes 104 discussed in connection with cluster booth 100. Each of rectangular tubes 2804 may be coupled, via bracket 2812, to rectangular tubes 2810. Rectangular tubes 2810 may be similar to rectangular tubes 110 discussed in connection with cluster booth 100. Each of brackets 2812 may be similar to brackets 112 discussed in connection with cluster booth 100.

Rectangular tubes 2810 may be coupled to multiple support structures 2814. Support structures 2814 may be similar to support structures 114 discussed in connection with cluster booth 100. Each of support structures 2814 may be coupled to leg 2816. Each leg 2816 may be similar to leg 2816 discussed in connection with cluster booth 100. Each leg 2816 may be coupled to glides 2818. Each leg 2816 may preferably include two or more glides 2818. Glides 2818 may be similar to glides 118 discussed in connection with cluster booth 100. Glides 2818 may enable leg 2816 to glide on a surface, such as a floor or ground.

Triangular stool seat 2803 may be coupled to rectangular tube 2810 via a seat mount. The seat mount may include u-shaped portion 2805. The seat mount may include bracket tube 2806. The seat mount may be coupled, via u-shaped portion 2805, to rectangular tube 2810. U-shaped portion 2805 may be bolted to rectangular tube 2810. Bolts 2813 may couple u-shaped portion 2805 to rectangular tube 2810. Bracket tube 2806 may fit into a hollow portion of protrusion 2808, which protrudes from an underside of triangular stool seat 2803. Bolts 2811 may couple bracket tube 2806 to protrusion 2808.

Figure 29:
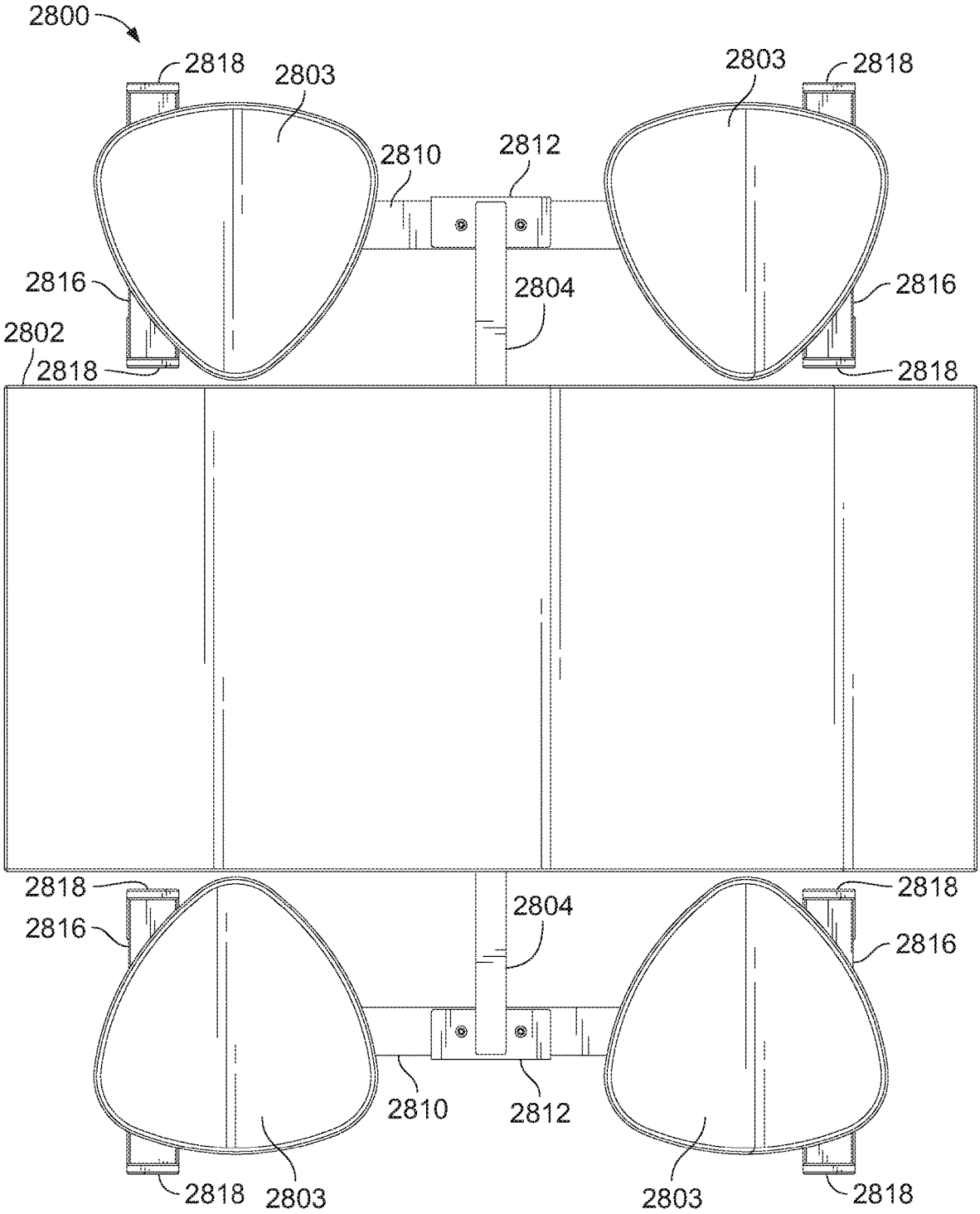
FIG. 29 shows an illustrative apparatus in accordance with principles of the disclosure.

FIG. 29 shows an illustrative top view of cluster booth 2800.

Figure 30:
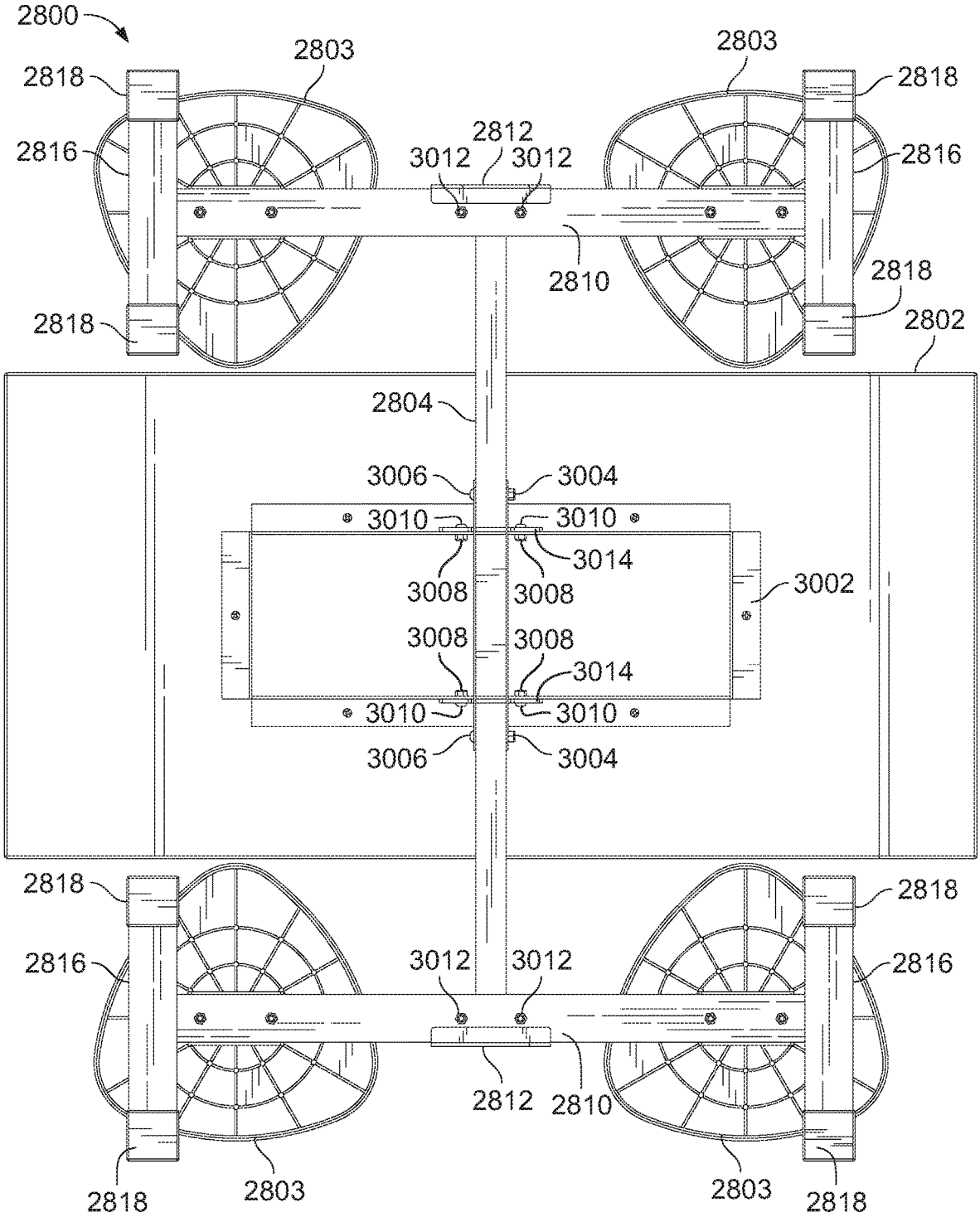
FIG. 30 shows an illustrative apparatus in accordance with principles of the disclosure.

FIG. 30 shows an illustrative bottom view of cluster booth 2800. Nuts 3012 may secure bolts screwed into bracket 2812 and rectangular tube 2810.

Illustrative bottom view of cluster booth 2800 shows table support 3002. Table support 3002 may be similar to table support 302 and table support 1302. Table support 3002 may include four L-shaped brackets. Each of the four L-shaped brackets may include a bottom face and a side face. The bottom face and/or the side face of the four L-shaped brackets may include one or more apertures. The apertures on the bottom face of the L-shaped brackets may be configured to receive one or more bolts. The bolts may couple table support 3002 to table 302.

Rectangular tube 2804 may be coupled, via coupling bracket 3014, to table support 3002. Coupling bracket 3014 may be welded, bolted and/or otherwise coupled, to rectangular tube 2804. Coupling bracket 3014 may be welded, bolted and/or otherwise coupled, to table support 3002. Bolts 3010 and nuts 3014 may secure coupling bracket 3014 to one or more L-shaped brackets included in table support 3002.

A support bar may couple the first rectangular tube 2804 to the second rectangular tube 2804. A second support bar may couple the first rectangular tube 2804 to the second rectangular tube 2804. The support bar(s) may be welded, bolted and/or otherwise coupled to the first rectangular tube 2804 and/or the second rectangular tube 2804. Bolts 3006 and nuts 3004 may secure the support bars to the first rectangular tube 2804 and/or the second rectangular tube 2804. The first support bar and the second support bar may be located on opposite sides of the first rectangular tube 2804 and the second rectangular tube 2804.

Figure 31:
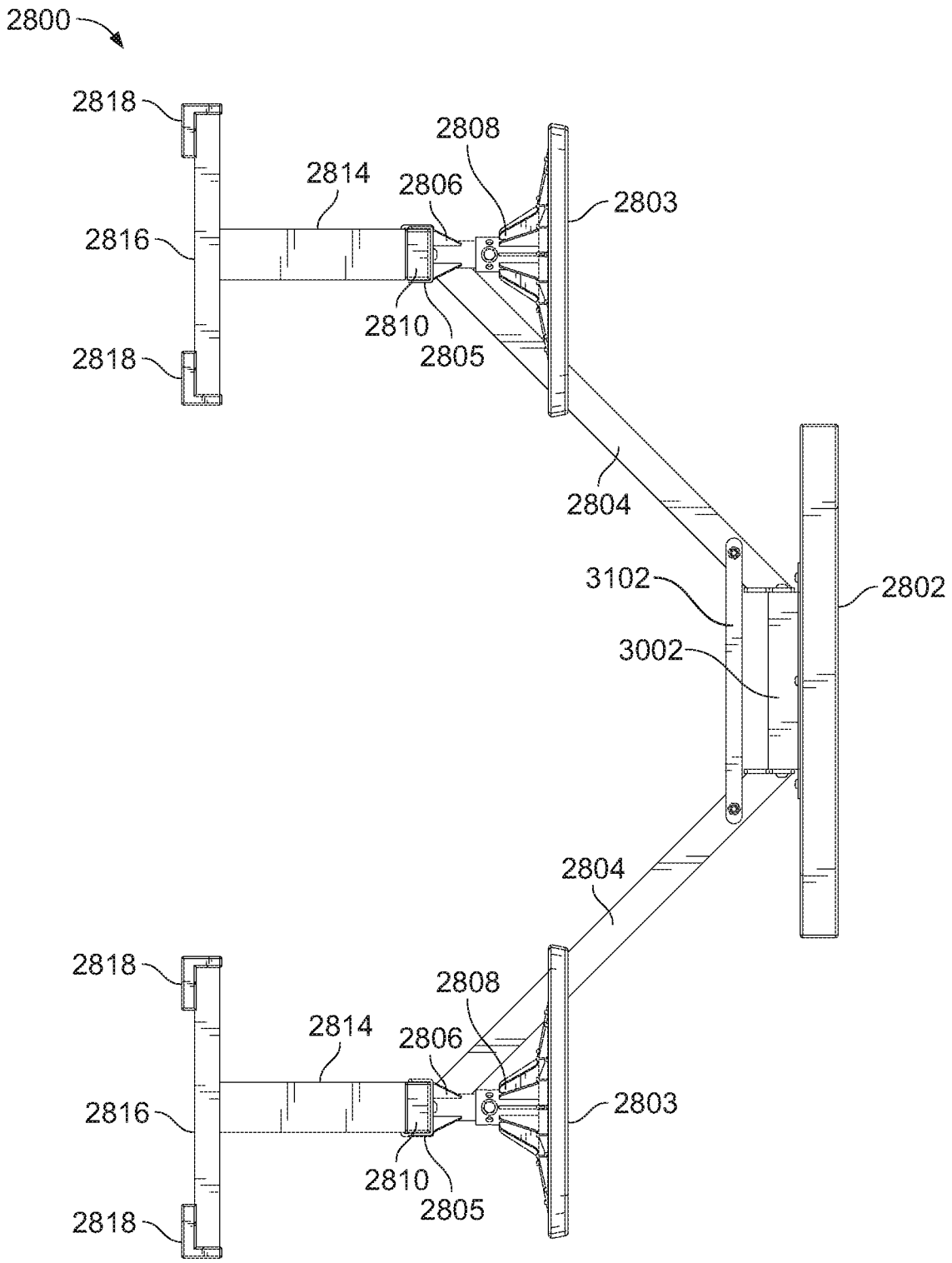
FIG. 31 shows an illustrative apparatus in accordance with principles of the disclosure.

FIG. 31 shows an illustrative front view of cluster booth 2800. Support bar 3102 couples the first rectangular tube 2804 to the second rectangular tube 2804.

Figure 32:
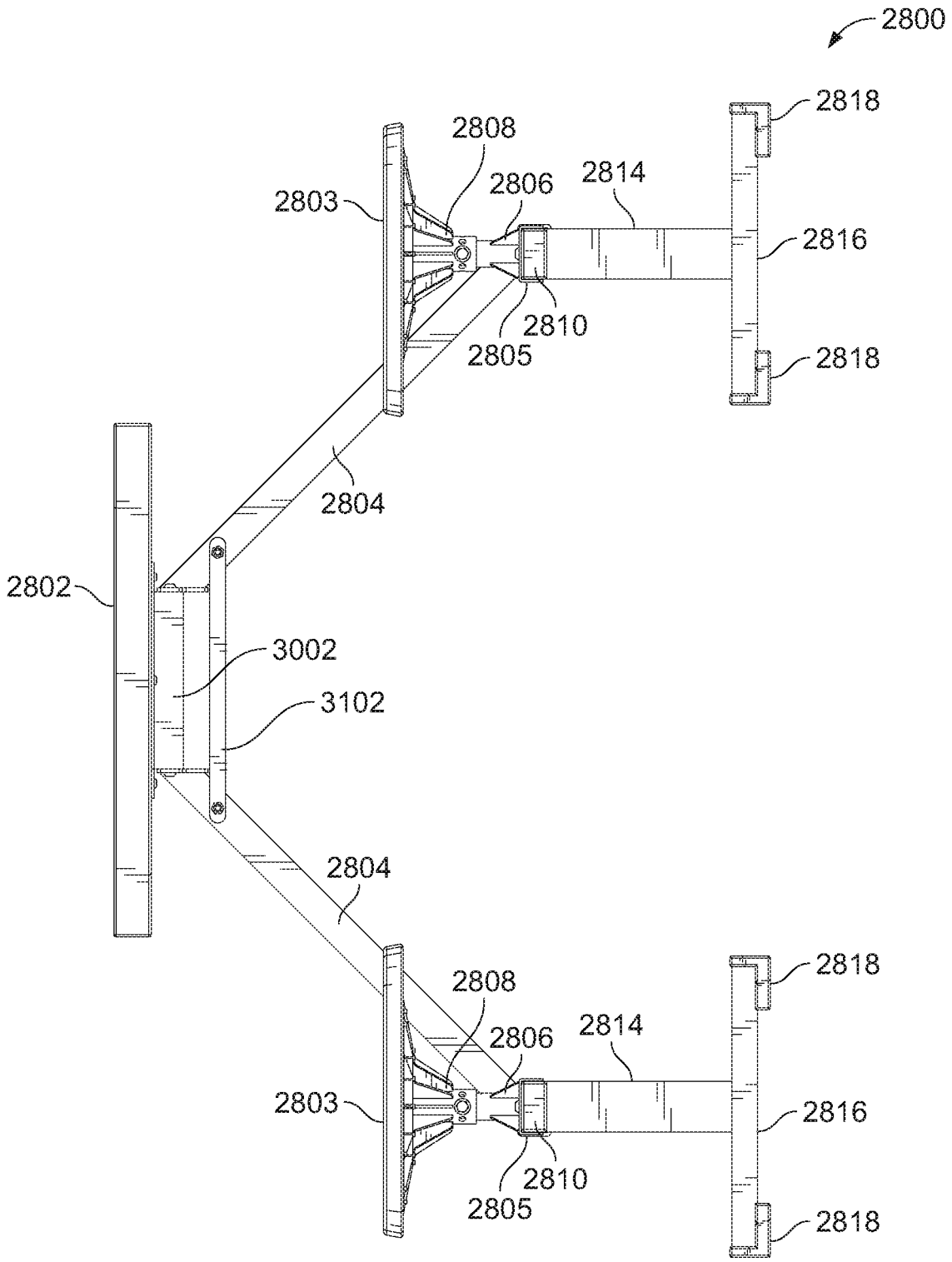
FIG. 32 shows an illustrative apparatus in accordance with principles of the disclosure.

FIG. 32 shows an illustrative back view of cluster booth 2800. A second support bar 3102 couples the first rectangular tube 2804 to the second rectangular tube 2804.

Figure 33:
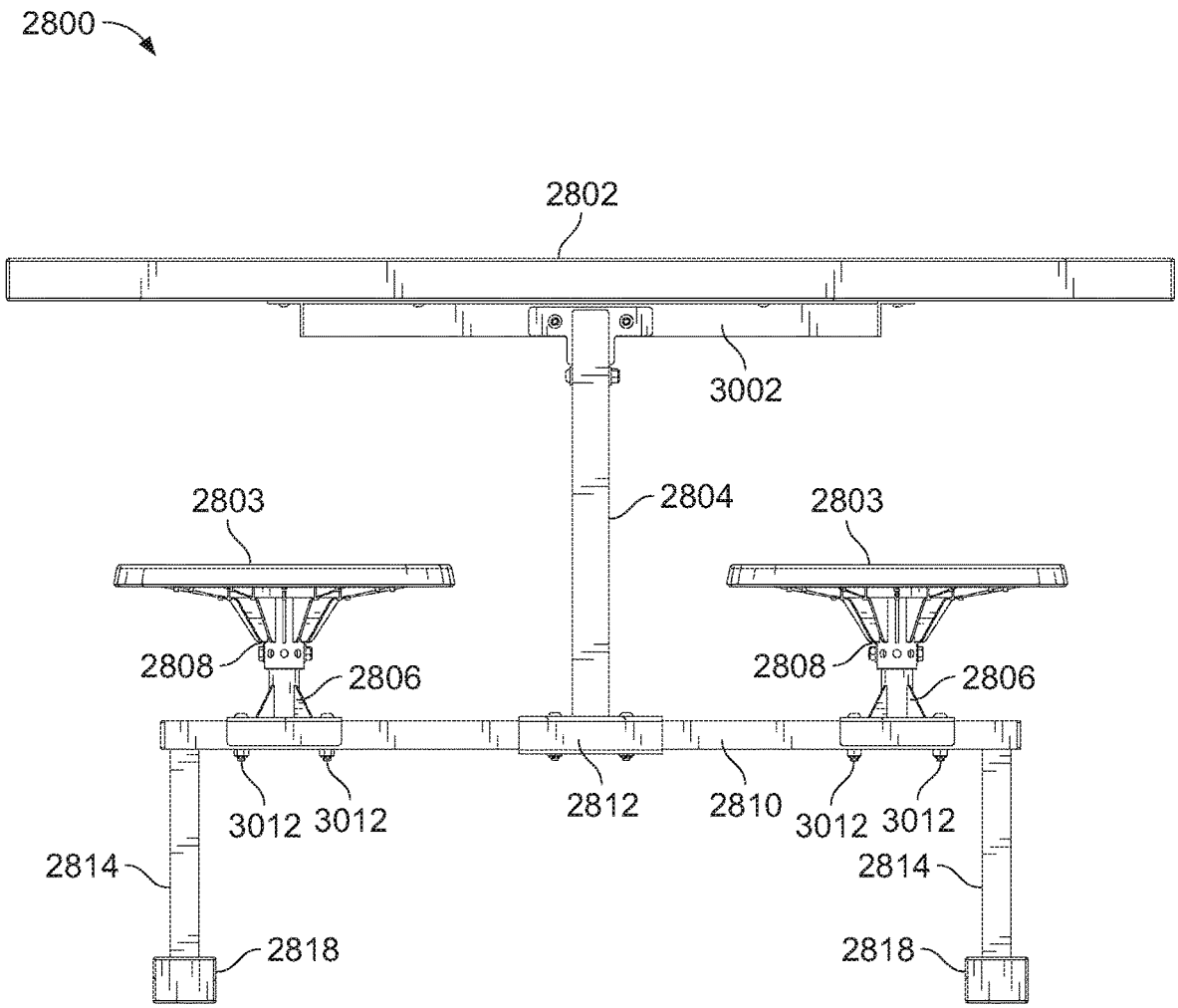
FIG. 33 shows an illustrative apparatus in accordance with principles of the disclosure.

FIG. 33 shows an illustrative left view of cluster booth 2800. Coupling bracket 3014 may couple rectangular tube 2804 to table support 3002.

Figure 34:
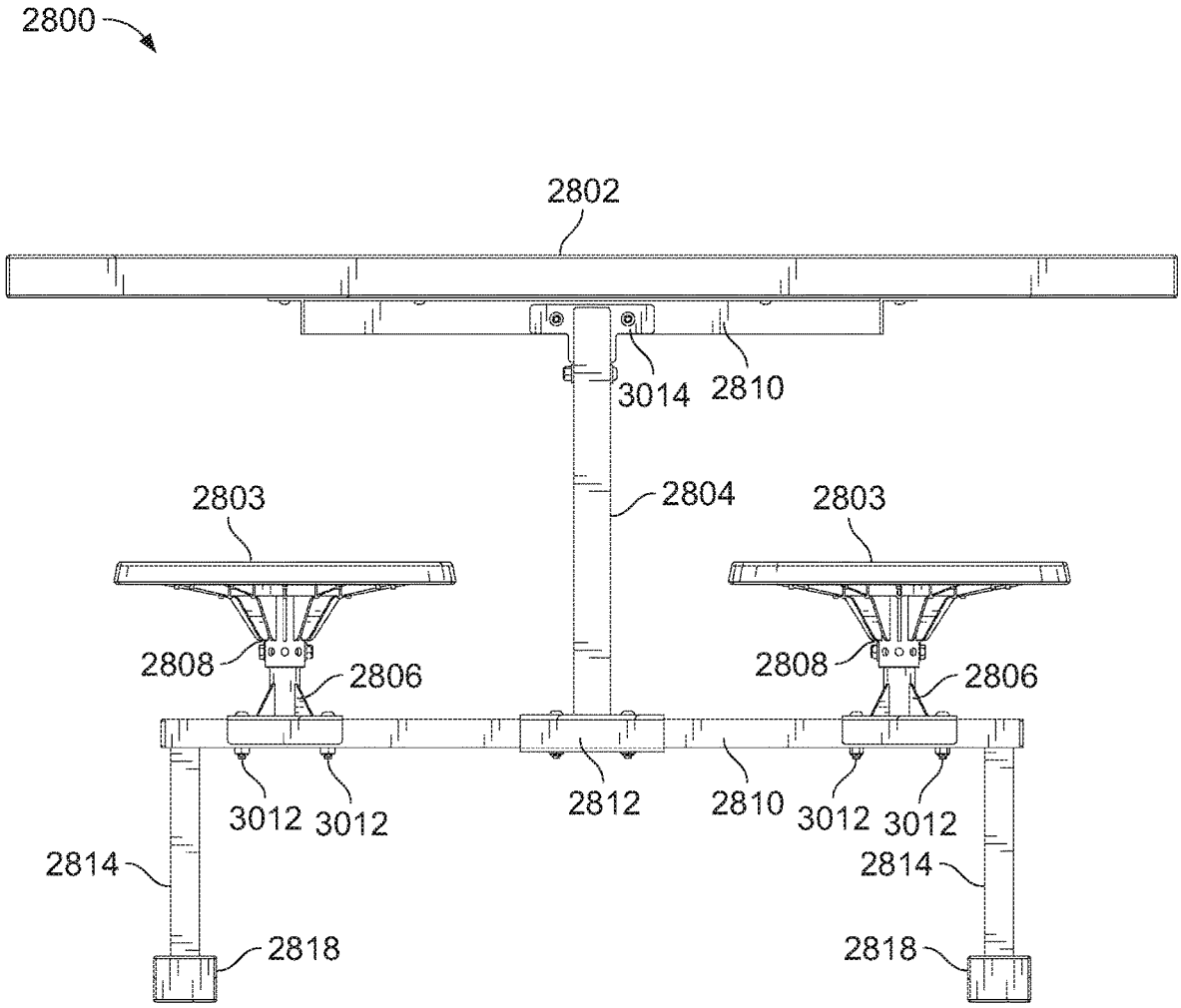
FIG. 34 shows an illustrative apparatus in accordance with principles of the disclosure.

FIG. 34 shows an illustrative right view of cluster booth 2800.

Figure 35:
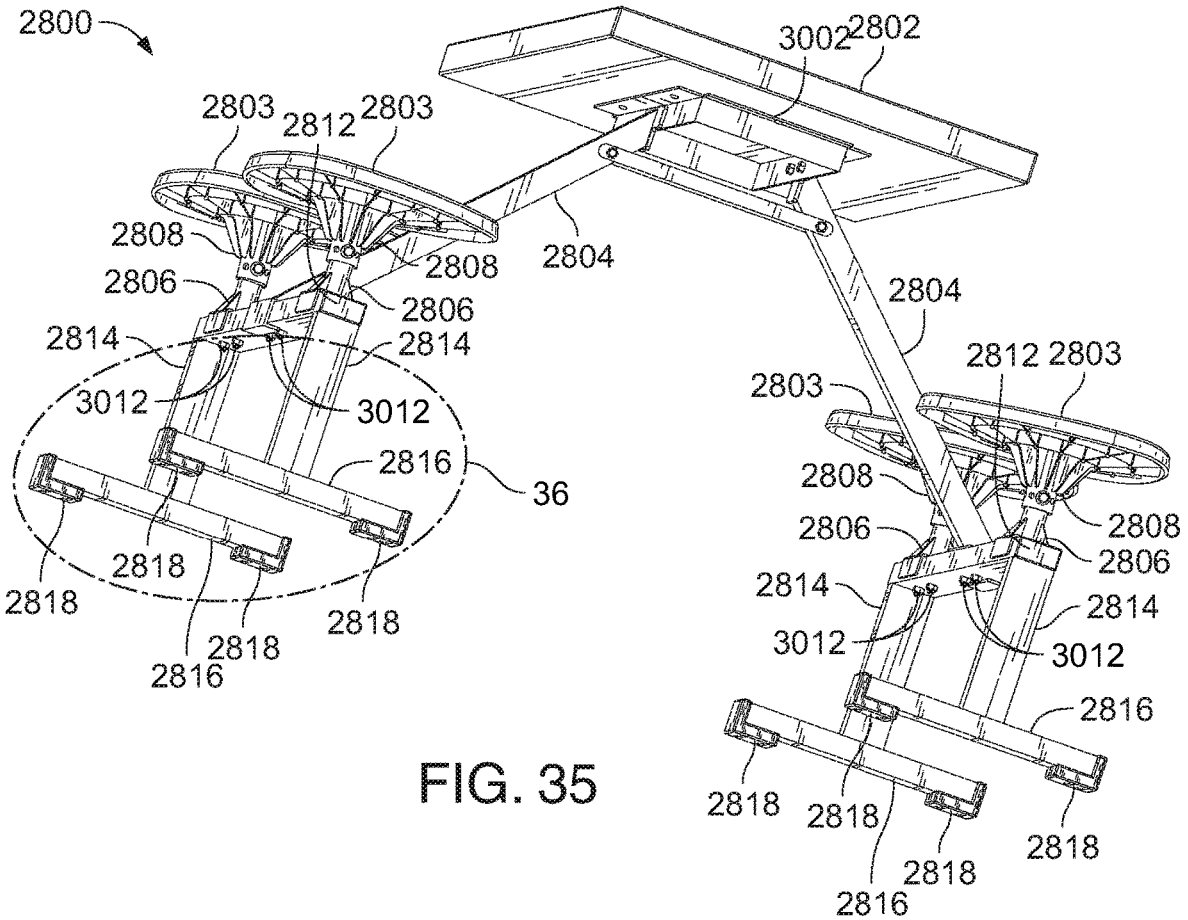
FIG. 35 shows an illustrative apparatus in accordance with principles of the disclosure.

FIG. 35 shows an illustrative bottom perspective view of cluster booth 2800. Nuts 3012 may secure bolts screwed into bracket 2812 and rectangular tube 2810. Nuts 3012 may secure bolts screwed into u-shaped portion 2805 and rectangular tube 2810.

Figure 36:
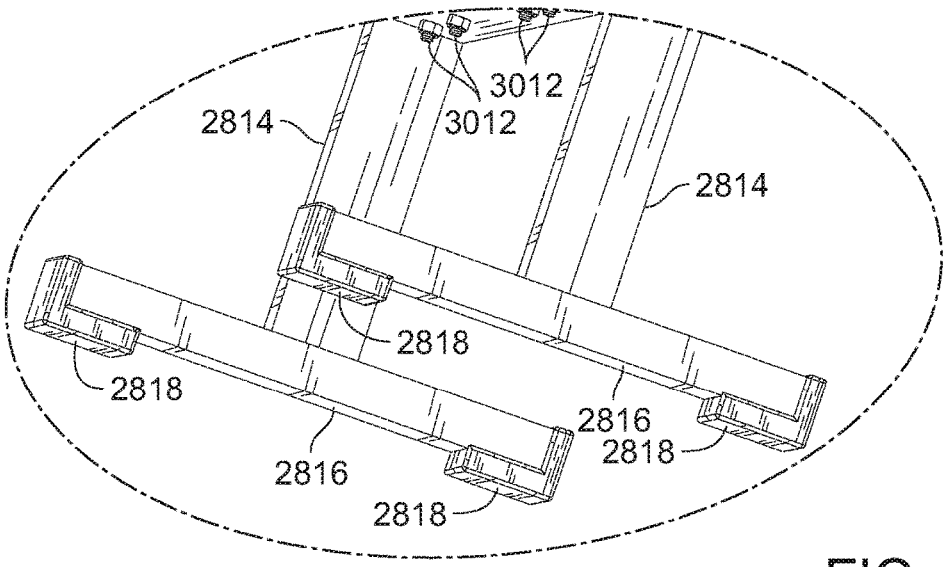
FIG. 36 shows an illustrative apparatus in accordance with principles of the disclosure.

FIG. 36 shows an illustrative bottom perspective view of an enlarged portion of the legs, taken from the circle part in FIG. 35, shown separately for completeness of illustration.

Figure 37:
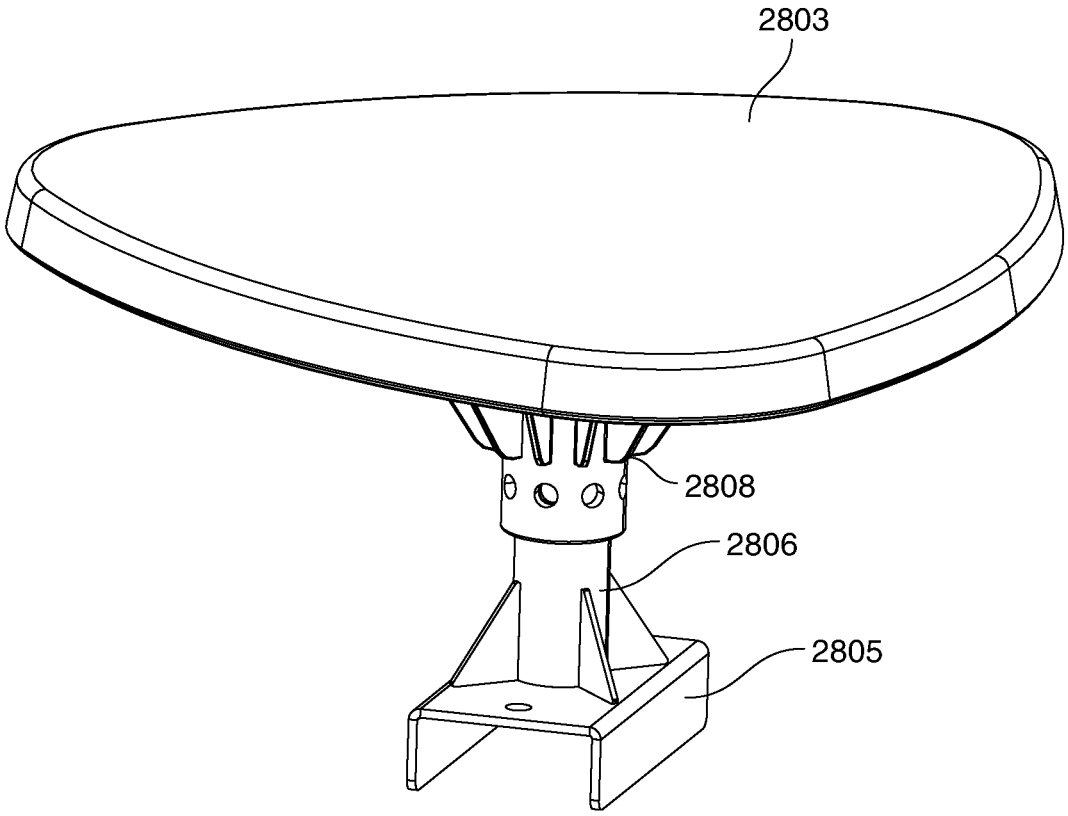
FIG. 37 shows an illustrative apparatus in accordance with principles of the disclosure.

FIG. 37 shows an illustrative top perspective view of triangular stool seat 2803 and the seat mount. Bracket tube 2806 may fit into protrusion 2808, which protrudes from stool seat 2803. U-shaped portion 2805 may be coupled to bracket tube 2806. Triangular flanges may support the connection between bracket tube 2806 and u-shaped portion 2805.

It should be noted that protrusion 2808 may include multiple apertures. The apertures may enable bracket tube 2806 to be coupled to protrusion 2808. The multiple apertures may enable triangular stool seat 2803 to be coupled bracket tube 2806 in various positions.

Figure 38:
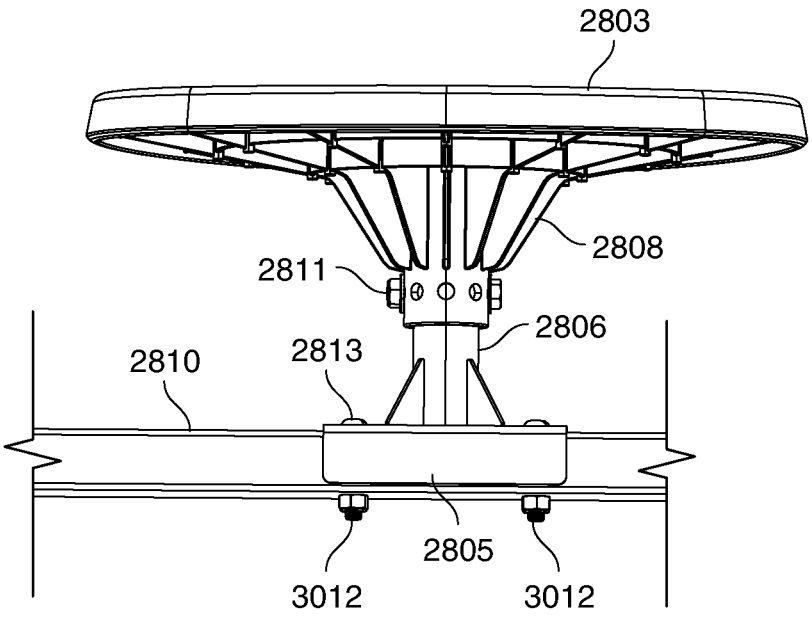
FIG. 38 shows an illustrative apparatus in accordance with principles of the disclosure.

FIG. 38 shows an illustrative side view of triangular stool seat 2803 mounted to the seat mount. The seat mount is shown secured to a portion of rectangular tube 2810.

Figure 39:
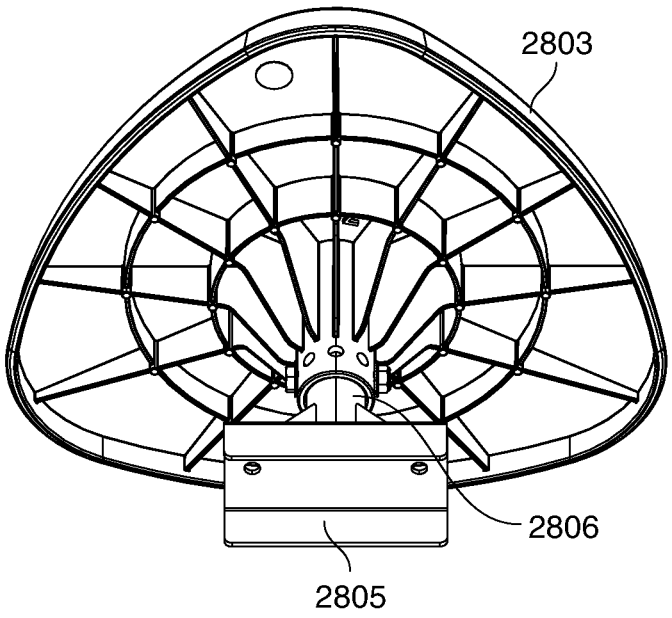
FIG. 39 shows an illustrative apparatus in accordance with principles of the disclosure.

FIG. 39 shows an illustrative bottom perspective view of triangular stool seat 2803 and the seat mount.

Figure 40:
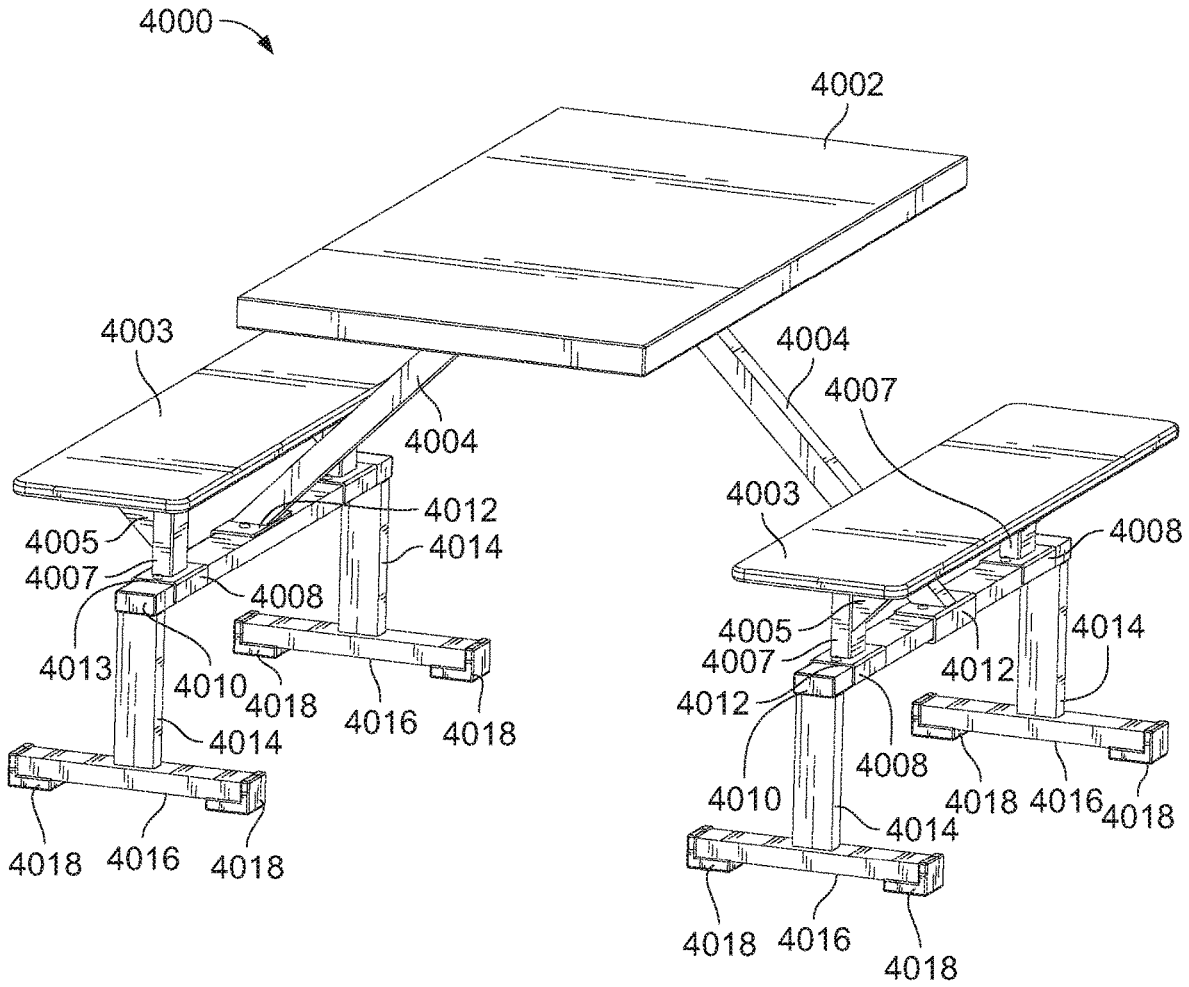
FIG. 40 shows an illustrative apparatus in accordance with principles of the disclosure.

FIG. 40 shows an illustrative top right perspective view of cluster booth 4000. Cluster booth 4000 may include table 4002. Table 4002 may refer to a rectangular substrate upon which activities are performed. Table 4002 may be similar to table 102 discussed in connection with cluster booth 100.

Table 4002 may be coupled to rectangular tubes 2804. Each of rectangular tubes 4004 may be similar to rectangular tubes 104 discussed in connection with cluster booth 100. Each of rectangular tubes 4004 may be coupled, via bracket 4012, to rectangular tube 4010. Each of brackets 4012 may be similar to brackets 112 discussed in connection with cluster booth 100. Rectangular tubes 4010 may be similar to rectangular tubes 110 discussed in connection with cluster booth 100.

Rectangular tubes 4010 may be coupled to multiple support structures 4014. Support structures 4014 may be similar to support structures 114 discussed in connection with cluster booth 100. Each of support structures 4014 may be coupled to leg 4016. Each leg 4016 may be similar to leg 116 discussed in connection with cluster booth 100. Each leg 4016 may be coupled to glides 4018. Each leg 4016 may preferably be coupled to two or more glides 4018. Glides 4018 may be similar to glides 118 discussed in connection with cluster booth 100. Glides 4018 may enable leg 4016 to glide on a surface, such as a floor or ground.

Bench 4003 may be coupled to rectangular tube 4010 via one or more bench mounts. The bench mount may also be referred to herein as a support bracket.

In some embodiments, preferably, two bench mounts may be used to support bench 4003. The bench mount may include one or more, preferably two, triangular support flanges 4005. The bench mount may include a plate. The bench mount may include rectangular bracket tube 4007. The bench mount may include u-shaped portion 4008. Bolts 4013 may secure u-shaped portion 4008 to rectangular tube 4010.

Figure 41:
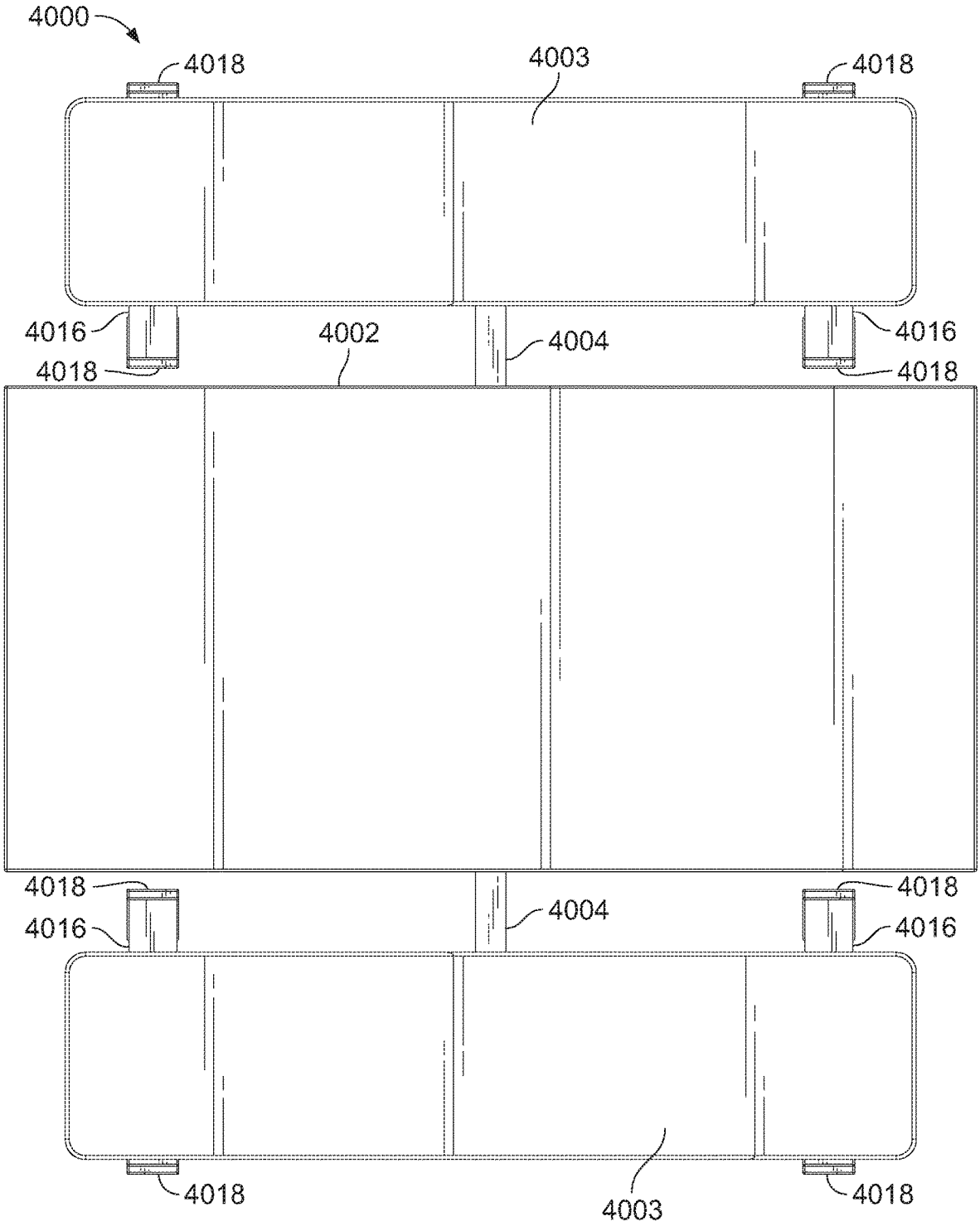
FIG. 41 shows an illustrative apparatus in accordance with principles of the disclosure.

FIG. 41 shows an illustrative top view of cluster booth 4000.

Figure 42:
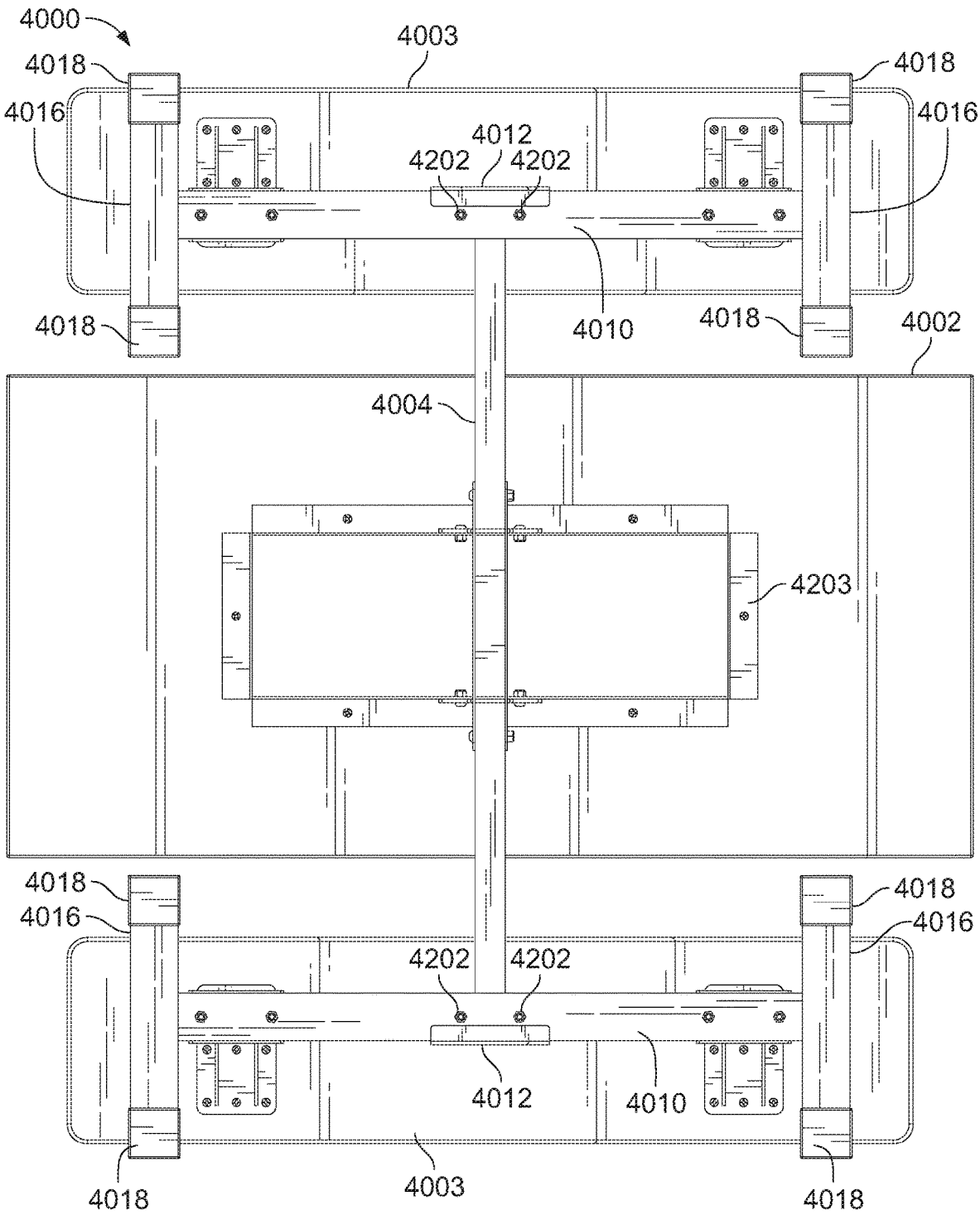
FIG. 42 shows an illustrative apparatus in accordance with principles of the disclosure.

FIG. 42 shows an illustrative bottom view of cluster booth 4000. Nuts 4202 may secure bolts engaged with bracket 4012 and rectangular tube 4010. Nuts 4202 may also secure bolts engaged with u-shaped portion 4008 and rectangular tube 4010.

Figure 43:
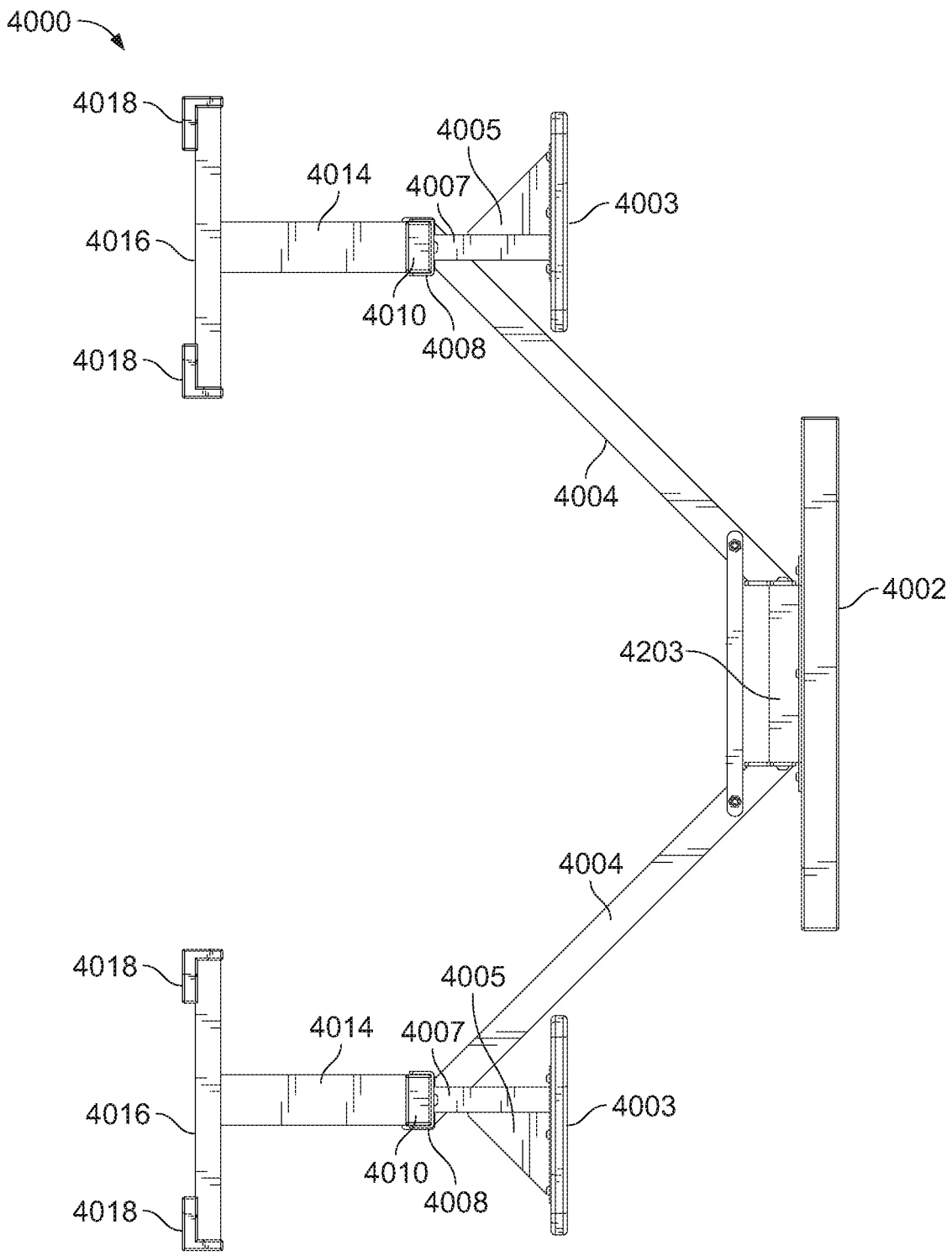
FIG. 43 shows an illustrative apparatus in accordance with principles of the disclosure.

FIG. 43 shows an illustrative front view of cluster booth 4000. Table support 4203 may be shown. Table support 4203 may be similar to table support 302 shown in connection with cluster booth 100.

Figure 44:
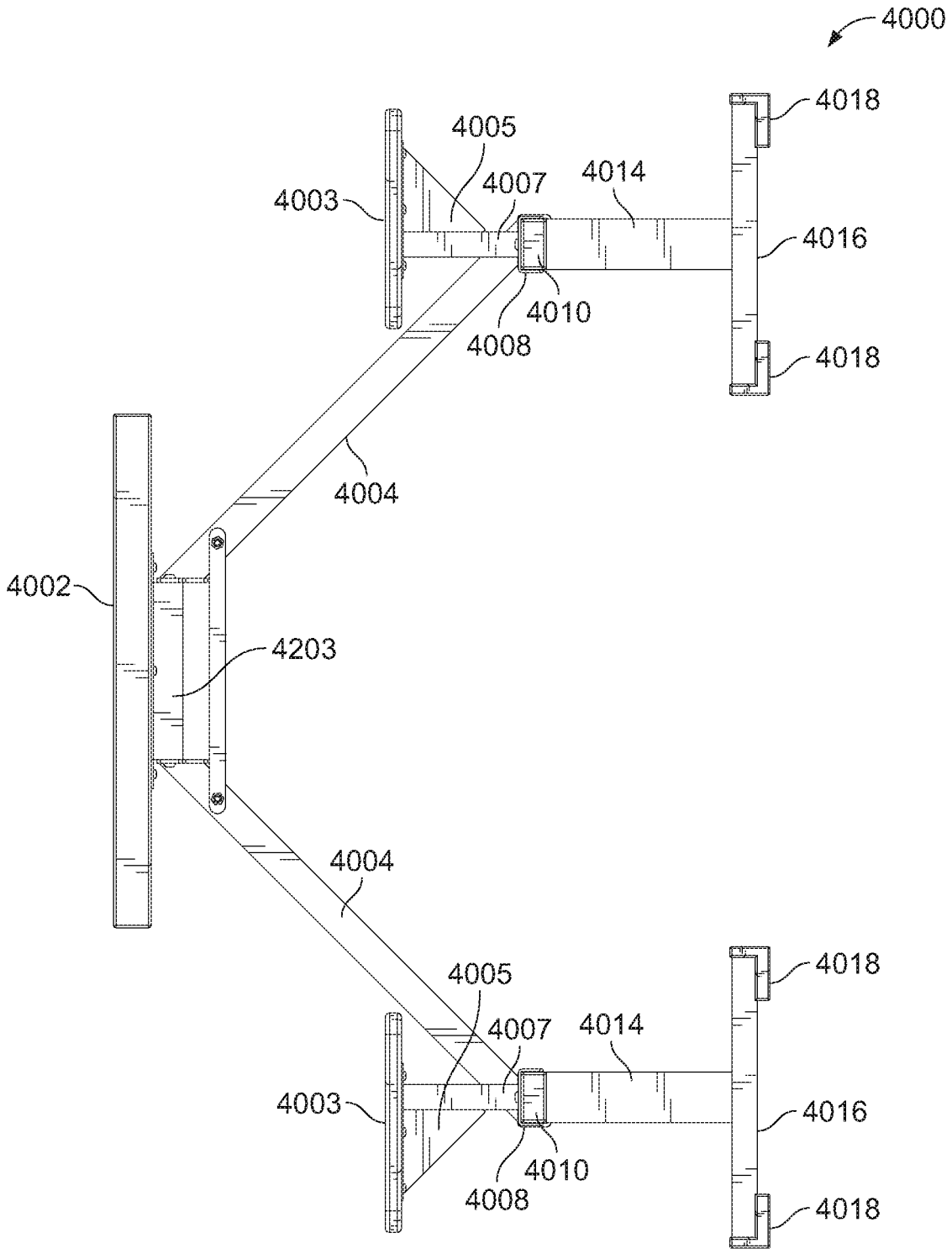
FIG. 44 shows an illustrative apparatus in accordance with principles of the disclosure.

FIG. 44 shows an illustrative back view of cluster booth 4000.

Figure 45:
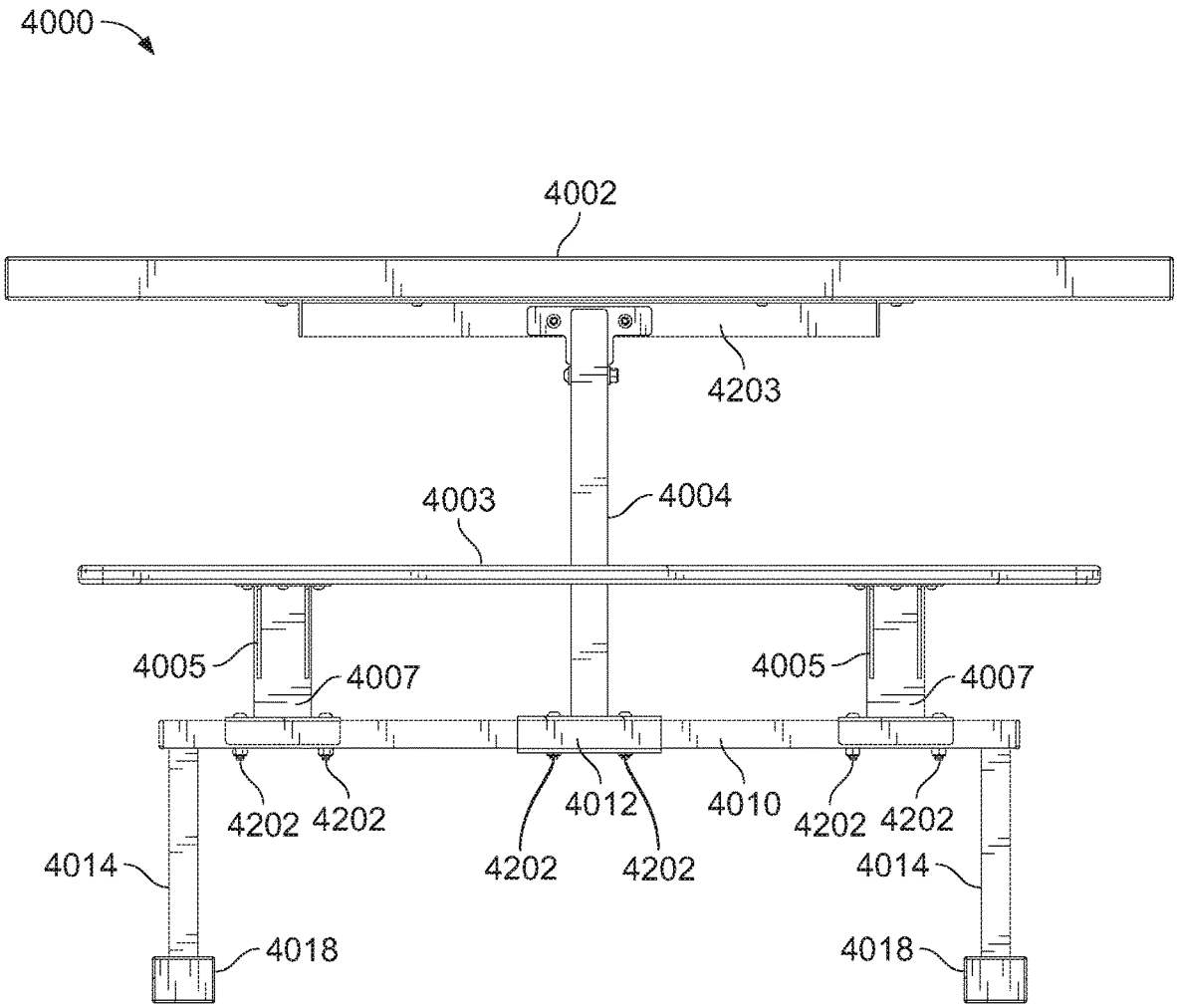
FIG. 45 shows an illustrative apparatus in accordance with principles of the disclosure.

FIG. 45 shows an illustrative left view of cluster booth 4000. Nuts 4202 may secure bolts engaged with bracket 4012 and rectangular tube 4010. Nuts 4202 may also secure bolts engaged with u-shaped portion 4008 and rectangular tube 4010.

Figure 46:
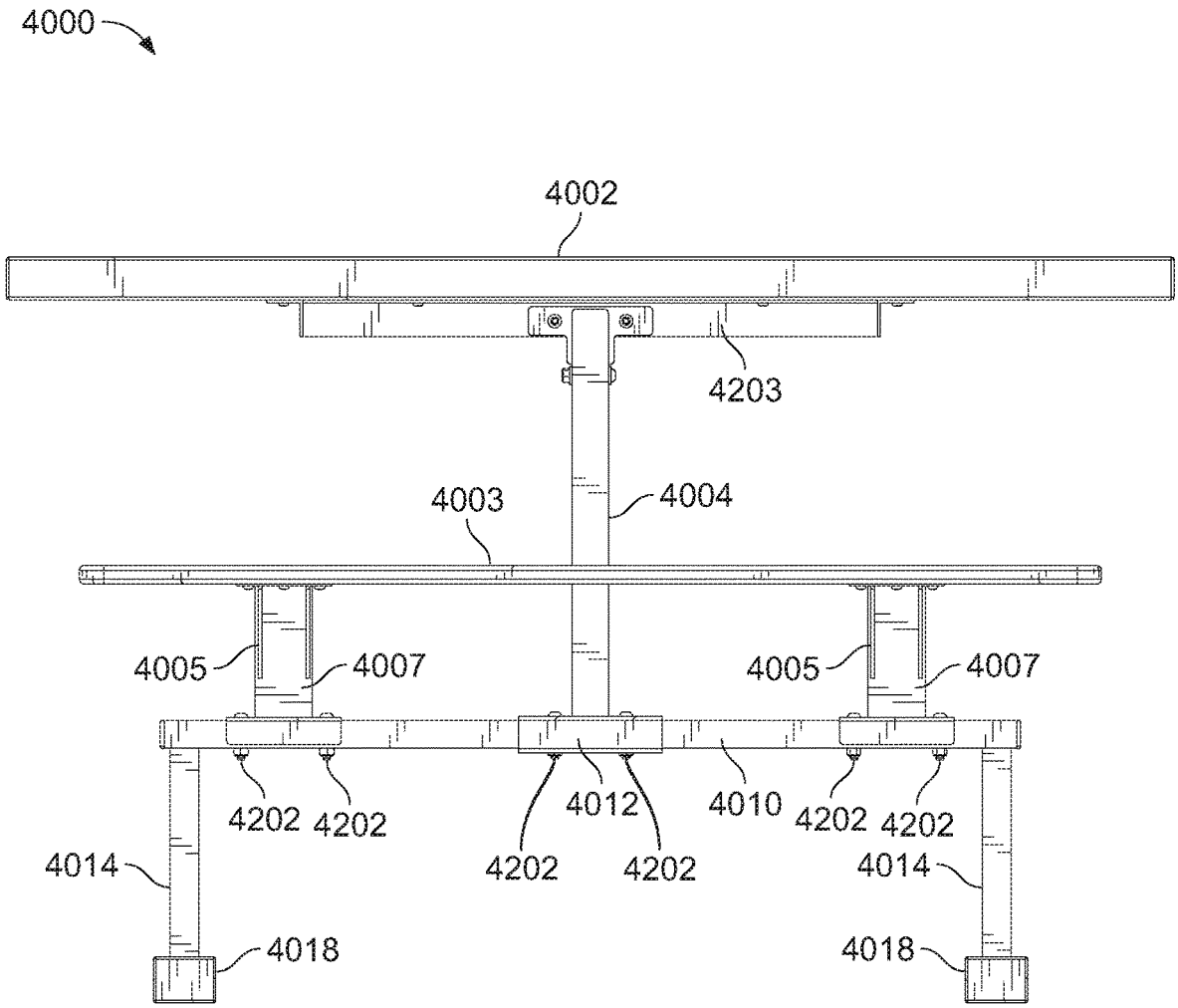
FIG. 46 shows an illustrative apparatus in accordance with principles of the disclosure.

FIG. 46 shows an illustrative right view of cluster booth 4000.

Figure 47:
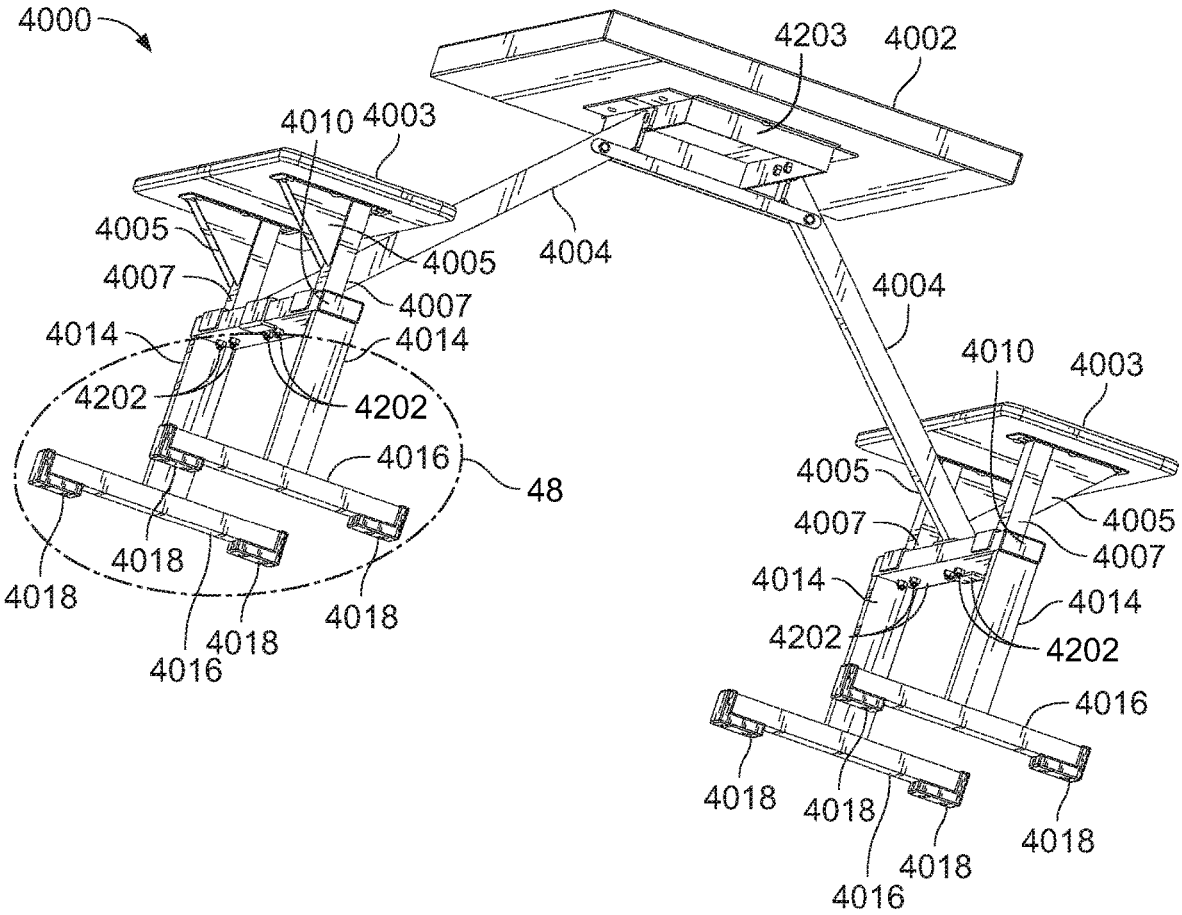
FIG. 47 shows an illustrative apparatus in accordance with principles of the disclosure.

FIG. 47 shows an illustrative bottom perspective view of cluster booth 4000.

Figure 48:
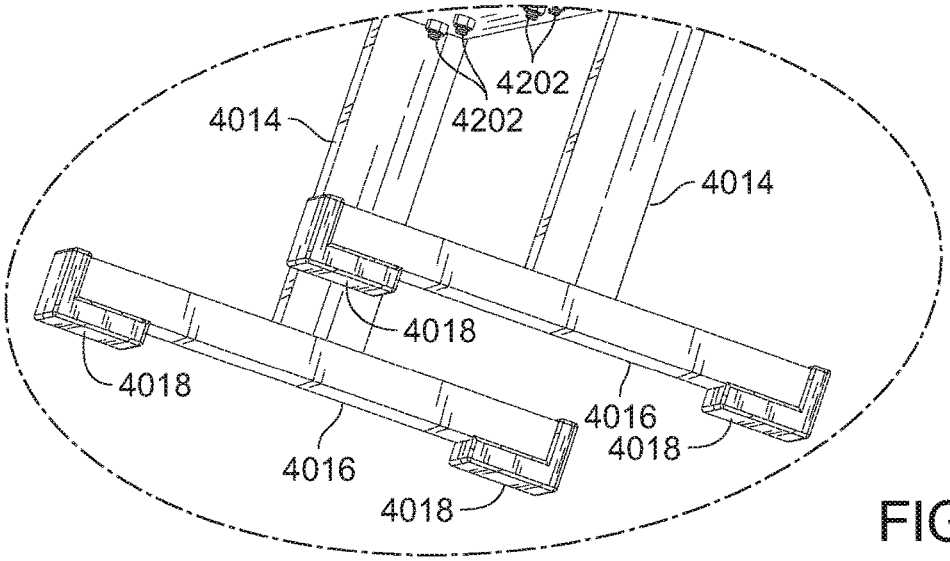
FIG. 48 shows an illustrative apparatus in accordance with principles of the disclosure.

FIG. 48 shows an illustrative bottom perspective view of an enlarged portion of the legs, taken from the circle part in FIG. 47, shown separately for completeness of illustration.

Figure 49:
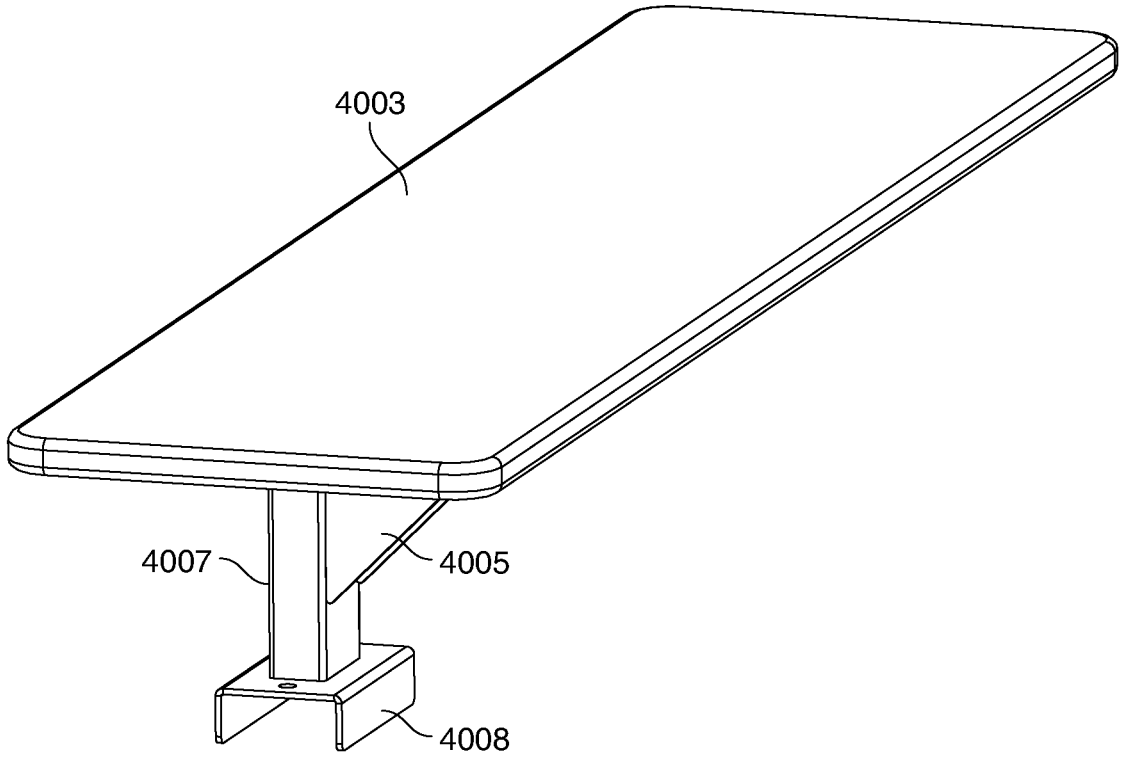
FIG. 49 shows an illustrative apparatus in accordance with principles of the disclosure.

FIG. 49 shows an illustrative top perspective view of bench 4003 and the bench mount. It should be noted that, in FIG. 49, a single bench mount is coupled to bench 4003. In certain embodiments, multiple bench mounts, such as, for example, two bench mounts may couple bench 4003 to rectangular tube 4010.

Figure 50:
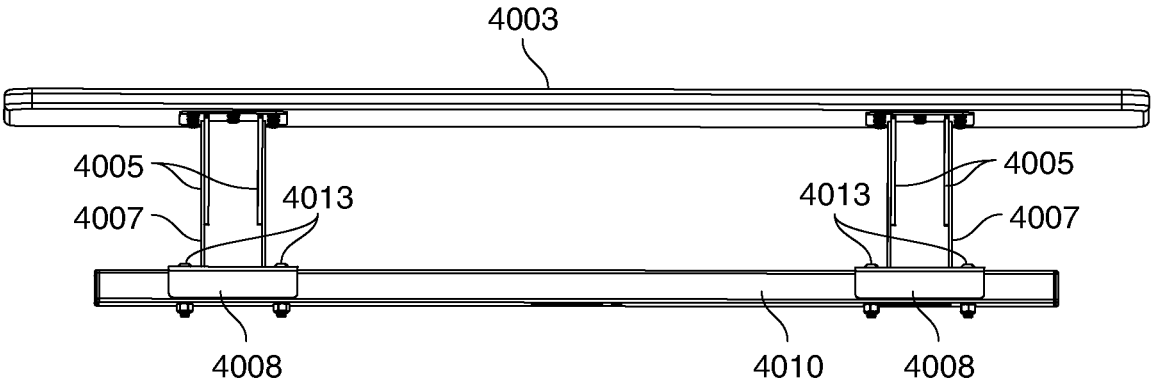
FIG. 50 shows an illustrative apparatus in accordance with principles of the disclosure.

FIG. 50 shows an illustrative side view of bench 4003 mounted, using two bench mounts, to rectangular tube 4010.

Figure 51:
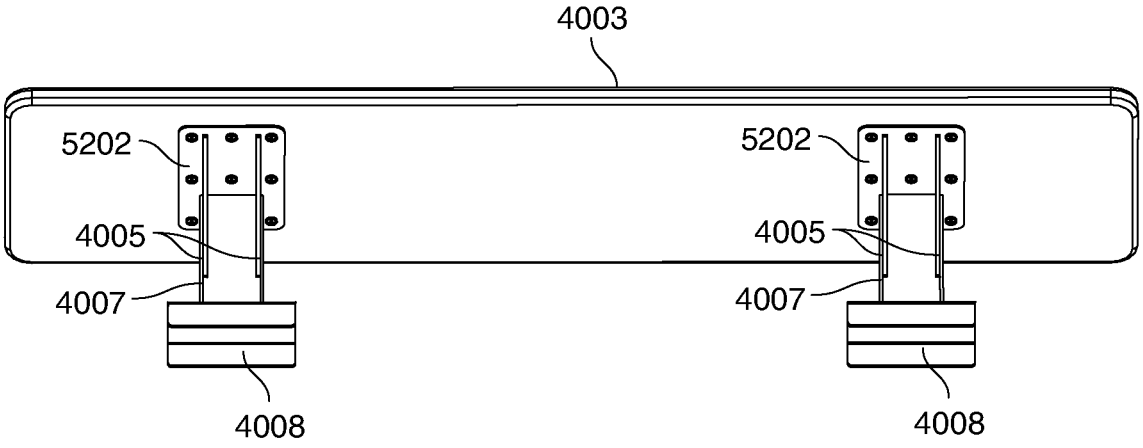
FIG. 51 shows an illustrative apparatus in accordance with principles of the disclosure.

FIG. 51 shows an illustrative bottom perspective view of bench 4003 coupled to two bench mounts. It should be noted that plate 5202 is shown in FIG. 51.

Figure 52:
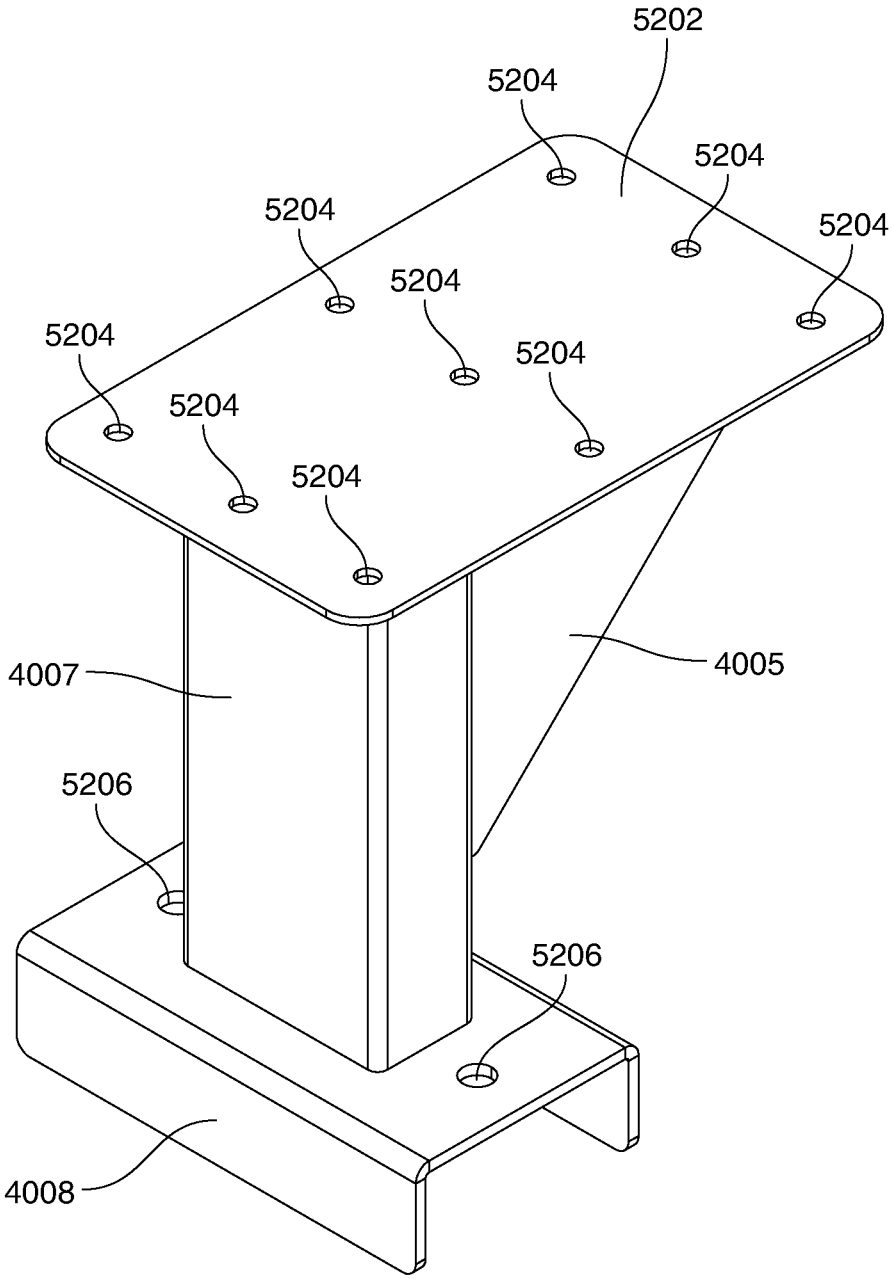
FIG. 52 shows an illustrative apparatus in accordance with principles of the disclosure.

FIG. 52 shown an illustrative perspective view of a bench mount. It should be noted that plate 5202 includes multiple apertures 5204. Each of apertures may be configured to receive a bolt. The bolts may secure plate 5202 to the underside of bench 4003.

Figure 53:
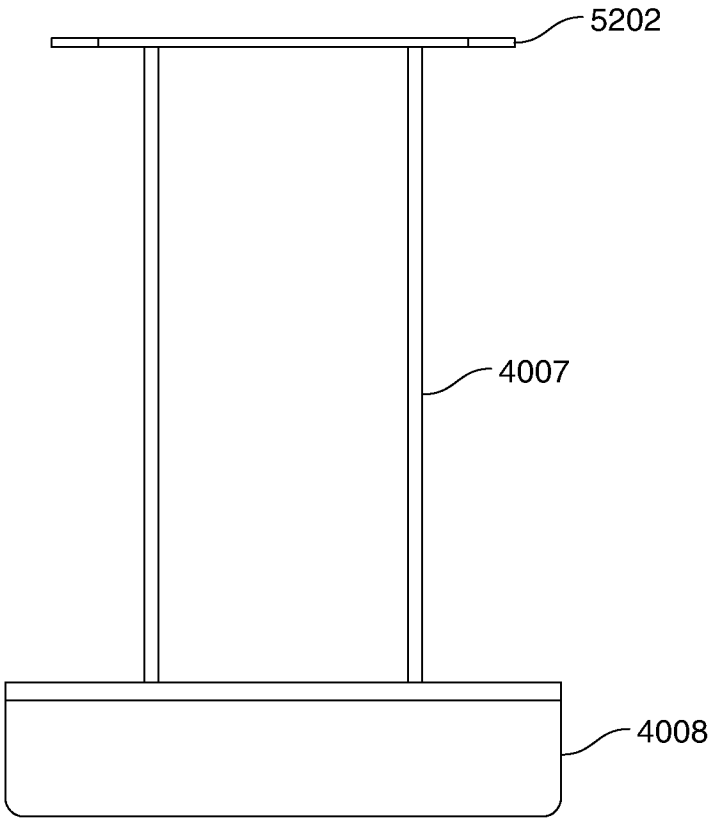
FIG. 53 shows an illustrative apparatus in accordance with principles of the disclosure.

FIG. 53 shows an illustrative front view of the bench mount.

Figure 54:
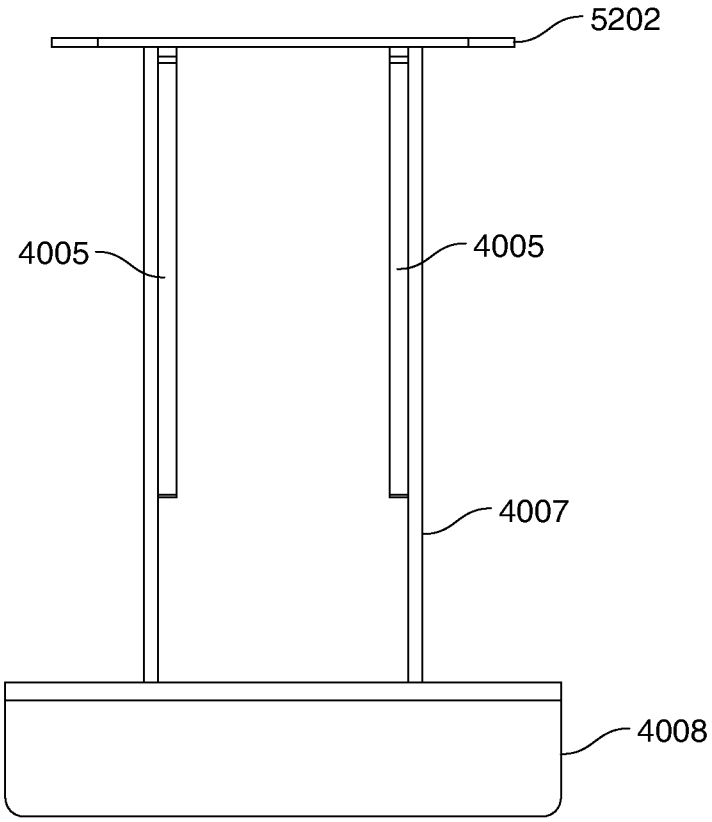
FIG. 54 shows an illustrative apparatus in accordance with principles of the disclosure.

FIG. 54 shows an illustrative back view of the bench mount.

Figure 55:
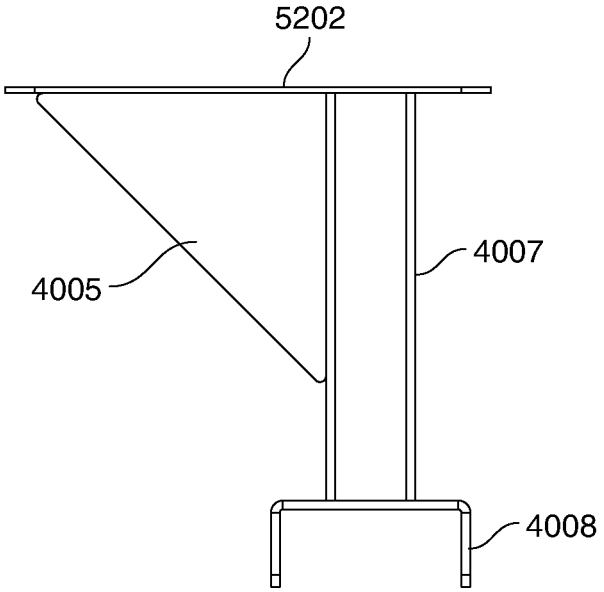
FIG. 55 shows an illustrative apparatus in accordance with principles of the disclosure.

FIG. 55 shows an illustrative side view of the bench mount.

Figure 56:
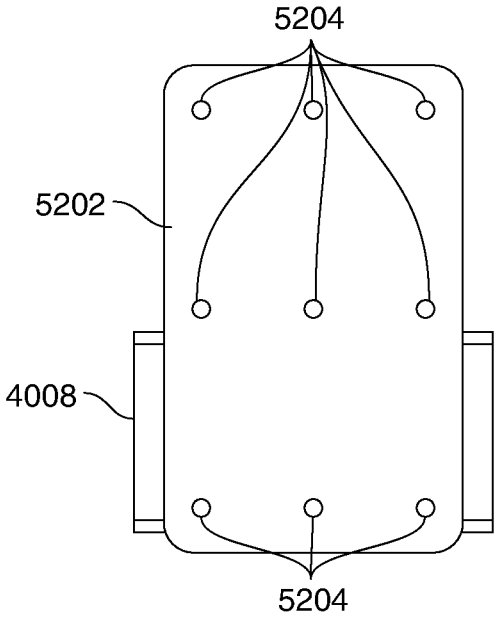
FIG. 56 shows an illustrative apparatus in accordance with principles of the disclosure.

FIG. 56 shows an illustrative top view of the bench mount.

Figure 57:
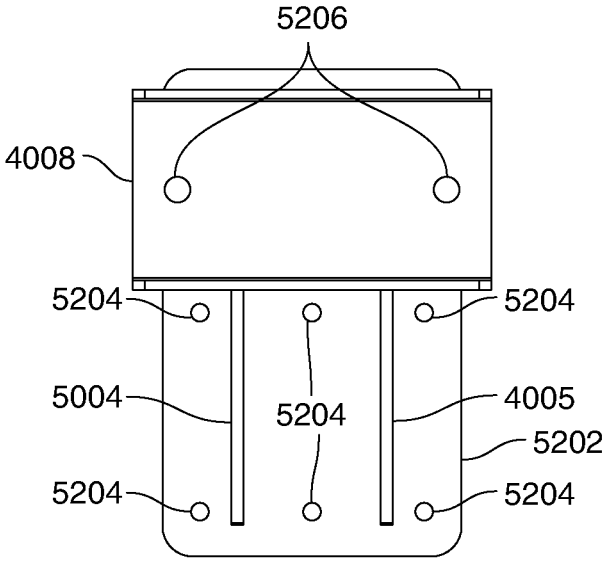
FIG. 57 shows an illustrative apparatus in accordance with principles of the disclosure.

FIG. 57 shows an illustrative bottom view of the bench mount.

Figure 58:
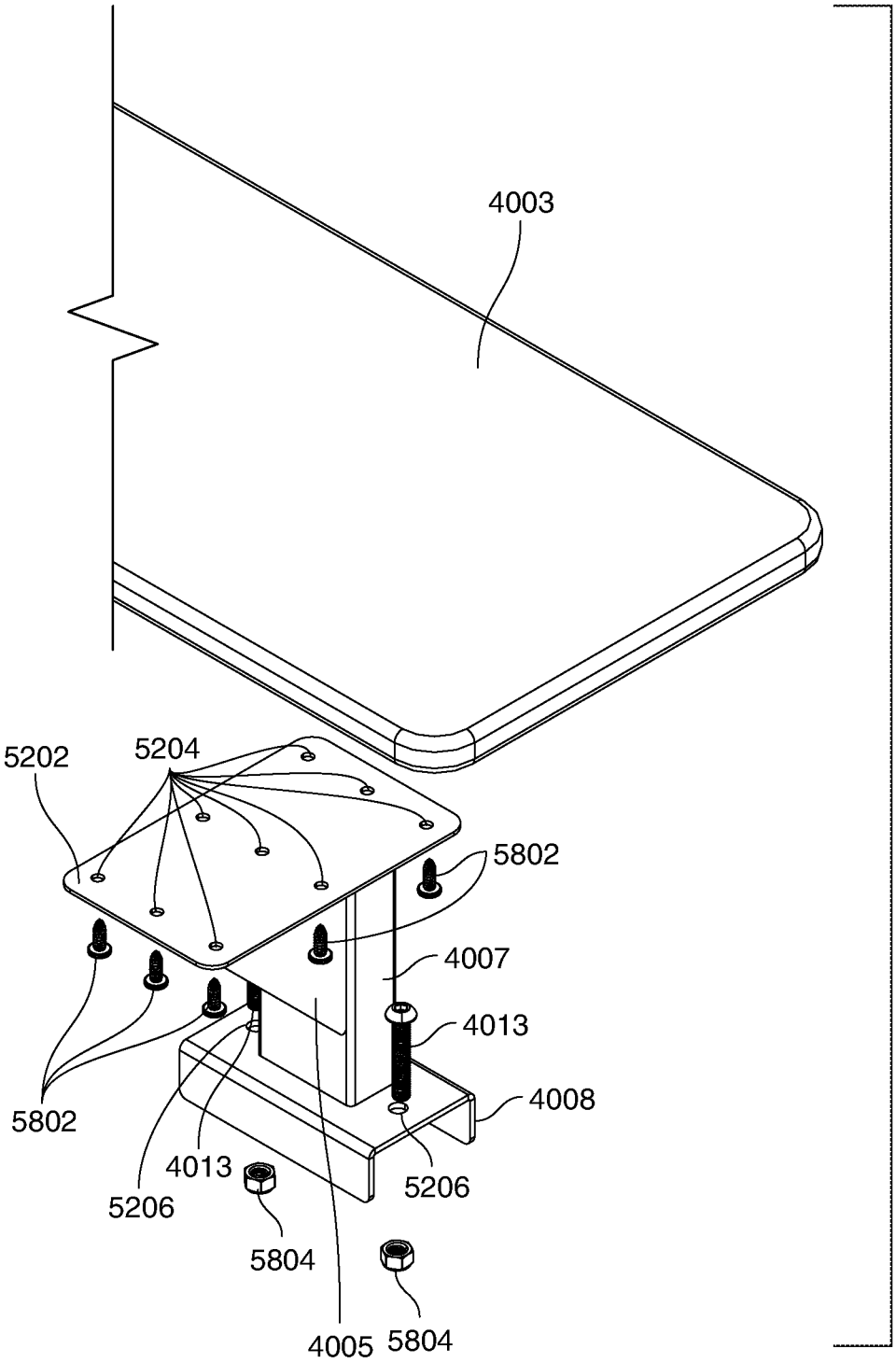
FIG. 58 shows an illustrative apparatus in accordance with principles of the disclosure.

FIG. 58 shows an illustrative exploded perspective view of bench 4003, the bench mount, bolts 5802 (configured to engage apertures 5204), bolts 4013 (configured to engage apertures 5206) and nuts 5804 configured to secure bolts 4013.

Figure 59:
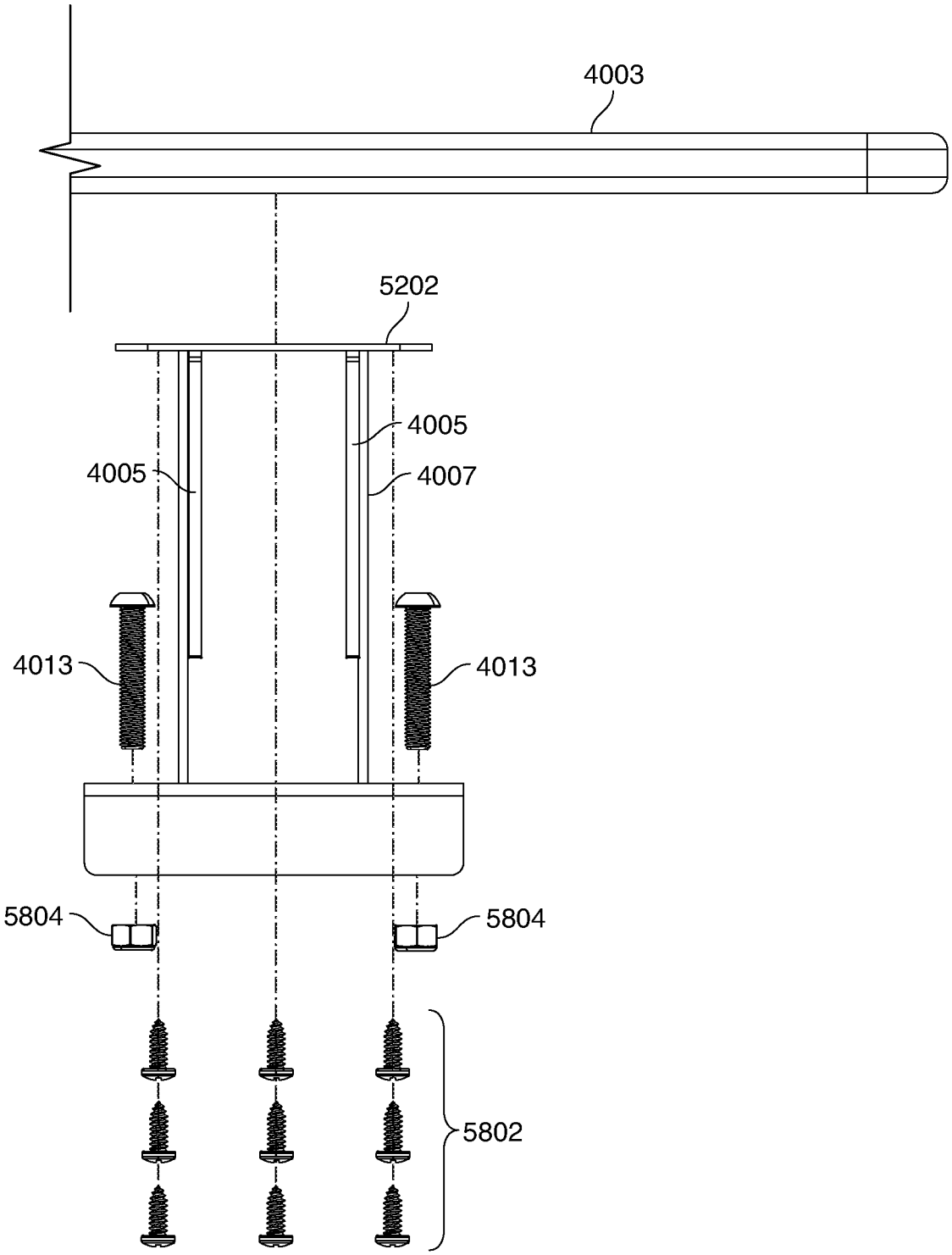
FIG. 59 shows an illustrative apparatus in accordance with principles of the disclosure.

FIG. 59 shows an illustrative exploded side view of bench 4003, the bench mount, bolts 5802 (configured to engage apertures 5204), bolts 4013 (configured to engage apertures 5206) and nuts 5804 configured to secure bolts 4013.

Thus, methods and systems for a cluster booth are provided. Persons skilled in the art will appreciate that the present invention can be practiced by other than the described embodiments, which are presented for purposes of illustration rather than of limitation, and that the present invention is limited only by the claims that follow.

What is claimed is:

1. A cluster booth comprising:

a table, said table coupled via a first rectangular tube to a second rectangular tube;

a seat comprising a protrusion extending from an underside of the seat;

a bracket, said bracket comprising:

a bracket tube;

a u-shaped portion, said u-shaped portion comprising a right face, a left face and a top face, the bracket tube coupled to the top face of the u-shaped portion; and four triangular support flanges, each of said four triangular support flanges comprising a first base side and a second base side, each of said four triangular support flanges coupled by the first base side to the bracket tube and by the second base side to the u-shaped portion;

wherein:

the bracket tube is configured to receive the protrusion; and the u-shaped portion is configured to encase the second rectangular tube on not less than three faces of the second rectangular tube, said second rectangular tube coupled to a set of support structures.

2. The cluster booth of claim 1 wherein:

each of said four triangular support flanges comprises a right triangle;

the first base side is a first leg of the right triangle; and the second base side is a second leg of the right triangle.

3. The cluster booth of claim 1, wherein the u-shaped portion comprises two apertures, each of the two apertures for receiving a bolt, each of the two apertures enabling the u-shaped portion to be secured to the second rectangular tube.

4. The cluster booth of claim 1, wherein:

the protrusion is hollow;

the protrusion comprises two apertures;

the protrusion is configured to receive the bracket tube;

the bracket tube comprises two apertures;

the two apertures included in the bracket tube correspond to the two apertures included in the protrusion; and a bolt is configured to thread through the two apertures included in the bracket tube and the two apertures included in the protrusion to secure the bracket to the seat.

5. A cluster booth comprising:

a table, said table:

coupled via a first rectangular tube to a second rectangular tube; and coupled via a third rectangular tube to a fourth rectangular tube;

a first seat, said first seat comprising a first protrusion extending from an underside of the first seat;

a second seat, said second seat comprising a second protrusion extending from an underside of the second seat;

a third seat, said third seat comprising a third protrusion extending from an underside of the third seat; and a fourth seat, said fourth seat comprising a fourth protrusion extending from an underside of the fourth seat;

a first bracket, said first bracket comprising:

a first tube; and a first u-shaped portion, said first u-shaped portion comprising a first right face, a first left face and a first top face, the first tube coupled to the first top face of the first u-shaped portion;

a second bracket, said second bracket comprising:

a second tube; and a second u-shaped portion, said second u-shaped portion comprising a second right face, a second left face and a second top face, the second tube coupled to the second top face of the second u-shaped portion;

a third bracket, said third bracket comprising:

a third tube; and a third u-shaped portion, said third u-shaped portion comprising a third right face, a third left face and a third top face, the third tube coupled to the third top face of the third u-shaped portion;

a fourth bracket, said fourth bracket comprising:

a fourth tube; and a fourth u-shaped portion, said fourth u-shaped portion comprising a fourth right face, a fourth left face and a fourth top face, the fourth tube coupled to the fourth top face of the fourth u-shaped portion;

wherein:

the first tube is configured to receive the first protrusion;

the second tube is configured to receive the second protrusion;

the third tube is configured to receive the third protrusion;

the fourth tube is configured to receive the fourth protrusion;

the first u-shaped portion and the second u-shaped portion are configured to encase the second rectangular tube on at least three faces of the second rectangular tube, said second rectangular tube coupled to a first set of support structures;

the third u-shaped portion and the fourth u-shaped portion are configured to encase the fourth rectangular tube on at least three faces of the fourth rectangular tube, said fourth rectangular tube coupled to a second set of support structures a first angle formed by the intersection of an underside of the table and a top face of the first rectangular tube is less than 90 degrees; and a second angle formed by the intersection of the underside of the table and a top face of the third rectangular tube is equivalent to the first angle.

6. The cluster booth of claim 5 further comprising a fifth bracket and a sixth bracket, wherein:

the fifth bracket comprises a first u-shape;

a top face of the fifth bracket is welded to the first rectangular tube;

the fifth bracket is configured to encase the second rectangular tube on at least three faces of the second rectangular tube;

a first angle formed by a top face of the second rectangular tube and a bottom face of the first rectangular tube is less than 90 degrees;

the sixth bracket comprises a second u-shape;

a top face of the sixth bracket is welded to the third rectangular tube;

the sixth bracket is configured to encase the fourth rectangular tube on at least three faces of the fourth rectangular tube; and a second angle formed by a top face of the fourth rectangular tube and a bottom face of the third rectangular tube is equivalent to the first angle.

7. The cluster booth of claim 5 wherein the first bracket further comprises four triangular support flanges, each of said four triangular support flanges comprising a first base side and a second base side, each of said four triangular support flanges coupled by the first base side to the first tube and by the second base side to the first u-shaped portion.

8. The cluster booth of claim 7 wherein:

each of said four triangular support flanges comprises a right triangle;

the first base side is a first leg of the right triangle; and the second base side is a second leg of the right triangle.

9. The cluster booth of claim 5, wherein the first u-shaped portion comprises two apertures, each of the two apertures for receiving a bolt, each of the two apertures enabling the first u-shaped portion to be secured to the second rectangular tube.

10. The cluster booth of claim 5, wherein:

the first protrusion is hollow;

the first protrusion comprises two apertures;

the first protrusion is configured to receive the first tube;

the first tube comprises two apertures;

the two apertures included in the first tube correspond to the two apertures included in the first protrusion; and a bolt is configured to thread through the two apertures included in the first tube and the two apertures included in the first protrusion to secure the first bracket to the first seat.

11. A cluster booth comprising:

a table, said table coupled via a first rectangular tube to a second rectangular tube;

a bench;

a set of support structures; and a support bracket, said support bracket comprising:

a plate, said plate comprising:

a top face;

a bottom face; and a plurality of apertures;

a rectangular bracket tube, said rectangular bracket tube comprising:

four faces, said four faces comprising a first face;

a proximal end; and a distal end;

a first triangular support flange comprising a right triangle;

a second triangular support flange comprising a right triangle; and a u-shaped portion, said u-shaped portion comprising a right face, a left face and a top face, wherein:

the distal end of the rectangular bracket tube is coupled to the bottom face of the plate;

the plurality of apertures is configured to receive a plurality of bolts, said plurality of bolts for coupling the support bracket to an underside of the bench;

the proximal end of the rectangular bracket tube is coupled to the top face of the u-shaped portion;

the first triangular support flange comprises a first base side and a second base side, the first triangular support flange coupled by the first base side to a right side of the first face of the rectangular bracket tube and by the second base side to the bottom face of the plate, the first base side is a first leg of the right triangle, the second base side is a second leg of the right triangle;

the second triangular support flange comprises a first base side and a second base side, the second triangular support flange coupled by the first base side to a left side of the first face of the rectangular bracket tube and by the second base side to the bottom face of the plate, the first base side is a first leg of the right triangle, the second base side is a second leg of the right triangle; and the u-shaped portion is configured to encase the second rectangular tube on not less than three faces of the second rectangular tube, said second rectangular tube coupled to the set of support structures.

12. The cluster booth of claim 11, wherein the u-shaped portion comprises two apertures, each of the two apertures for receiving a bolt, each of the two apertures enabling the u-shaped portion to be secured to the second rectangular tube.

13. The cluster booth of claim 11, wherein an angle formed by the intersection of an underside of the table and a top face of the first rectangular tube is less than 90 degrees.

14. The cluster booth of claim 11, wherein an angle formed by the intersection of a bottom face of the first rectangular tube and a top face of the second rectangular tube is less than 90 degrees.

15. A cluster booth comprising:

a table, said table:

coupled via a first rectangular tube to a second rectangular tube; and coupled via a third rectangular tube to a fourth rectangular tube;

a first bench;

a second bench;

a first set of support structures, said first set of support structures coupled to the second rectangular tube;

a second set of support structures, said second set of support structures coupled to the fourth rectangular tube;

a plurality of support brackets, the plurality of support brackets comprising a first support bracket, a second support bracket, a third support bracket, and a fourth support bracket, each support bracket included in the plurality of support brackets comprising:

a plate, said plate comprising:

a top face;

a bottom face; and a plurality of apertures;

a rectangular bracket tube, said rectangular bracket tube comprising:

four faces, said four faces comprising a first face;

a proximal end; and a distal end;

a first triangular support flange, said first triangular support flange comprising a right triangle;

a second triangular support flange, said second triangular support flange comprising a right triangle;

a u-shaped portion, said u-shaped portion comprising a right face, a left face and a top face;

wherein:

for the first support bracket:

the distal end of the rectangular bracket tube is coupled to the bottom face of the plate;

the plurality of apertures is configured to receive a plurality of bolts;

the support bracket is coupled to the first bench when the plurality of bolts is engaged with the first bench through the plurality of apertures;

the proximal end of the rectangular bracket tube is coupled to the top face of the u-shaped portion;

the first triangular support flange comprises:

a first base side; and a second base side;

the first triangular support flange:

is coupled by the first base side to a right side of the first face of the rectangular bracket tube; and is coupled by the second base side to the bottom face of the plate;

the second triangular support flange comprises:

a first base side; and a second base side;

the second triangular support flange:

is coupled by the first base side to a left side of the first face of the rectangular bracket tube; and is coupled by the second base side to the bottom face of the plate;

the u-shaped portion is configured to encase the second rectangular tube on not less than three faces of the second rectangular tube;

for the second support bracket:

the distal end of the rectangular bracket tube is coupled to the bottom face of the plate;

the plurality of apertures is configured to receive a plurality of bolts;

the support bracket is coupled to the first bench when the plurality of bolts is engaged with the first bench through the plurality of apertures;

the proximal end of the rectangular bracket tube is coupled to the top face of the u-shaped portion;

the first triangular support flange comprises:

a first base side; and a second base side;

the first triangular support flange:

is coupled by the first base side to a right side of the first face of the rectangular bracket tube; and is coupled by the second base side to the bottom face of the plate;

the second triangular support flange comprises:

a first base side; and a second base side;

the second triangular support flange:

is coupled by the first base side to a left side of the first face of the rectangular bracket tube; and is coupled by the second base side to the bottom face of the plate;

the u-shaped portion is configured to encase the second rectangular tube on not less than three faces of the second rectangular tube;

for the third support bracket:

the distal end of the rectangular bracket tube is coupled to the bottom face of the plate;

the plurality of apertures is configured to receive a plurality of bolts;

the support bracket is coupled to the second bench when the plurality of bolts is engaged with the second bench through the plurality of apertures;

the proximal end of the rectangular bracket tube is coupled to the top face of the u-shaped portion;

the first triangular support flange comprises:

a first base side; and a second base side;

the first triangular support flange:

is coupled by the first base side to a right side of the first face of the rectangular bracket tube; and is coupled by the second base side to the bottom face of the plate;

the second triangular support flange comprises:

a first base side; and a second base side;

the second triangular support flange:

is coupled by the first base side to a left side of the first face of the rectangular bracket tube; and is coupled by the second base side to the bottom face of the plate;

the u-shaped portion is configured to encase the fourth rectangular tube on not less than three faces of the fourth rectangular tube;

for the fourth support bracket:

the distal end of the rectangular bracket tube is coupled to the bottom face of the plate;

the plurality of apertures is configured to receive a plurality of bolts;

the support bracket is coupled to the second bench when the plurality of bolts is engaged with the second bench through the plurality of apertures;

the proximal end of the rectangular bracket tube is coupled to the top face of the u-shaped portion;

the first triangular support flange comprises:

a first base side; and a second base side;

the first triangular support flange:

is coupled by the first base side to a right side of the first face of the rectangular bracket tube; and is coupled by the second base side to the bottom face of the plate;

the second triangular support flange comprises:

a first base side; and a second base side;

the second triangular support flange:

is coupled by the first base side to a left side of the first face of the rectangular bracket tube; and is coupled by the second base side to the bottom face of the plate;

the u-shaped portion is configured to encase the fourth rectangular tube on not less than three faces of the fourth rectangular tube.

16. The cluster booth of claim 15, wherein:

the u-shaped portion of the first support bracket comprises two apertures, each of the two apertures for receiving a bolt, each of the two apertures enabling the u-shaped portion of the first support bracket to be secured to the second rectangular tube;

the u-shaped portion of the second support bracket comprises two apertures, each of the two apertures for receiving a bolt, each of the two apertures enabling the u-shaped portion of the second support bracket to be secured to the second rectangular tube;

the u-shaped portion of the third support bracket comprises two apertures, each of the two apertures for receiving a bolt, each of the two apertures enabling the u-shaped portion of the third support bracket to be secured to the fourth rectangular tube; and the u-shaped portion of the fourth support bracket comprises two apertures, each of the two apertures for receiving a bolt, each of the two apertures enabling the u-shaped portion of the fourth support bracket to be secured to the fourth rectangular tube.

17. The cluster booth of claim 15, wherein an angle formed by the intersection of an underside of the table and a top face of the first rectangular tube is less than 90 degrees.

18. The cluster booth of claim 15, wherein an angle formed by the intersection of a bottom face of the first rectangular tube and a top face of the second rectangular tube is less than 90 degrees.

* * * * *